US009173437B2

(12) United States Patent
VanDerWoude et al.

(10) Patent No.: US 9,173,437 B2
(45) Date of Patent: Nov. 3, 2015

(54) MEDICAL/SURGICAL PERSONAL PROTECTION SYSTEM INCLUDING A HELMET AND A HOOD, THE HELMET HAVING CHIN BAR-MOUNTED CONTROLS

(71) Applicant: Stryker Corporation, Kalamazoo, MI (US)

(72) Inventors: Brian VanDerWoude, Portage, MI (US); Douglas Campbell, Kalamazoo, MI (US); Marshall Proulx, Keller, TX (US); Adam Sclafani, Uniontown, OH (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 14/461,480

(22) Filed: Aug. 18, 2014

(65) Prior Publication Data

US 2014/0352037 A1 Dec. 4, 2014

Related U.S. Application Data

(62) Division of application No. 13/616,010, filed on Sep. 14, 2012, now Pat. No. 8,819,869, which is a division of application No. 12/813,084, filed on Jun. 10, 2010, now Pat. No. 8,282,234, which is a division of (Continued)

(51) Int. Cl.
*A42B 1/06* (2006.01)
*A41D 13/002* (2006.01)

(Continued)

(52) U.S. Cl.
CPC ..... *A41D 13/0025* (2013.01); *A41D 13/1153* (2013.01); *A41D 13/1209* (2013.01);

(Continued)

(58) Field of Classification Search
CPC ..... A42B 3/322; A42B 1/046; A41G 7/00; A62B 17/006; A62B 17/04; A62B 18/04; A61F 9/02; A61M 2016/0493
USPC ..... 2/410, 69, 84, 15, 171, 2.14, 171.3, 2/202, 206, 428, 901, 909; 128/201.23, 128/201.24, 200.24, 200.26, 857, 858, 863
See application file for complete search history.

(56) References Cited

U.S. PATENT DOCUMENTS 3,963,021 A 6/1976 Bancroft
4,280,491 A 7/1981 Berg et al.

(Continued)

FOREIGN PATENT DOCUMENTS

EP 0 199 449 A2 10/1986
EP 0 338 714 A2 10/1989

(Continued)

OTHER PUBLICATIONS

"U.S. Appl. No. 60/664,900", filed Mar. 24, 2005.

(Continued)

*Primary Examiner* — Tejash Patel

(57) ABSTRACT

A personal protection system for providing a sterile barrier around medical/surgical personnel. The system includes a helmet over which a hood or a toga suspended. The helmet has a chin bar that extends forward of the face of the individual wearing the system. At least one manually actuated control for regulating one aspect of operation of the system is mounted to the chin bar. Sometimes the control is a button that is depressed to control the operation of a helmet mounted fan that draws air into the hood or toga. A microphone may also be mounted to the chin bar.

24 Claims, 47 Drawing Sheets

Related U.S. Application Data application No. 11/485,783, filed on Jul. 13, 2006, now Pat. No. 7,735,156.

(60) Provisional application No. 60/699,166, filed on Jul. 14, 2005.

(51) Int. Cl.

| | |
|---|---|
| ***A42B 3/32*** | (2006.01) |
| ***A41D 13/11*** | (2006.01) |
| ***A41D 13/12*** | (2006.01) |
| ***A42B 3/28*** | (2006.01) |
| ***A62B 17/04*** | (2006.01) |
| ***A62B 18/00*** | (2006.01) |
| ***A62B 18/04*** | (2006.01) |
| ***A42B 3/30*** | (2006.01) |

(52) U.S. Cl.

CPC . *A42B3/286* (2013.01); *A42B 3/30* (2013.01); *A42B 3/322* (2013.01); *A62B 17/04* (2013.01); *A62B 18/003* (2013.01); *A62B 18/045* (2013.01)

(56) References Cited

U.S. PATENT DOCUMENTS

| | | | |
|---|---|---|---|
| 4,890,335 | A | 1/1990 | Crowson |
| 4,901,716 | A | 2/1990 | Stackhouse et al. |
| 5,009,225 | A | 4/1991 | Vrabel |
| 5,054,480 | A | 10/1991 | Bare et al. |
| 5,592,936 | A | 1/1997 | Thomas et al. |
| 5,652,964 | A | 8/1997 | Reinheardt |
| 5,887,281 | A | 3/1999 | Green et al. |
| 6,249,918 | B1 | 6/2001 | Lacroix |
| 6,393,617 | B1 | 5/2002 | Paris et al. |
| 6,481,019 | B2 | 11/2002 | Diaz et al. |
| 6,711,748 | B2 | 3/2004 | Paris et al. |
| 6,751,807 | B2 | 6/2004 | Klotz et al. |
| 6,973,677 | B2 | 12/2005 | Diza et al. |
| 6,990,691 | B2 | 1/2006 | Klotz et al. |
| 7,200,873 | B2 | 4/2007 | Klotz et al. |
| 7,534,005 | B1 | 5/2009 | Buckman |
| 7,937,775 | B2 | 5/2011 | Manzella et al. |
| 8,234,722 | B2 | 8/2012 | VanDerWoude et al. |
| 8,282,234 | B2 * | 10/2012 | VanDerWoude et al. ..... 362/106 |
| 8,464,366 | B2 | 6/2013 | Carron |
| 8,819,869 | B2 * | 9/2014 | VanDerWoude et al. ..... 2/410 |
| 2001/0032348 | A1 | 10/2001 | Diaz et al. |
| 2003/0083112 | A1 | 5/2003 | Fukuda |
| 2005/0010992 | A1 | 1/2005 | Klota et al. |
| 2005/0109337 | A1 | 5/2005 | Diaz et al. |
| 2005/0117327 | A1 | 6/2005 | Gupta et al. |
| 2006/0133069 | A1 | 6/2006 | Clupper et al. |
| 2007/0050898 | A1 | 3/2007 | Larson et al. |

FOREIGN PATENT DOCUMENTS

| | | | |
|---|---|---|---|
| EP | 0 465 971 | A2 | 1/1992 |
| JP | 63-199132 | A | 12/1988 |
| JP | 06-023001 | A | 2/1994 |
| WO | 01/14013 | A1 | 3/2001 |
| WO | 2007/011646 | A | 1/2007 |

OTHER PUBLICATIONS

"EPO ISA Written Opinion" for PCT App. No. PCT/US2006/027214, Feb. 2007.

"EPO International Search Report" for PCT App. No. PCT/US2006/027214, Feb. 2007.

"Stryker Instruments, T-4 fiber Optic Surgical Helmet Assembly, Eng. Drawings", May 2000, Kalamazoo, MI.

"Stryker Instruments, T4 Personal Protection System, T4 Fiber Optic Surgical Helmet, Instructions for Use", Jun. 2004, Kalamazoo, MI.

IP Australia, "Examination Report" for AU Application No. 2013202901, Nov. 2013.

* cited by examiner 122
120
20
20
12
14
16
10

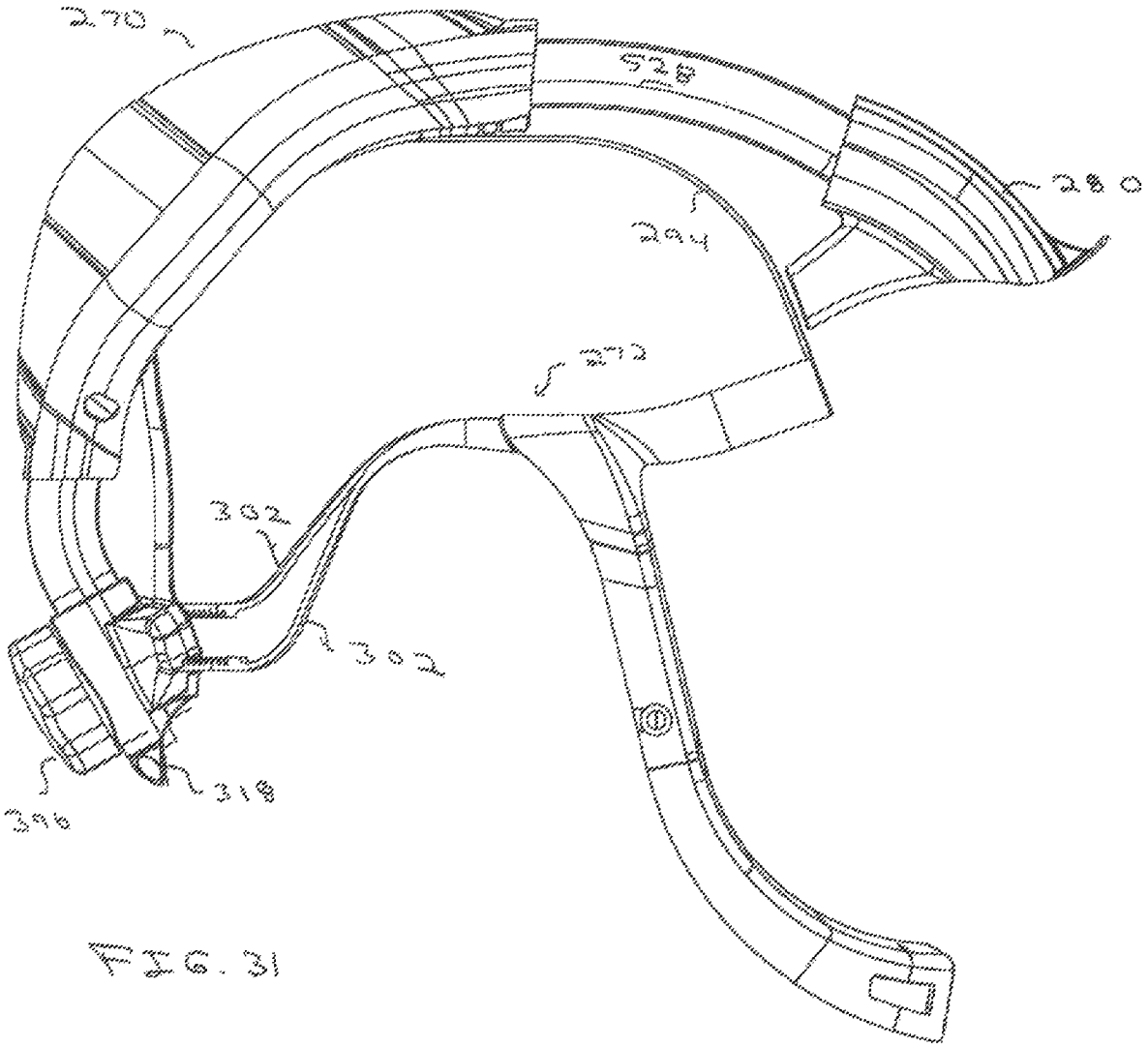
2a0
2a8
2b8
2b0
2b2
2b4
2b6
2b8
2c0
2c2
2c4
2c6
2c8
2d0
2d2
2d4
2d6
2d8
2e0
2e2
2e4
2e6
2e8
2f0
2f2
2f4
2f6
2f8
2g0
2g2
2g4
2g6
2g8
2h0
2h2
2h4
2h6
2h8
2i0
2i2
2i4
2i6
2i8
2j0
2j2
2j4
2j6
2j8
2k0
2k2
2k4
2k6
2k8
2l0
2l2
2l4
2l6
2l8
2m0
2m2
2m4
2m6
2m8
2n0
2n2
2n4
2n6
2n8
2o0
2o2
2o4
2o6
2o8
2p0
2p2
2p4
2p6
2p8
2q0
2q2
2q4
2q6
2q8
2r0
2r2
2r4
2r6
2r8
2s0
2s2
2s4
2s6
2s8
2t0
2t2
2t4
2t6
2t8
2u0
2u2
2u4
2u6
2u8
2v0
2v2
2v4
2v6
2v8
2w0
2w2
2w4
2w6
2w8
2x0
2x2
2x4
2x6
2x8
2y0
2y2
2y4
2y6
2y8
2z0
2z2
2z4
2z6
2z8
3a0
3a2
3a4
3a6
3a8
3b0
3b2
3b4
3b6
3b8
3c0
3c2
3c4
3c6
3c8
3d0
3d2
3d4
3d6
3d8
3e0
3e2
3e4
3e6
3e8
3f0
3f2
3f4
3f6
3f8
3g0
3g2
3g4
3g6
3g8
3h0
3h2
3h4
3h6
3h8
3i0
3i2
3i4
3i6
3i8
3j0
3j2
3j4
3j6
3j8
3k0
3k2
3k4
3k6
3k8
3l0
3l2
3l4
3l6
3l8
3m0
3m2
3m4
3m6
3m8
3n0
3n2
3n4
3n6
3n8
3o0
3o2
3o4
3o6
3o8
3p0
3p2
3p4
3p6
3p8
3q0
3q2
3q4
3q6
3q8
3r0
3r2
3r4
3r6
3r8
3s0
3s2
3s4
3s6
3s8
3t0
3t2
3t4
3t6
3t8
3u0
3u2
3u4
3u6
3u8
3v0
3v2
3v4
3v6
3v8
3w0
3w2
3w4
3w6
3w8
3x0
3x2
3x4
3x6
3x8
3y0
3y2
3y4
3y6
3y8
3z0
3z2
3z4
3z6
3z8
4a0
4a2
4a4
4a6
4a8
4b0
4b2
4b4
4b6
4b8
4c0
4c2
4c4
4c6
4c8
4d0
4d2
4d4
4d6
4d8
4e0
4e2
4e4
4e6
4e8
4f0
4f2
4f4
4f6
4f8
4g0
4g2
4g4
4g6
4g8
4h0
4h2
4h4
4h6
4h8
4i0
4i2
4i4
4i6
4i8
4j0
4j2
4j4
4j6
4j8
4k0
4k2
4k4
4k6
4k8
4l0
4l2
4l4
4l6
4l8
4m0
4m2
4m4
4m6
4m8
4n0
4n2
4n4
4n6
4n8
4o0
4o2
4o4
4o6
4o8
4p0
4p2
4p4
4p6
4p8
4q0
4q2
4q4
4q6
4q8
4r0
4r2
4r4
4r6
4r8
4s0
4s2
4s4
4s6
4s8
4t0
4t2
4t4
4t6
4t8
4u0
4u2
4u4
4u6
4u8
4v0
4v2
4v4
4v6
4v8
4w0
4w2
4w4
4w6
4w8
4x0
4x2
4x4
4x6
4x8
4y0
4y2
4y4
4y6
4y8
4z0
4z2
4z4
4z6
4z8
5a0
5a2
5a4
5a6
5a8
5b0
5b2
5b4
5b6
5b8
5c0
5c2
5c4
5c6
5c8
5d0
5d2
5d4
5d6
5d8
5e0
5e2
5e4
5e6
5e8
5f0
5f2
5f4
5f6
5f8
5g0
5g2
5g4
5g6
5g8
5h0
5h2
5h4
5h6
5h8
5i0
5i2
5i4
5i6
5i8
5j0
5j2
5j4
5j6
5j8
5k0
5k2
5k4
5k6
5k8
5l0
5l2
5l4
5l6
5l8
5m0
5m2
5m4
5m6
5m8
5n0
5n2
5n4
5n6
5n8
5o0
5o2
5o4
5o6
5o8
5p0
5p2
5p4
5p6
5p8
5q0
5q2
5q4
5q6
5q8
5r0
5r2
5r4
5r6
5r8
5s0
5s2
5s4
5s6
5s8
5t0
5t2
5t4
5t6
5t8
5u0
5u2
5u4
5u6
5u8
5v0
5v2
5v4
5v6
5v8
5w0
5w2
5w4
5w6
5w8
5x0
5x2
5x4
5x6
5x8
5y0
5y2
5y4
5y6
5y8
5z0
5z2
5z4
5z6
5z8
6a0
6a2
6a4
6a6
6a8
6b0
6b2
6b4
6b6
6b8
6c0
6c2
6c4
6c6
6c8
6d0
6d2
6d4
6d6
6d8
6e0
6e2
6e4
6e6
6e8
6f0
6f2
6f4
6f6
6f8
6g0
6g2
6g4
6g6
6g8
6h0
6h2
6h4
6h6
6h8
6i0
6i2
6i4
6i6
6i8
6j0
6j2
6j4
6j6
6j8
6k0
6k2
6k4
6k6
6k8
6l0
6l2
6l4
6l6
6l8
6m0
6m2
6m4
6m6
6m8
6n0
6n2
6n4
6n6
6n8
6o0
6o2
6o4
6o6
6o8
6p0
6p2
6p4
6p6
6p8
6q0
6q2
6q4
6q6
6q8
6r0
6r2
6r4
6r6
6r8
6s0
6s2
6s4
6s6
6s8
6t0
6t2
6t4
6t6
6t8
6u0
6u2
6u4
6u6
6u8
6v0
6v2
6v4
6v6
6v8
6w0
6w2
6w4
6w6
6w8
6x0
6x2
6x4
6x6
6x8
6y0
6y2
6y4
6y6
6y8
6z0
6z2
6z4
6z6
6z8
7a0
7a2
7a4
7a6
7a8
7b0
7b2
7b4
7b6
7b8
7c0
7c2
7c4
7c6
7c8
7d0
7d2
7d4
7d6
7d8
7e0
7e2
7e4
7e6
7e8
7f0
7f2
7f4
7f6
7f8
7g0
7g2
7g4
7g6
7g8
7h0
7h2
7h4
7h6
7h8
7i0
7i2
7i4
7i6
7i8
7j0
7j2
7j4
7j6
7j8
7k0
7k2
7k4
7k6
7k8
7l0
7l2
7l4
7l6
7l8
7m0
7m2
7m4
7m6
7m8
7n0
7n2
7n4
7n6
7n8
7o0
7o2
7o4
7o6
7o8
7p0
7p2
7p4
7p6
7p8
7q0
7q2
7q4
7q6
7q8
7r0
7r2
7r4
7r6
7r8
7s0
7s2
7s4
7s6
7s8
7t0
7t2
7t4
7t6
7t8
7u0
7u2
7u4
7u6
7u8
7v0
7v2
7v4
7v6
7v8
7w0
7w2
7w4
7w6
7w8
7x0
7x2
7x4
7x6
7x8
7y0
7y2
7y4
7y6
7y8
7z0
7z2
7z4
7z6
7z8
8a0
8a2
8a4
8a6
8a8
8b0
8b2
8b4
8b6
8b8
8c0
8c2
8c4
8c6
8c8
8d0
8d2
8d4
8d6
8d8
8e0
8e2
8e4
8e6
8e8
8f0
8f2
8f4
8f6
8f8
8g0
8g2
8g4
8g6
8g8
8h0
8h2
8h4
8h6
8h8
8i0
8i2
8i4
8i6
8i8
8j0
8j2
8j4
8j6
8j8
8k0
8k2
8k4
8k6
8k8
8l0
8l2
8l4
8l6
8l8
8m0
8m2
8m4
8m6
8m8
8n0
8n2
8n4
8n6
8n8
8o0
8o2
8o4
8o6
8o8
8p0
8p2
8p4
8p6
8p8
8q0
8q2
8q4
8q6
8q8
8r0
8r2
8r4
8r6
8r8
8s0
8s2
8s4
8s6
8s8
8t0
8t2
8t4
8t6
8t8
8u0
8u2
8u4
8u6
8u8
8v0
8v2
8v4
8v6
8v8
8w0
8w2
8w4
8w6
8w8
8x0
8x2
8x4
8x6
8x8
8y0
8y2
8y4
8y6
8y8
8z0
8z2
8z4
8z6
8z8
9a0
9a2
9a4
9a6
9a8
9b0
9b2
9b4
9b6
9b8
9c0
9c2
9c4
9c6
9c8
9d0
9d2
9d4
9d6
9d8
9e0
9e2
9e4
9e6
9e8
9f0
9f2
9f4
9f6
9f8
9g0
9g2
9g4
9g6
9g8
9h0
9h2
9h4
9h6
9h8
9i0
9i2
9i4
9i6
9i8
9j0
9j2
9j4
9j6
9j8
9k0
9k2
9k4
9k6
9k8
9l0
9l2
9l4
9l6
9l8
9m0
9m2
9m4
9m6
9m8
9n0
9n2
9n4
9n6
9n8
9o0
9o2
9o4
9o6
9o8
9p0
9p2
9p4
9p6
9p8
9q0
9q2
9q4
9q6
9q8
9r0
9r2
9r4
9r6
9r8
9s0
9s2
9s4
9s6
9s8
9t0
9t2
9t4
9t6
9t8
9u0
9u2
9u4
9u6
9u8
9v0
9v2
9v4
9v6
9v8
9w0
9w2
9w4
9w6
9w8
9x0
9x2
9x4
9x6
9x8
9y0
9y2
9y4
9y6
9y8
9z0
9z2
9z4
9z6
9z8
10a0
10a2
10a4
10a6
10a8
10b0
10b2
10b4
10b6
10b8
10c0
10c2
10c4
10c6
10c8
10d0
10d2
10d4
10d6
10d8
10e0
10e2
10e4
10e6
10e8
10f0
10f2
10f4
10f6
10f8
10g0
10g2
10g4
10g6
10g8
10h0
10h2
10h4
10h6
10h8
10i0
10i2
10i4
10i6
10i8
10j0
10j2
10j4
10j6
10j8
10k0
10k2
10k4
10k6
10k8
10l0
10l2
10l4
10l6
10l8
10m0
10m2
10m4
10m6
10m8
10n0
10n2
10n4
10n6
10n8
10o0
10o2
10o4
10o6
10o8
10p0
10p2
10p4
10p6
10p8
10q0
10q2
10q4
10q6
10q8
10r0
10r2
10r4
10r6
10r8
10s0
10s2
10s4
10s6
10s8
10t0
10t2
10t4
10t6
10t8
10u0
10u2
10u4
10u6
10u8
10v0
10v2
10v4
10v6
10v8
10w0
10w2
10w4
10w6
10w8
10x0
10x2
10x4
10x6
10x8
10y0
10y2
10y4
10y6
10y8
10z0
10z2
10z4
10z6
10z8
11a0
11a2
11a4
11a6
11a8
11b0
11b2
11b4
11b6
11b8
11c0
11c2
11c4
11c6
11c8
11d0
11d2
11d4
11d6
11d8
11e0
11e2
11e4
11e6
11e8
11f0
11f2
11f4
11f6
11f8
11g0
11g2
11g4
11g6
11g8
11h0
11h2
11h4
11h6
11h8
11i0
11i2
11i4
11i6
11i8
11j0
11j2
11j4
11j6
11j8
11k0
11k2
11k4
11k6
11k8
11l0
11l2
11l4
11l6
11l8
11m0
11m2
11m4
11m6
11m8
11n0
11n2
11n4
11n6
11n8
11o0
11o2
11o4
11o6
11o8
11p0
11p2
11p4
11p6
11p8
11q0
11q2
11q4
11q6
11q8
11r0
11r2
11r4
11r6
11r8
11s0
11s2
11s4
11s6
11s8
11t0
11t2
11t4
11t6
11t8
11u0
11u2
11u4
11u6
11u8
11v0
11v2
11v4
11v6
11v8
11w0
11w2
11w4
11w6
11w8
11x0
11x2
11x4
11x6
11x8
11y0
11y2
11y4
11y6
11y8
11z0
11z2
11z4
11z6
11z8
12a0
12a2
12a4
12a6
12a8
12b0
12b2
12b4
12b6
12b8
12c0
12c2
12c4
12c6
12c8
12d0
12d2
12d4
12d6
12d8
12e0
12e2
12e4
12e6
12e8
12f0
12f2
12f4
12f6
12f8
12g0
12g2
12g4
12g6
12g8
12h0
12h2
12h4
12h6
12h8
12i0
12i2
12i4
12i6
12i8
12j0
12j2
12j4
12j6
12j8
12k0
12k2
12k4
12k6
12k8
12l0
12l2
12l4
12l6
12l8
12m0
12m2
12m4
12m6
12m8
12n0
12n2
12n4
12n6
12n8
12o0
12o2
12o4
12o6
12o8
12p0
12p2
12p4
12p6
12p8
12q0
12q2
12q4
12q6
12q8
12r0
12r2
12r4
12r6
12r8
12s0
12s2
12s4
12s6
12s8
12t0
12t2
12t4
12t6
12t8
12u0
12u2
12u4
12u6
12u8
12v0
12v2
12v4
12v6
12v8
12w0
12w2
12w4
12w6
12w8
12x0
12x2
12x4
12x6
12x8
12y0
12y2
12y4
12y6
12y8
12z0
12z2
12z4
12z6
12z8
13a0
13a2
13a4
13a6
13a8
13b0
13b2
13b4
13b6
13b8
13c0
13c2
13c4
13c6
13c8
13d0
13d2
13d4
13d6
13d8
13e0
13e2
13e4
13e6
13e8
13f0
13f2
13f4
13f6
13f8
13g0
13g2
13g4
13g6
13g8
13h0
13h2
13h4
13h6
13h8
13i0
13i2
13i4
13i6
13i8
13j0
13j2
13j4
13j6
13j8
13k0
13k2
13k4
13k6
13k8
13l0
13l2
13l4
13l6
13l8
13m0
13m2
13m4
13m6
13m8
13n0
13n2
13n4
13n6
13n8
13o0
13o2
13o4
13o6
13o8
13p0
13p2
13p4
13p6
13p8
13q0
13q2
13q4
13q6
13q8
13r0
13r2
13r4
13r6
13r8
13s0
13s2
13s4
13s6
13s8
13t0
13t2
13t4
13t6
13t8
13u0
13u2
13u4
13u6
13u8
13v0
13v2
13v4
13v6
13v8
13w0
13w2
13w4
13w6
13w8
13x0
13x2
13x4
13x6
13x8
13y0
13y2
13y4
13y6
13y8
13z0
13z2
13z4
13z6
13z8
14a0
14a2
14a4
14a6
14a8
14b0
14b2
14b4
14b6
14b8
14c0
14c2
14c4
14c6
14c8
14d0
14d2
14d4
14d6
14d8
14e0
14e2
14e4
14e6
14e8
14f0
14f2
14f4
14f6
14f8
14g0
14g2
14g4
14g6
14g8
14h0
14h2
14h4
14h6
14h8
14i0
14i2
14i4
14i6
14i8
14j0
14j2
14j4
14j6
14j8
14k0
14k2
14k4
14k6
14k8
14l0
14l2
14l4
14l6
14l8
14m0
14m2
14m4
14m6
14m8
14n0
14n2
14n4
14n6
14n8
14o0
14o2
14o4
14o6
14o8
14p0
14p2
14p4
14p6
14p8
14q0
14q2
14q4
14q6
14q8
14r0
14r2
14r4
14r6
14r8
14s0
14s2
14s4
14s6
14s8
14t0
14t2
14t4
14t6
14t8
14u0
14u2
14u4
14u6
14u8
14v0
14v2
14v4
14v6
14v8
14w0
14w2
14w4
14w6
14w8
14x0
14x2
14x4
14x6
14x8
14y0
14y2
14y4
14y6
14y8
14z0
14z2
14z4
14z6
14z8
15a0
15a2
15a4
15a6
15a8
15b0
15b2
15b4
15b6
15b8
15c0
15c2
15c4
15c6
15c8
15d0
15d2
15d4
15d6
15d8
15e0
15e2
15e4
15e6
15e8
15f0
15f2
15f4
15f6
15f8
15g0
15g2
15g4
15g6
15g8
15h0
15h2
15h4
15h6
15h8
15i0
15i2
15i4
15i6
15i8
15j0
15j2
15j4
15j6
15j8
15k0
15k2
15k4
15k6
15k8
15l0
15l2
15l4
15l6
15l8
15m0
15m2
15m4
15m6
15m8
15n0
15n2
15n4
15n6
15n8
15o0
15o2
15o4
15o6
15o8
15p0
15p2
15p4
15p6
15p8
15q0
15q2
15q4
15q6
15q8
15r0
15r2
15r4
15r6
15r8
15s0
15s2
15s4
15s6
15s8
15t0
15t2
15t4
15t6
15t8
15u0
15u2
15u4
15u6
15u8
15v0
15v2
15v4
15v6
15v8
15w0
15w2
15w4
15w6
15w8
15x0
15x2
15x4
15x6
15x8
15y0
15y2
15y4
15y6
15y8
15z0
15z2
15z4
15z6
15z8
16a0
16a2
16a4
16a6
16a8
16b0
16b2
16b4
16b6
16b8
16c0
16c2
16c4
16c6
16c8
16d0
16d2
16d4
16d6
16d8
16e0
16e2
16e4
16e6
16e8
16f0
16f2
16f4
16f6
16f8
16g0
16g2
16g4
16g6
16g8
16h0
16h2
16h4
16h6
16h8
16i0
16i2
16i4
16i6
16i8
16j0
16j2
16j4
16j6
16j8
16k0
16k2
16k4
16k6
16k8
16l0
16l2
16l4
16l6
16l8
16m0
16m2
16m4
16m6
16m8
16n0
16n2
16n4
16n6
16n8
16o0
16o2
16o4
16o6
16o8
16p0
16p2
16p4
16p6
16p8
16q0
16q2
16q4
16q6
16q8
16r0
16r2
16r4
16r6
16r8
16s0
16s2
16s4
16s6
16s8
16t0
16t2
16t4
16t6
16t8
16u0
16u2
16u4
16u6
16u8
16v0
16v2
16v4
16v6
16v8
16w0
16w2
16w4
16w6
16w8
16x0
16x2
16x4
16x6
16x8
16y0
16y2
16y4
16y6
16y8
16z0
16z2
16z4
16z6
16z8
17a0
17a2
17a4
17a6
17a8
17b0
17b2
17b4
17b6
17b8
17c0
17c2
17c4
17c6
17c8
17d0
17d2
17d4
17d6
17d8
17e0
17e2
17e4
17e6
17e8
17f0
17f2
17f4
17f6
17f8
17g0
17g2
17g4
17g6
17g8
17h0
17h2
17h4
17h6
17h8
17i0
17i2
17i4
17i6
17i8
17j0
17j2
17j4
17j6
17j8
17k0
17k2
17k4
17k6
17k8
17l0
17l2
17l4
17l6
17l8
17m0
17m2
17m4
17m6
17m8
17n0
17n2
17n4
17n6
17n8
17o0
17o2
17o4
17o6
17o8
17p0
17p2
17p4
17p6
17p8
17q0
17q2
17q4
17q6
17q8
17r0
17r2
17r4
17r6
17r8
17s0
17s2
17s4
17s6
17s8
17t0
17t2
17t4
17t6
17t8
17u0
17u2
17u4
17u6
17u8
17v0
17v2
17v4
17v6
17v8
17w0
17w2
17w4
17w6
17w8
17x0
17x2
17x4
17x6
17x8
17y0
17y2
17y4
17y6
17y8
17z0
17z2
17z4
17z6
17z8
18a0
18a2
18a4
18a6
18a8
18b0
18b2
18b4
18b6
18b8
18c0
18c2
18c4
18c6
18c8
18d0
18d2
18d4
18d6
18d8
18e0
18e2
18e4
18e6
18e8
18f0
18f2
18f4
18f6
18f8
18g0
18g2
18g4
18g6
18g8
18h0
18h2
18h4
18h6
18h8
18i0
18i2
18i4
18i6
18i8
18j0
18j2
18j4
18j6
18j8
18k0
18k2
18k4
18k6
18k8
18l0
18l2
18l4
18l6
18l8
18m0
18m2
18m4
18m6
18m8
18n0
18n2
18n4
18n6
18n8
18o0
18o2
18o4
18o6
18o8
18p0
18p2
18p4
18p6
18p8
18q0
18q2
18q4
18q6
18q8
18r0
18r2
18r4
18r6
18r8
18s0
18s2
18s4
18s6
18s8
18t0
18t2
18t4
18t6
18t8
18u0
18u2
18u4
18u6
18u8
18v0
18v2
18v4
18v6
18v8
18w0
18w2
18w4
18w6
18w8
18x0
18x2
18x4
18x6
18x8
18y0
18y2
18y4
18y6
18y8
18z0
18z2
18z4
18z6
18z8
19a0
19a2
19a4
19a6
19a8
19b0
19b2
19b4
19b6
19b8
19c0
19c2
19c4
19c6
19c8
19d0
19d2
19d4
19d6
19d8
19e0
19e2
19e4
19e6
19e8
19f0
19f2
19f4
19f6
19f8
19g0
19g2
19g4
19g6
19g8
19h0
19h2
19h4
19h6
19h8
19i0
19i2
19i4
19i6
19i8
19j0
19j2
19j4
19j6
19j8
19k0
19k2
19k4
19k6
19k8
19l0
19l2
19l4
19l6
19l8
19m0
19m2
19m4
19m6
19m8
19n0
19n2
19n4
19n6
19n8
19o0
19o2
19o4
19o6
19o8
19p0
19p2
19p4
19p6
19p8
19q0
19q2
19q4
19q6
19q8
19r0
19r2
19r4
19r6
19r8
19s0
19s2
19s4
19s6
19s8
19t0
19t2
19t4
19t6
19t8
19u0
19u2
19u4
19u6
19u8
19v0
19v2
19v4
19v6
19v8
19w0
19w2
19w4
19w6
19w8
19x0
19x2
19x4
19x6
19x8
19y0
19y2
19y4
19y6
19y8
19z0
19z2
19z4
19z6
19z8
20a0
20a2
20a4
20a6
20a8
20b0
20b2
20b4
20b6
20b8
20c0
20c2
20c4
20c6
20c8
20d0
20d2
20d4
20d6
20d8
20e0
20e2
20e4
20e6
20e8
20f0
20f2
20f4
20f6
20f8
20g0
20g2
20g4
20g6
20g8
20h0
20h2
20h4
20h6
20h8
20i0
20i2
20i4
20i6
20i8
20j0
20j2
20j4
20j6
20j8
20k0
20k2
20k4
20k6
20k8
20l0
20l2
20l4
20l6
20l8
20m0
20m2
20m4
20m6
20m8
20n0
20n2
20n4
20n6
20n8
20o0
20o2
20o4
20o6
20o8
20p0
20p2
20p4
20p6
20p8
20q0
20q2
20q4
20q6
20q8
20r0
20r2
20r4
20r6
20r8
20s0
20s2
20s4
20s6
20s8
20t0
20t2
20t4
20t6
20t8
20u0
20u2
20u4
20u6
20u8
20v0
20v2
20v4
20v6
20v8
20w0
20w2
20w4
20w6
20w8
20x0
20x2
20x4
20x6
20x8
20y0
20y2
20y4
20y6
20y8
20z0
20z2
20z4
20z6
20z8
21a0
21a2
21a4
21a6
21a8
21b0
21b2
21b4
21b6
21b8
21c0
21c2
21c4
21c6
21c8
21d0
21d2
21d4
21d6
21d8
21e0
21e2
21e4
21e6
21e8
21f0
21f2
21f4
21f6
21f8
21g0
21g2
21g4
21g6
21g8
21h0
21h2
21h4
21h6
21h8
21i0
21i2
21i4
21i6
21i8
21j0
21j2
21j4
21j6
21j8
21k0
21k2
21k4
21k6
21k8
21l0
21l2
21l4
21l6
21l8
21m0
21m2
21m4
21m6
21m8
21n0
21n2
21n4
21n6
21n8
21o0
21o2
21o4
21o6
21o8
21p0
21p2
21p4
21p6
21p8
21q0
21q2
21q4
21q6
21q8
21r0
21r2
21r4
21r6
21r8
21s0
21s2
21s4
21s6
21s8
21t0
21t2
21t4
21t6
21t8
21u0
21u2
21u4
21u6
21u8
21v0
21v2
21v4
21v6
21v8
21w0
21w2
21w4
21w6
21w8
21x0
21x2
21x4
21x6
21x8
21y0
21y2
21y4
21y6
21y8
21z0
21z2
21z4
21z6
21z8
22a0
22a2
22a4
22a6
22a8
22b0
22b2
22b4
22b6
22b8
22c0
22c2
22c4
22c6
22c8
22d0
22d2
22d4
22d6
22d8
22e0
22e2
22e4
22e6
22e8
22f0
22f2
22f4
22f6
22f8
22g0
22g2
22g4
22g6
22g8
22h0
22h2
22h4
22h6
22h8
22i0
22i2
22i4
22i6
22i8
22j0
22j2
22j4
22j6
22j8
22k0
22k2
22k4
22k6
22k8
22l0
22l2
22l4
22l6
22l8
22m0
22m2
22m4
22m6
22m8
22n0
22n2
22n4
22n6
22n8
22o0
22o2
22o4
22o6
22o8
22p0
22p2
22p4
22p6
22p8
22q0
22q2
22q4
22q6
22q8
22r0
22r2
22r4
22r6
22r8
22s0
22s2
22s4
22s6
22s8
22t0
22t2
22t4
22t6
22t8
22u0
22u2
22u4
22u6
22u8
22v0
22v2
22v4
22v6
22v8
22w0
22w2
22w4
22w6
22w8
22x0
22x2
22x4
22x6
22x8
22y0
22y2
22y4
22y6
22y8
22z0
22z2
22z4
22z6
22z8
23a0
23a2
23a4
23a6
23a8
23b0
23b2
23b4
23b6
23b8
23c0
23c2
23c4
23c6
23c8
23d0
23d2
23d4
23d6
23d8
23e0
23e2
23e4
23e6
23e8
23f0
23f2
23f4
23f6
23f8
23g0
23g2
23g4
23g6
23g8
23h0
23h2
23h4
23h6
23h8
23i0
23i2
23i4
23i6
23i8
23j0
23j2
23j4
23j6
23j8
23k0
23k2
23k4
23k6
23k8
23l0
23l2
23l4
23l6
23l8
23m0
23m2
23m4
23m6
23m8
23n0
23n2
23n4
23n6
23n8
23o0
23o2
23o4
23o6
23o8
23p0
23p2
23p4
23p6
23p8
23q0
23q2
23q4
23q6
23q8
23r0
23r2
23r4
23r6
23r8
23s0
23s2
23s4
23s6
23s8
23t0
23t2
23t4
23t6
23t8
23u0
23u2
23u4
23u6
23u8
23v0
23v2
23v4
23v6
23v8
23w0
23w2
23w4
23w6
23w8
23x0
23x2
23x4
23x6
23x8
23y0
23y2
23y4
23y6
23y8
23z0
23z2
23z4
23z6
23z8
24a0
24a2
24a4
24a6
24a8
24b0
24b2
24b4
24b6
24b8
24c0
24c2
24c4
24c6
24c8
24d0
24d2
24d4
24d6
24d8
24e0
24e2
24e4
24e6
24e8
24f0
24f2
24f4
24f6
24f8
24g0
24g2
24g4
24g6
24g8
24h0
24h2
24h4
24h6
24h8
24i0
24i2
24i4
24i6
24i8
24j0
24j2
24j4
24j6
24j8
24k0
24k2
24k4
24k6
24k8
24l0
24l2
24l4
24l6
24l8
24m0
24m2
24m4
24m6
24m8
24n0
24n2
24n4
24n6
24n8
24o0
24o2
24o4
24o6
24o8
24p0
24p2
24p4
24p6
24p8
24q0
24q2
24q4
24q6
24q8
24r0
24r2
24r4
24r6
24r8
24s0
24s2
24s4
24s6
24s8
24t0
24t2
24t4
24t6
24t8
24u0
24u2
24u4
24u6
24u8
24v0
24v2
24v4
24v6
24v8
24w0
24w2
24w4
24w6
24w8
24x0
24x2
24x4
24x6
24x8
24y0
24y2
24y4
24y6
24y8
24z0
24z2
24z4
24z6
24z8
25a0
25a2
25a4
25a6
25a8
25b0
25b2
25b4
25b6
25b8
25c0
25c2
25c4
25c6
25c8
25d0
25d2
25d4
25d6
25d8
25e0
25e2
25e4
25e6
25e8
25f0
25f2
25f4
25f6
25f8
25g0
25g2
25g4
25g6
25g8
25h0
25h2
25h4
25h6
25h8
25i0
25i2
25i4
25i6
25i8
25j0
25j2
25j4
25j6
25j8
25k0
25k2
25k4
25k6
25k8
25l0
25l2
25l4
25l6
25l8
25m0
25m2
25m4
25m6
25m8
25n0
25n2
25n4
25n6
25n8
25o0
25o2
25o4
25o6
25o8
25p0
25p2
25p4
25p6
25p8
25q0
25q2
25q4
25q6
25q8
25r0
25r2
25r4
25r6
25r8
25s0
25s2
25s4
25s6
25s8
25t0
25t2
25t4
25t6
25t8
25u0
25u2
25u4
25u6
25u8
25v0
25v2
25v4
25v6
25v8
25w0
25w2
25w4
25w6
25w8
25x0
25x2
25x4
25x6
25x8
25y0
25y2
25y4
25y6
25y8
25z0
25z2
25z4
25z6
25z8
26a0
26a2
26a4
26a6
26a8
26b0
26b2
26b4
26b6
26b8
26c0
26c2
26c4
26c6
26c8
26d0
26d2
26d4
26d6
26d8
26e0
26e2
26e4
26e6
26e8
26f0
26f2
26f4
26f6
26f8
26g0
26g2
26g4
26g6
26g8
26h0
26h2
26h4
26h6
26h8
26i0
26i2
26i4
26i6
26i8
26j0
26j2
26j4
26j6
26j8
26k0
26k2
26k4
26k6
26k8
26l0
26l2
26l4
26l6
26l8
26m0
26m2
26m4
26m6
26m8
26n0
26n2
26n4
26n6
26n8
26o0
26o2
26o4
26o6
26o8
26p0
26p2
26p4
26p6
26p8
26q0
26q2
26q4
26q6
26q8
26r0
26r2
26r4
26r6
26r8
26s0
26s2
26s4
26s6
26s8
26t0
26t2
26t4
26t6
26t8
26u0
26u2
26u4
26u6
26u8
26v0
26v2
26v4
26v6
26v8
26w0
26w2
26w4
26w6
26w8
26x0
26x2
26x4
26x6
26x8
26y0
26y2
26y4
26y6
26y8
26z0
26z2
26z4
26z6
26z8
27a0
27a2
27a4
27a6
27a8
27b0
27b2
27b4
27b6
27b8
27c0
27c2
27c4
27c6
27c8
27d0
27d2
27d4
27d6
27d8
27e0
27e2
27e4
27e6
27e8
27f0
27f2
27f4
27f6
27f8
27g0
27g2
27g4
27g6
27g8
27h0
27h2
27h4
27h6
27h8
27i0
27i2
27i4
27i6
27i8
27j0
27j2
27j4
27j6
27j8
27k0
27k2
27k4
27k6
27k8
27l0
27l2
27l4
27l6
27l8
27m0
27m2
27m4
27m6
27m8
27n0
27n2
27n4
27n6
27n8
27o0
27o2
27o4
27o6
27o8
27p0
27p2
27p4
27p6
27p8
27q0
27q2
27q4
27q6
27q8
27r0
27r2
27r4
27r6
27r8
27s0
27s2
27s4
27s6
27s8
27t0
27t2
27t4
27t6
27t8
27u0
27u2
27u4
27u6
27u8
27v0
27v2
27v4
27v6
27v8
27w0
27w2
27w4
27w6
27w8
27x0
27x2
27x4
27x6
27x8
27y0
27y2
27y4
27y6
27y8
27z0
27z2
27z4
27z6
27z8
28a0
28a2
28a4
28a6
28a8
28b0
28b2
28b4
28b6
28b8
28c0
28c2
28c4
28c6
28c8
28d0
28d2
28d4
28d6
28d8
28e0
28e2
28e4
28e6
28e8
28f0
28f2
28f4
28f6
28f8
28g0
28g2
28g4
28g6
28g8
28h0
28h2
28h4
28h6
28h8
28i0
28i2
28i4
28i6
28i8
28j0
28j2
28j4
28j6
28j8
28k0
28k2
28k4
28k6
28k8
28l0
28l2
28l4
28l6
28l8
28m0
28m2
28m4
28m6
28m8
28n0
28n2
28n4
28n6
28n8
28o0
28o2
28o4
28o6
28o8
28p0
28p2
28p4
28p6
28p8
28q0
28q2
28q4
28q6
28q8
28r0
28r2
28r4
28r6
28r8
28s0
28s2
28s4
28s6
28s8
28t0
28t2
28t4
28t6
28t8
28u0
28u2
28u4
28u6
28u8
28v0
28v2
28v4
28v6
28v8
28w0
28w2
28w4
28w6
28w8
28x0
28x2
28x4
28x6
28x8
28y0
28y2
28y4
28y6
28y8
28z0
28z2
28z4
28z6
28z8
29a0
29a2
29a4
29a6
29a8
29b0
29b2
29b4
29b6
29b8
29c0
29c2
29c4
29c6
29c8
29d0
29d2
29d4
29d6
29d8
29e0
29e2
29e4
29e6
29e8
29f0
29f2
29f4
29f6
29f8
29g0
29g2
29g4
29g6
29g8
29h0
29h2
29h4
29h6
29h8
29i0
29i2
29i4
29i6
29i8
29j0
29j2
29j4
29j6
29j8
29k0
29k2
29k4
29k6
29k8
29l0
29l2
29l4
29l6
29l8
29m0
29m2
29m4
29m6
29m8
29n0
29n2
29n4
29n6
29n8
29o0
29o2
29o4
29o6
29o8
29p0
29p2
29p4
29p6
29p8
29q0
29q2
29q4
29q6
29q8
29r0
29r2
29r4
29r6
29r8
29s0
29s2
29s4
29s6
29s8
29t0
29t2
29t4
29t6
29t8
29u0
29u2
29u4
29u6
29u8
29v0
29v2
29v4
29v6
29v8
29w0
29w2
29w4
29w6
29w8
29x0
29x2
29x4
29x6
29x8
29y0
29y2
29y4
29y6
29y8
29z0
29z2
29z4
29z6
29z8
30a0
30a2
30a4
30a6
30a8
30b0
30b2
30b4
30b6
30b8
30c0
30c2
30c4
30c6
30c8
30d0
30d2
30d4
30d6
30d8
30e0
30e2
30e4
30e6
30e8
30f0
30f2
30f4
30f6
30f8
30g0
30g2
30g4
30g6
30g8
30h0
30h2
30h4
30h6
30h8
30i0
30i2
30i4
30i6
30i8
30j0
30j2
30j4
30j6
30j8
30k0
30k2
30k4
30k6
30k8
30l0
30l2
30l4
30l6
30l8
30m0
30m2
30m4
30m6
30m8
30n0
30n2
30n4
30n6
30n8
30o0
30o2
30o4
30o6
30o8
30p0
30p2
30p4
30p6
30p8
30q0
30q2
30q4
30q6
30q8
30r0
30r2
30r4
30r6
30r8
30s0
30s2
30s4
30s6
30s8
30t0
30t2
30t4
30t6
30t8
30u0
30u2
30u4
30u6
30u8
30v0
30v2
30v4
30v6
30v8
30w0
30w2
30w4
30w6
30w8
30x0
30x2
30x4
30x6
30x8
30y0
30y2
30y4
30y6
30y8
30z0
30z2
30z4
30z6
30z8
31a0
31a2
31a4
31a6
31a8
31b0
31b2
31b4
31b6
31b8
31c0
31c2
31c4
31c6
31c8
31d0
31d2
31d4
31d6
31d8
31e0
31e2
31e4
31e6
31e8
31f0
31f2
31f4
31f6
31f8
31g0
31g2
31g4
31g6
31g8
31h0
31h2
31h4
31h6
31h8
31i0
31i2
31i4
31i6
31i8
31j0
31j2
31j4
31j6
31j8
31k0
31k2
31k4
31k6
31k8
31l0
31l2
31l4
31l6
31l8
31m0
31m2
31m4
31m6
31m8
31n0
31n2
31n4
31n6
31n8
31o0
31o2
31o4
31o6
31o8
31p0
31p2
31p4
31p6
31p8
31q0
31q2
31q4
31q6
31q8
31r0
31r2
31r4
31r6
31r8
31s0
31s2
31s4
31s6
31s8
31t0
31t2
31t4
31t6
31t8
31u0
31u2
31u4
31u6
31u8
31v0
31v2
31v4
31v6
31v8
31w0
31w2
31w4
31w6
31w8
31x0
31x2
31x4
31x6
31x8
31y0
31y2
31y4
31y6
31y8
31z0
31z2
31z4
31z6
31z8
32a0
32a2
32a4
32a6
32a8
32b0
32b2
32b4
32b6
32b8
32c0
32c2
32c4
32c6
32c8
32d0
32d2
32d4
32d6
32d8
32e0
32e2
32e4
32e6
32e8
32f0
32f2
32f4
32f6
32f8
32g0
32g2
32g4
32g6
32g8
32h0
32h2
32h4
32h6
32h8
32i0
32i2
32i4
32i6
32i8
32j0
32j2
32j4
32j6
32j8
32k0
32k2
32k4
32k6
32k8
32l0
32l2
32l4
32l6
32l8
32m0
32m2
32m4
32m6
32m8
32n0
32n2
32n 205
205
205
205
205
205
205
205
205
205
205
205
205
205
205
205
205
205
205
205
205

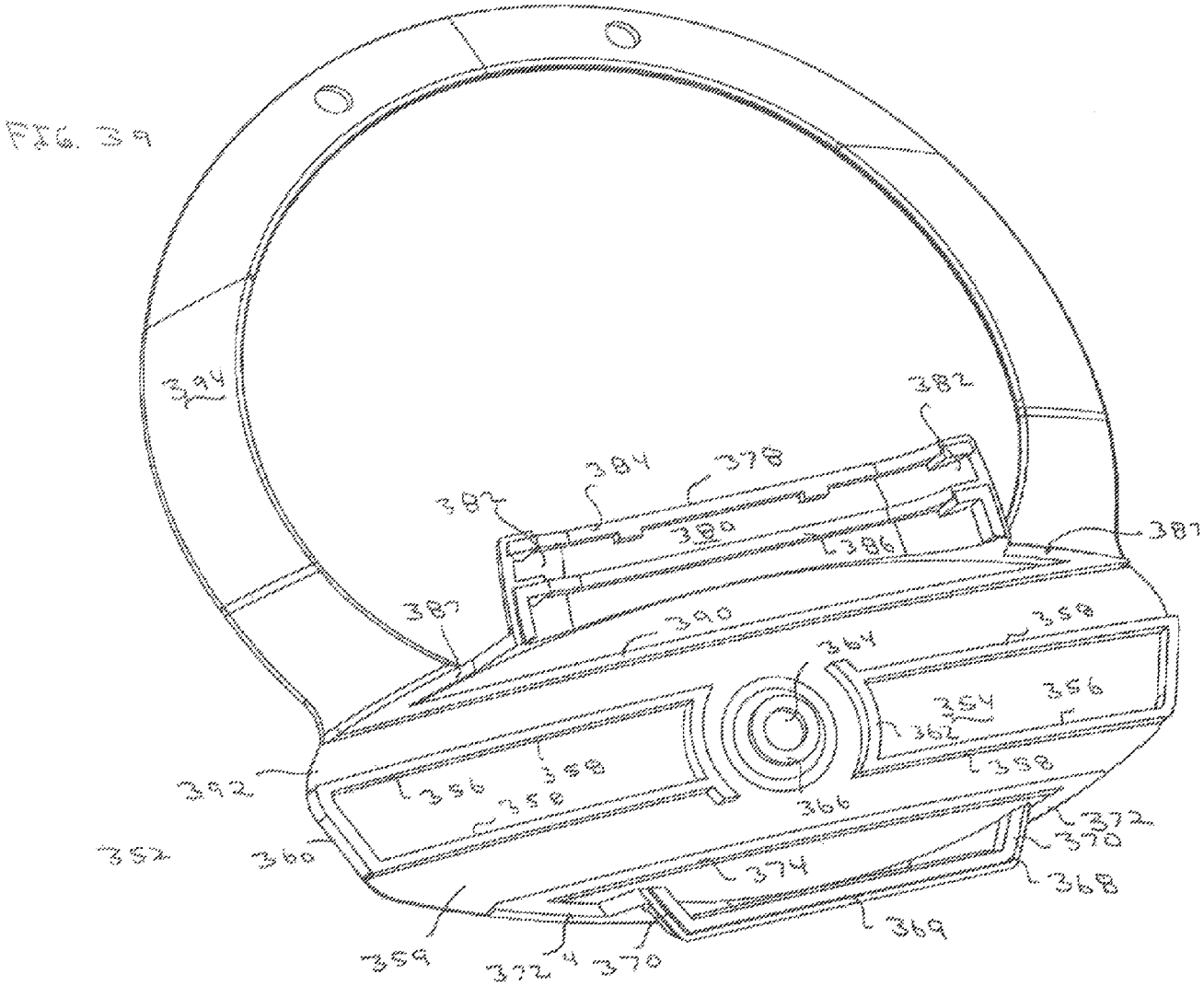

306
308
310
304
302
305
307
309
308

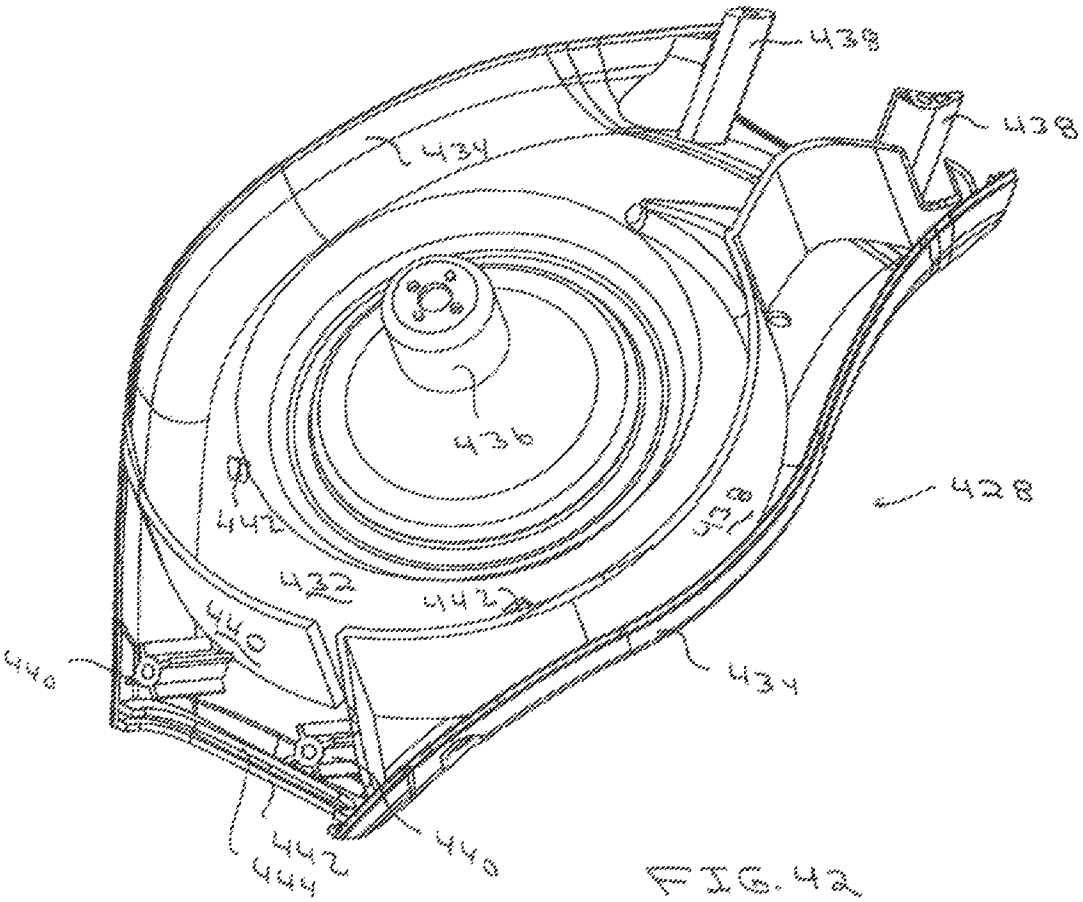
348
348
348

805
805
805
805
805
805
805
805

MEDICAL/SURGICAL PERSONAL PROTECTION SYSTEM INCLUDING A HELMET AND A HOOD, THE HELMET HAVING CHIN BAR-MOUNTED CONTROLS

RELATIONSHIP TO EARLIER FILED APPLICATIONS

This application is a divisional of U.S. patent application Ser. No. 13/616,010 filed 14 Sep. 2012 now U.S. Pat. No. 8,819,869. U.S. patent application Ser. No. 13/616,010 is a divisional of U.S. patent application Ser. No. 12/813,084 filed 10 Jun. 2010, now U.S. Pat. No. 8,282,234. U.S. patent application Ser. No. 12/813,084 is a divisional of U.S. patent application Ser. No. 11/485,783, filed 13 Jul. 2006, now U.S. Pat. No. 7,735,156. U.S. patent application Ser. No. 11/485,783 claims priority under 35 U.S.C. Sec. 119 from U.S. Patent Application No. 60/699,166 filed 14 Jul. 2005. The contents of the priority applications are hereby incorporated by reference.

FIELD OF THE INVENTION

The present invention generally relates to personal protection systems for use in medical environments, such as surgical environments, to protect both patients from contamination during surgical procedures, and to protect medical professionals from exposure to airborne contaminants and bodily fluids. More particularly, the system of this invention offers illumination, communication and reduces the physical strain imposed on the wearer.

BACKGROUND OF THE INVENTION

Personal protection systems are used in surgical procedures to provide a sterile barrier between the surgical personnel and the patient. One such system is disclosed in U.S. Pat. No. 5,054,480, the contents of which are incorporated herein by reference discloses that basic structure of such a system. Specifically, the traditional system includes a helmet that supports a toga or a hood. This assemblage is worn by medical/surgical personnel that want to establish the sterile barrier. The toga or the hood includes a transparent face shield. The helmet includes a ventilation unit that includes a fan. The ventilation unit draws air through the toga/hood so the air is circulated around the wearer. This reduces both the amount of heat that is trapped within the toga/hood and the $CO_2$ that builds up in this space. It is further known to mount a light to the helmet. The light, which is directed through face shield illuminates the surgical site.

Conventional personal protection systems do a reasonable job of providing a sterile barrier between the surgical personnel and the surrounding environment. However, there are some limitations associated with their use. The toga/hood that covers the wearer blocks sound waves. This means an individual wearing the system may have to speak loudly, even shout, to be heard. This is especially the case when the hooded individual is trying to communicate with another individual similarly attired.

Furthermore, while it is known to provide light with the helmet, it has proven difficult to provide a workable light. This is because in one proposed system, it is proposed that the actual light be emitted by a source at a static console. The light is supplied to the helmet for emission therefrom through a fiber optic cable. Thus with this system, the wearer is essentially tethered to the light source. This both limits the mobility of the individual and requires other operating room personnel to navigate around the tether. Alternatively, the light source could be mounted in the helmet. Such light sources generate heat. This heat can cause the temperature beneath the toga/hood to rise to an uncomfortable level.

Moreover, the helmet and the equipment it supports, places a load on the head of the wearer. Over time this load can impose an appreciable strain on the muscles and skeletal structure.

SUMMARY OF THE INVENTION

This invention relates to a new and useful personal protection system such as the type of system used to provide a sterile boundary around medical/surgical personnel.

The system of this invention includes a ventilation unit for supplying ventilation air underneath the toga/hood of wearer. There is a light unit. The light unit has a light source positioned in line with the air discharged from the ventilation unit. This arrangement minimizes the build up of heat around the light unit.

The system of this invention also includes an in-helmet mounted RF communications system.

The system of this invention also has a head unit that substitutes for a conventional helmet. The head unit includes a head band and a ventilation unit that is suspended above the head band. The ventilation unit is adjustably positioned relative to the head band. This allows the ventilation unit to be positioned relative to the head of the wearer so it is located where it will impose only a minimal strain on the wearer.

BRIEF DESCRIPTION OF THE DRAWINGS

Other advantages of the present invention will be readily appreciated as the same becomes better understood by reference to the following detailed description when considered in connection with the accompanying drawings wherein:

FIG. 29 is a perspective view of an alternative head unit of the personal protection system of this invention;

FIG. 31 is a side view of the head unit;

FIG. 32 is rear view of the head unit;

FIG. 33 is a rear perspective view of the head unit;

FIG. 35 is a perspective view of the face frame;

FIG. 40 is a perspective view of the knob integral with the rear nozzle assembly;

FIG. 42 is a view of the inside of the lower shell of the ventilation unit;

FIG. 43 is a perspective view of the upper shell of the ventilation unit;

FIG. 44 is a perspective view of the ventilation unit fan;

FIG. 46 is a perspective view of the ventilation unit motor cover;

FIG. 49 is a perspective view illustrating how the light is adjustably mounted to the head unit;

DETAILED DESCRIPTION OF THE INVENTION

I. Overview

Referring to the Figures, wherein like numerals indicate like or corresponding parts throughout the several views, a personal protection system is generally shown at 10.

Figure 1:
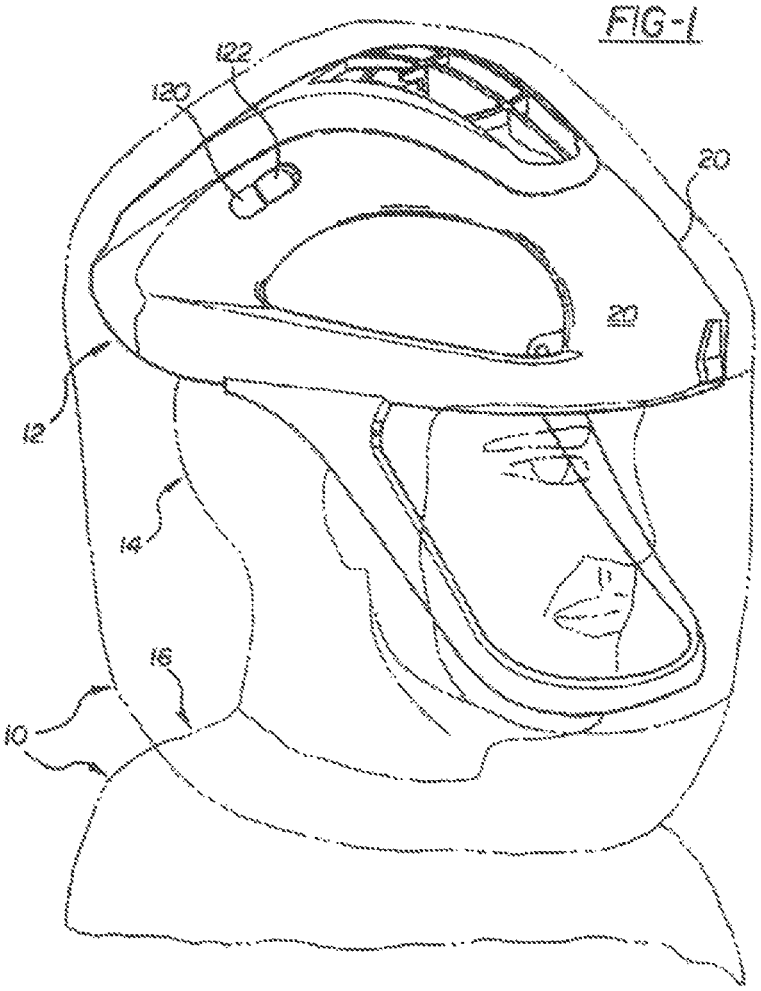
FIG. 1 is a perspective view of a helmet type personal protection system of this invention fitted over the head of a user.

The personal protection system 10 is adapted from the personal protection system 10 disclosed in U.S. Pat. No. 6,481,019 to Diaz et al. and U.S. Provisional Patent Application No. 60/664,900, both of which are hereby incorporated by reference. The personal protection system 10 of the present invention is implemented as a helmet assembly 12 mountable to the head 14 of a user, as shown in FIG. 1.

The personal protection system 10 filters air between the head 14 and body 16 of a user, e.g., a medical professional, and an environment external to the user. The helmet assembly 12 distributes air about the head 14 of the user as will be described below. More specifically, the helmet assembly 12 distributes air toward both a front of the head 14, i.e., a face of the user, and a back of the head 14, i.e., a neck of the user.

Figure 2:
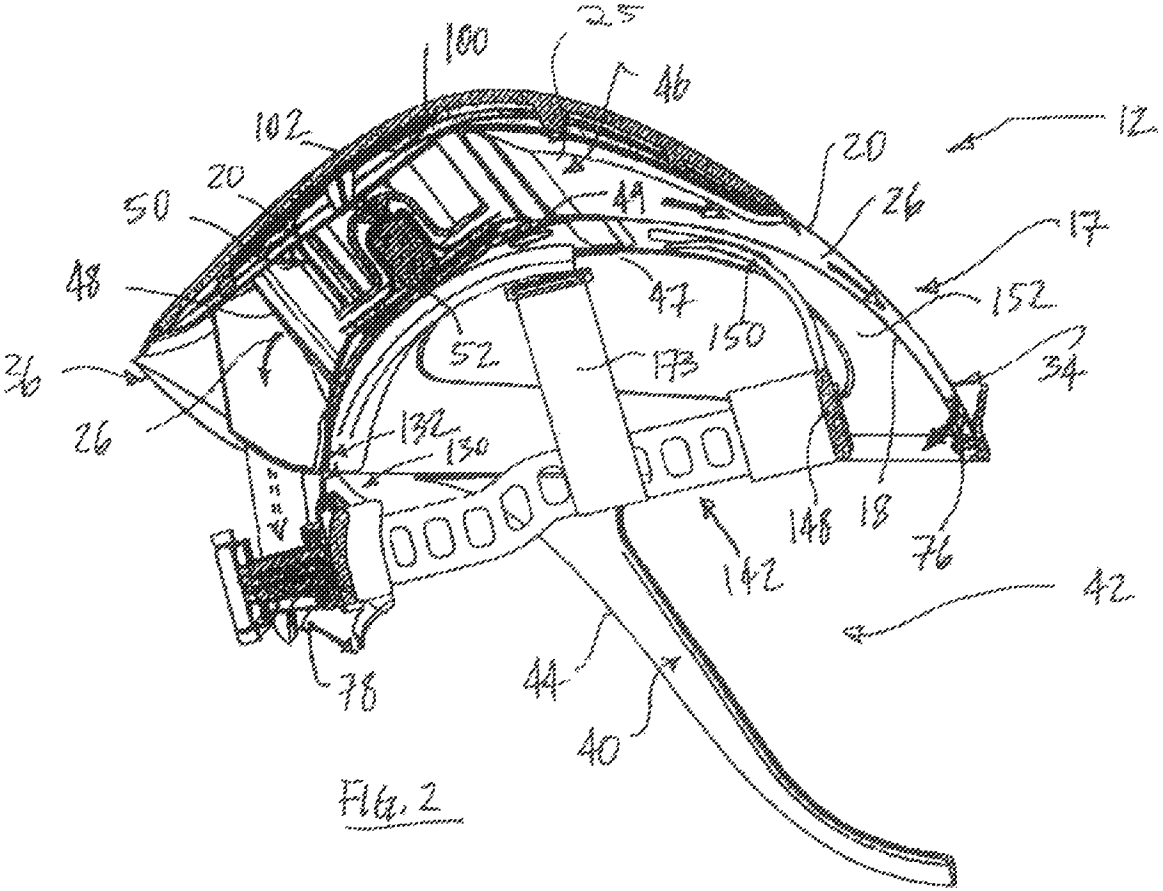
FIG. 2 is a cross-sectional view of the helmet assembly.

Referring to FIG. 2, the helmet assembly 12 includes a shell 17 having an inner shell portion 18 facing the user and an outer shell portion 20 facing away from the user. The outer shell portion 20 is spaced apart from the inner shell portion 18 to define at least one air flow channel 26 between the inner and outer shell portions 18, 20. It is to be understood that the present invention may include more than one discrete air flow channel 26. The illustrated embodiment includes a single unitary air flow channel 26 and the present invention will be described below in terms of this air flow channel 26. The shell 17 is preferably formed of acrylonitrile butadiene styrene (ABS), but may be formed, in alternative plastics.

The helmet assembly 12 also includes a facial section 40 extending from the shell 17 to define a facial opening 42. The facial section 40 of the helmet assembly 12 is a chin bar 44. The chin bar 44 is flexible and is formed of plastic such as polypropylene. The flexibility of the chin bar 44 protects the wearer's face and absorbs impact when the user contacts an external object with the helmet assembly 12. The chin bar 44 also holds the hood 92 (FIG. 1) away from the face of the wearer

II. Helmet

Figure 3:
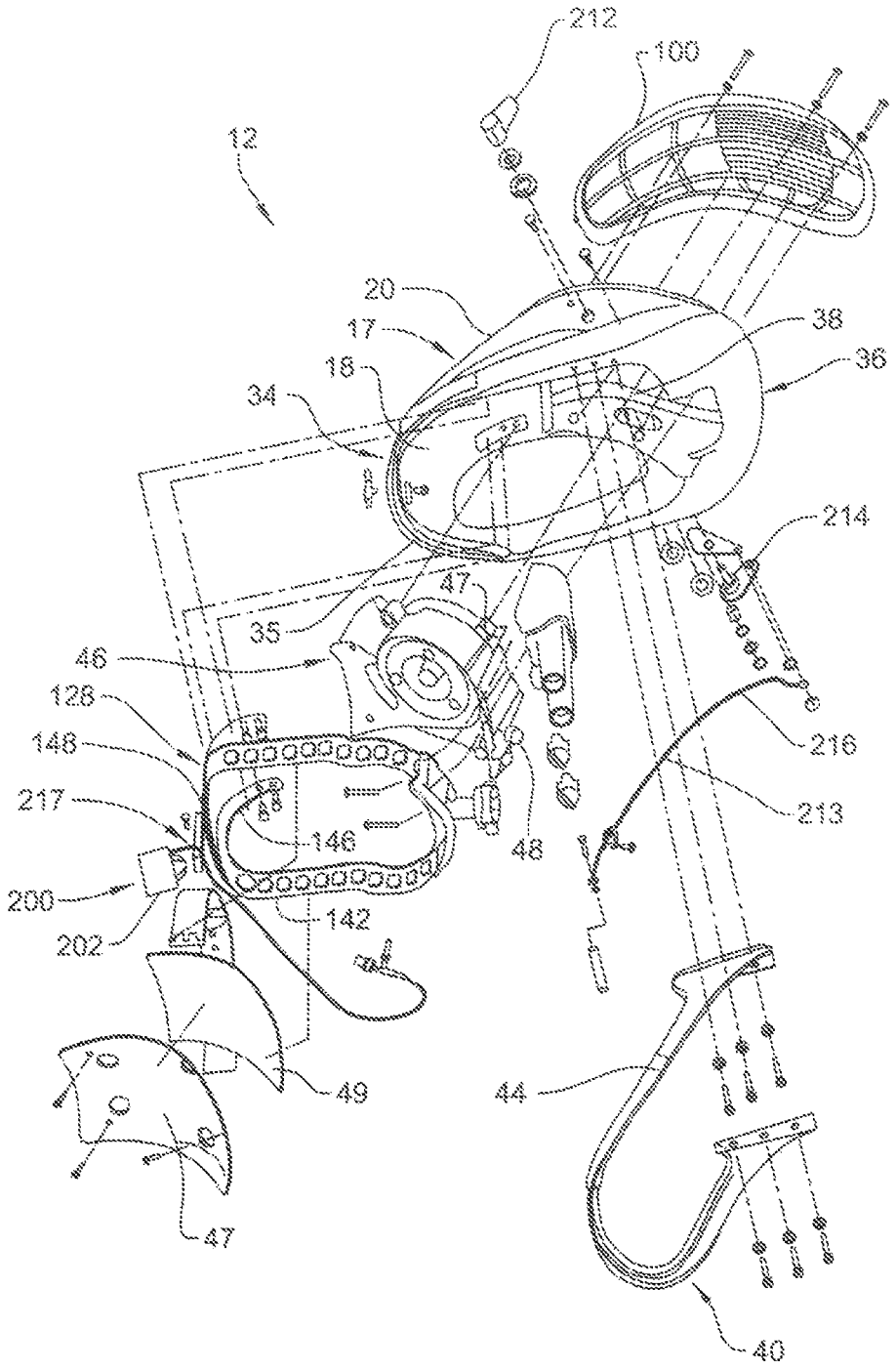
FIG. 3 is an exploded perspective view of the helmet assembly.

Referring to FIGS. 2-3, the helmet assembly 12 includes a fan module 46 mounted in a cavity 38 in the shell 17 Fan module 46 includes a fan 50 and a motor 52 mounted to a scroll housing 48. Fasteners M that extend through the shell 17 into threaded bores in the housing 48 to hold the module 46 in cavity 38 (housing bores not shown). A cover plate 47 is fixed to the shell 17 below cavity 38 to cover the fan module 46. A cushion 49 is disposed between the cover plate 47 and a base of the fan module 46. The cushion 49 absorbs the sound emitted by the fan motor 52. This reduces the amount of noise emitted by the system 10 of this invention. The scroll housing 48 may be formed of glass-filled polypropylene to reduce vibrations.

The helmet assembly 12 further includes an intake grid 100 mounted to the outer shell portion 20. The intake grid 100 includes a top surface spaced from the outer shell portion 20 of the helmet assembly 12. The intake grid 100 is contoured to the outer shell portion 20 between the front and rear of the shell 17. Air is drawn into the scroll housing 48 through the intake grid 100 by the fan 50.

Also shown in FIG. 3 are various fasteners and washers, not identified, that secure the components forming helmet assembly 12 together.

In operation, the motor 52 rotates the fan 50 to draw air into the air inlet 64 of the scroll housing 48 through the intake grid 100. The air is discharged through two spaced openings in the scroll housing 48. A first opening 51 seen in FIG. 3A, is in the front of the scroll housing 48. The air discharged from opening 51 flows directly into the opening 25 into air flow channel 26. From channel 26, the air is discharged from an outlet opening 35 between the inner and outer shell portions 18 and 20, respectively, in the front of the shell 17

Figure 3B:
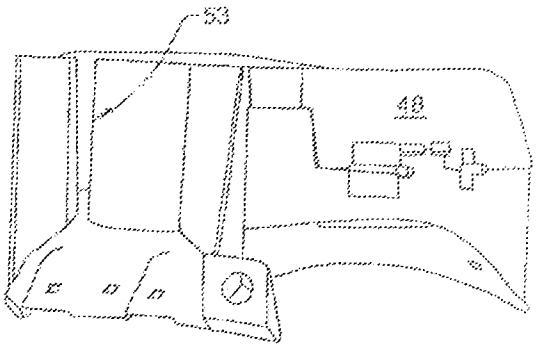
FIG. 3B is a plan view of the rear of the scroll housing.
Figure 3A:
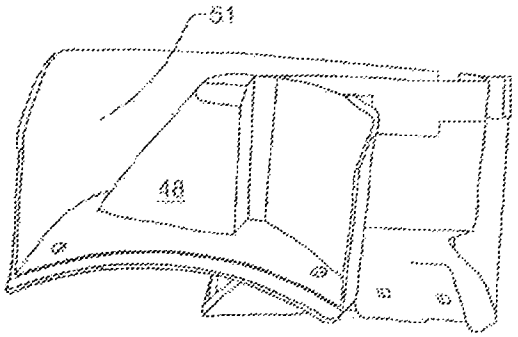
FIG. 3A is a plan view of the front of the scroll housing.
Figure 4:
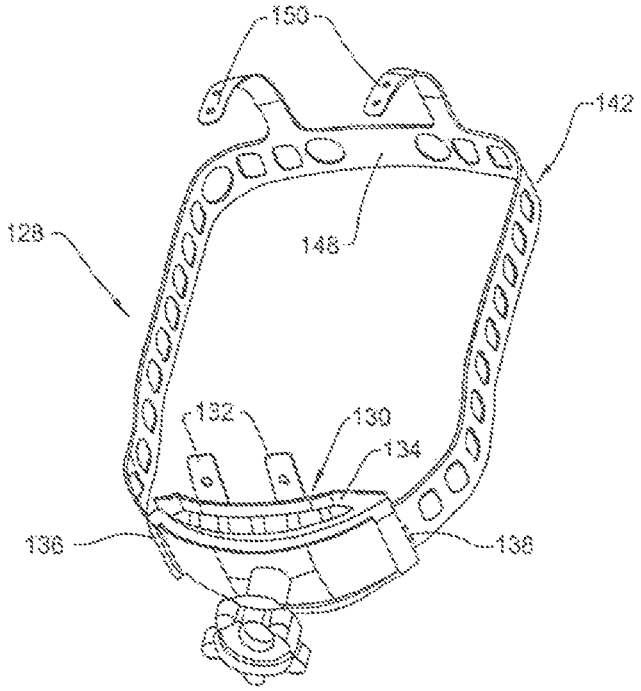
FIG. 4 is a perspective view of the head band.

The second opening, opening 53, is located in the rear of the scroll housing 48, best seen in FIG. 3B. The air discharged from opening 53 flows into a manifold mounted to the rear of the scroll housing 48. From the manifold, the air is discharged from two downwardly directed nozzles. The manifold and nozzles are formed as a single unit, S in FIG. 3. When the system 10 is worn, the nozzle discharge ports are positioned adjacent the back of the neck of the wearer.

The air flow channel 26 defined between the inner and outer shell portions 18, 20 terminates at the front section 34 with the front air exits. More specifically, the inner and outer shell portions 18, 20 converge toward the front section 34 to define the front air exits. The front air exits may have an air deflector defined between the outer shell portion 20 and the inner shell portion 18 wherein the outer shell portion 20 angles toward the inner shell portion 18 at the front air exits for proper deflection of air toward the front of the head 14 of the user. Such an air deflector is best shown in U.S. Pat. No. 6,481,019 et al., which, again, is hereby incorporated by reference. Air flow channel 26 diverges upon approaching the front air exits. The convergence and divergence of the air flow channel 26 maintains a balanced flow of air about the user's head 14. Ultimately, this also has the effect of minimizing or even completely eliminating noise within the helmet assembly 12 due to the air flow.

Referring to FIGS. 2, 3, 4 and 8, an adjustable head band 128 assists in minimizing the strain on the head 14 and the neck of the user. Strain and torque on the head 14 and neck of the user is minimized by maintaining the weight of the fan 50 and motor 52 over the neck of the user even upon adjustment of the helmet assembly 12 to fit various sized heads 14. The head band 128 includes a rear support 130 that rigidly extends from the shell 17. It is understood that the rear support 130 can be a separate part that is connected to the helmet assembly 12 or can be an integral part of the helmet assembly 12. The rear support 130 includes first and second rigid connectors 132 that connect the rear support 130 to the rear section 36. In the preferred embodiment, the rear support 130 is connected to and extends from the rear section 36 of the inner shell portion 18 and will be described below in terms of the inner shell portion 18. However, it is to be understood that the rear support 130 can connect to and extend from any portion of the shell 17.

An adjustment segment 134 having a first side 136 and a second side 138 is also part of head band 128. Although not required, the rear support 130 preferably includes the adjustment segment 134. In the preferred embodiment, the adjustment segment 134 is integral to, or the same part as, the rear support 130. In alternative embodiments, the adjustment segment 134 is a discrete component that is simply mounted to the rear support 130. In either situation, the adjustment segment 134 defines apertures 140 for receiving a first end 144 and a second end 146 of a strap 142 flexibly connected to and extending from the front section 34 of the inner shell portion 18. The first end 144 is disposed within the first side 136 of the adjustment segment 134, and the second end 146 is disposed within the second side 138 of the adjustment segment 134. Preferably, the first end 144 is movably disposed within the first side 136 of the adjustment segment 134, and preferably the second end 146 is movably disposed within the second side 138 of the adjustment segment 134. However, as will be understood from the explanation below, the first end 144 may be movably disposed within the first side 136 of the adjustment segment 134 and the second end 146 may be fixedly disposed within the second side 138 of the adjustment segment 134. Alternatively, the first end 144 may be fixedly disposed within the first side 136 of the adjustment segment 134 and the second end 146 may be movably disposed within the second side 138 of the adjustment segment 134.

The strap 142 further includes a frontal portion 148 disposed between its first and second ends 144, 146 and opposite the adjustment segment 134 of the rear support 130. At least one support arm 150 flexibly extends from the frontal portion 148 of the strap 142 to flexibly connect the strap 142 to the front section 34 of the inner shell portion 18. These support arms 150 act as hinges for the head 14 support assembly. Preferably, there are two support arms 150 that extend from the frontal portion 148 of the strap 142. In such a case, the two supports arms are connected to the front section 34 of the inner shell portion 18 and to the frontal portion 148 of the strap 142 equidistant from one another. A gap 152 exists between the frontal portion 148 of the strap 142 and the front section 34 of the inner shell portion 18.

III. Toga and Hood

Figure 5:
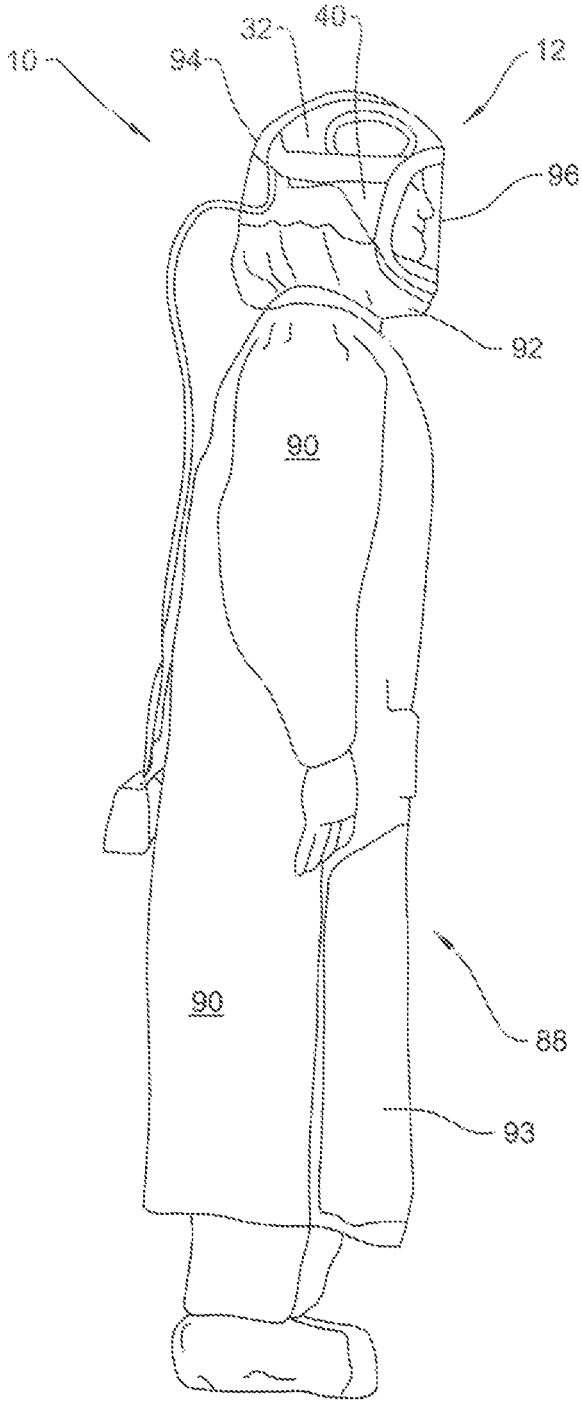
FIG. 5 is a side view of the helmet assembly with a toga and hood with face shield.
Figure 6:
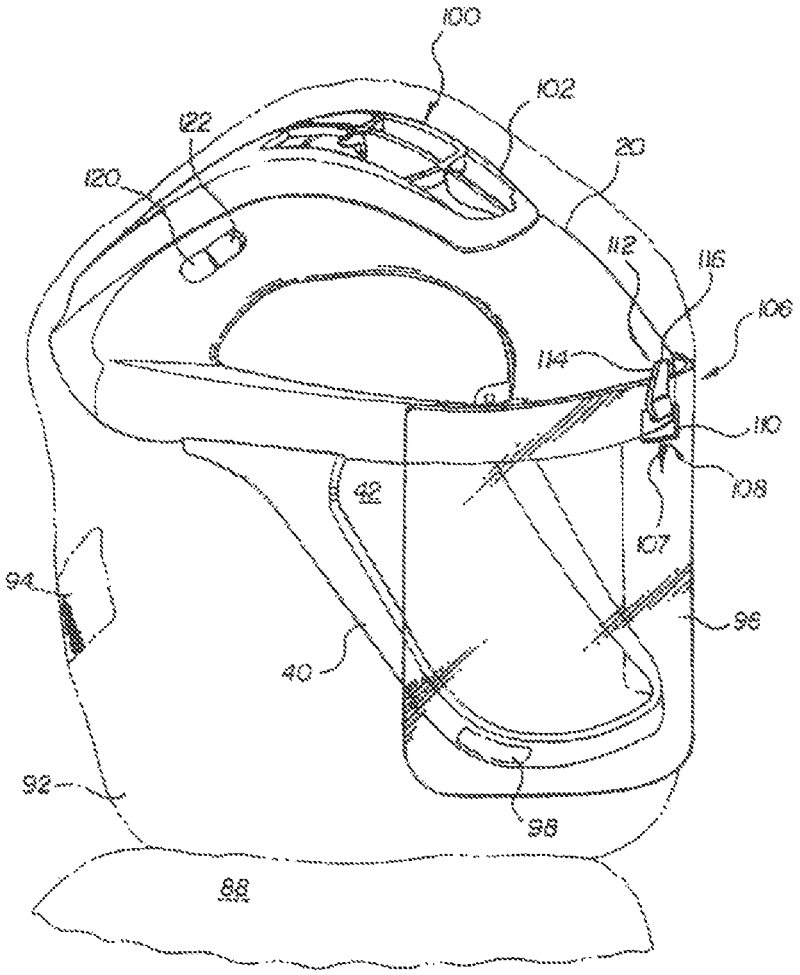
FIG. 6 is a perspective view of the helmet assembly illustrating a positioning and supporting system including a mounting clip supporting the face shield via an aperture in the face shield.
Figure 7:
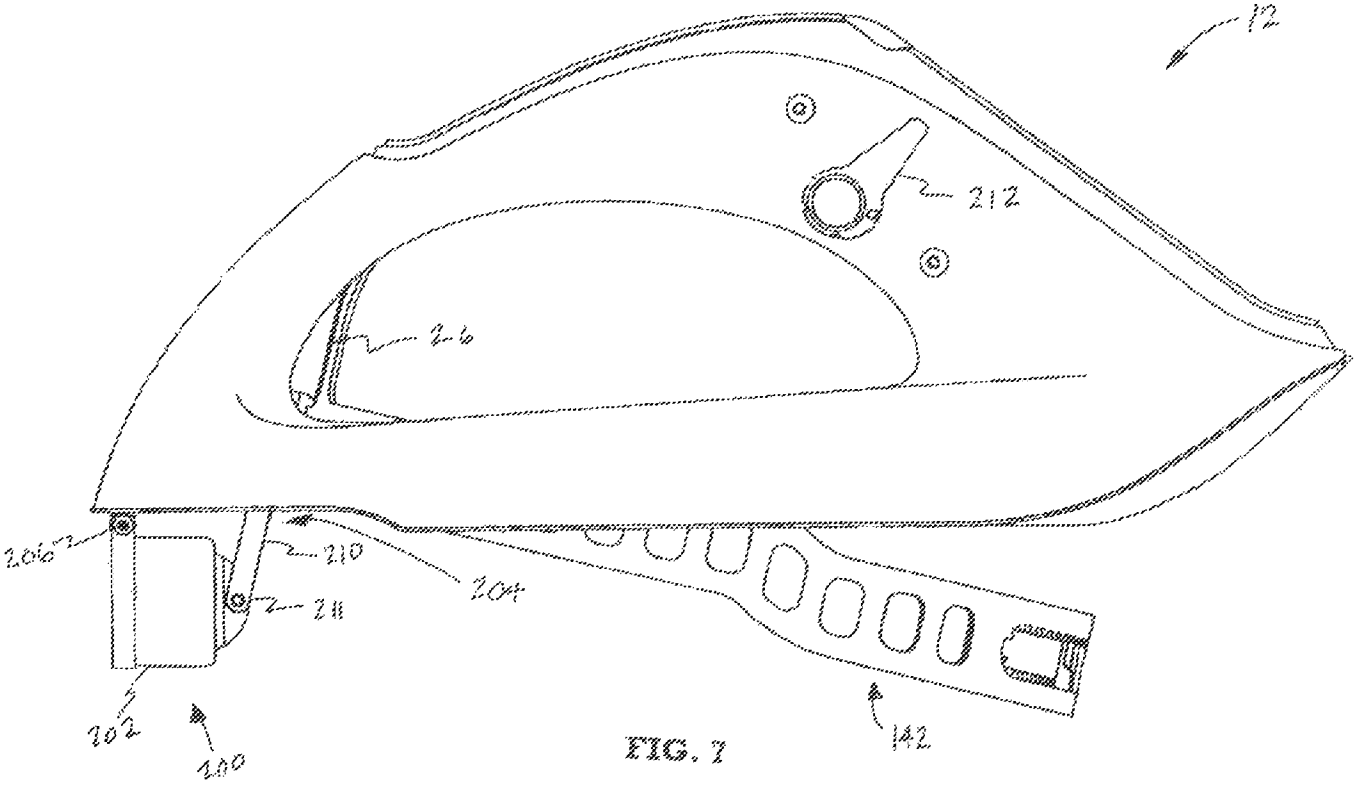
FIG. 7 is a side view of the helmet assembly implementing a light assembly.
Figure 8:
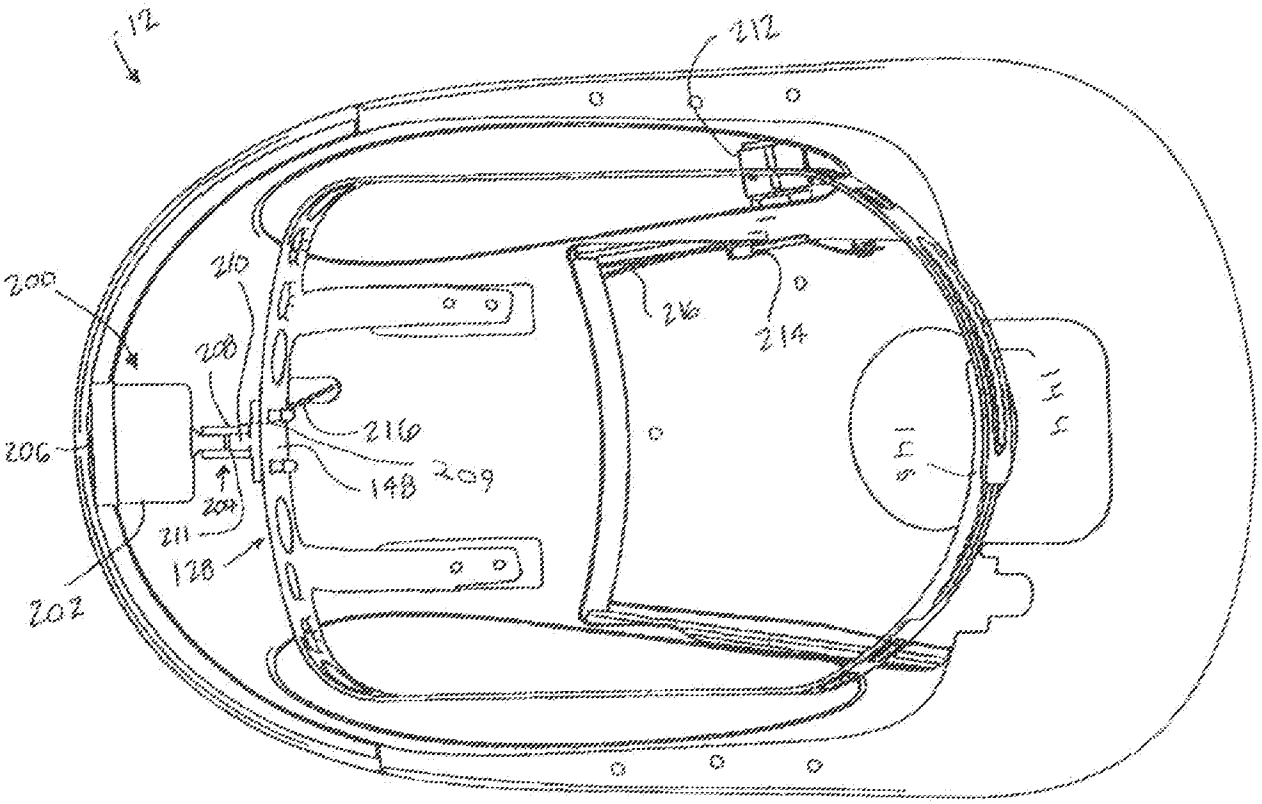
FIG. 8 is a bottom view of the helmet assembly implementing the light assembly.

Referring to FIG. 5, the personal protection system 10 includes a toga 88 having a body portion 90 for covering substantially all of the body 16. Toga 88 includes a hood 92 for covering the head and helmet assembly 12. The body portion 90 can extend downward to cover any portion of the body 16 of the user. For instance, the body portion 90 can extend downward to the waist of the user, or to the ankles of the user. The hood 92 includes a filter element 94 to filter air between the user and the external environment. The facial section 40 of the helmet assembly 12, introduced above, also operates to maintain the hood 92 away from the head 14 of the user. The intake grid 100 spaces the filter medium 94 out away from the outer shell portion 20 and the fan 50.

As is known in the art, a hood unit may be offered as a covering separate from the complete toga. This type of hood unit is used when there is only a need to provide a barrier around the head of the wearer.

A transparent face shield 96 permits the user to view through the hood 92. The face shield 96 may include anti-reflective and/or anti-refractive coatings to enhance vision through the face shield 96. As shown in FIG. 5, the face shield 96 is mounted to the hood 92 such that the face shield 96 covers the facial section 40 and the facial opening 42 of the helmet assembly 12 once the user dresses into the personal protection system 10. The face shield 96 is sewn into the hood 92. The facial opening 42 of the helmet assembly 12 receives the face shield 96. In this version of the invention, facial section 40 of the helmet assembly 12 includes a hook-and-loop fastener 98 to further facilitate attachment of the face shield 96 to the facial section 40 for covering the facial opening 42.

IV. Light Assembly and Fan Assembly

As shown in FIG. 3 and FIGS. 7-19, the personal protection system 10 includes a light assembly 200. The light assembly 200 is disposed within the hood 92 behind the face shield 96 to emit a beam of light that projects outside of the hood 92. Since the light assembly is disposed within the hood 92, there is no need to meticulously clean the light assembly to keep it to the sterile conditions of a surgical room. Light assembly 200 includes a light generating unit, light source 201, disposed adjacent to a lens (not shown).

The light source is preferably one or more light-emitting diodes (LEDs). The LED emits white light. In one version of the invention, light is emitted at a color temperature of 5500° K. Light in this spectrum is equivalent to daylight and provides true tissue color rendition. A light housing 202 supports and surrounds the LEDs and the lens. One suitable light assembly 200 is the PeriLux LED, manufactured by PeriOptix, Inc. of Mission Viejo, Calif. The light source may alternatively be an incandescent light bulb or other suitable sources as are well known in the art. One possible alternative is the use of a light source mounted somewhere on the user and fiber-optic cables to carry the light to the light housing.

The lens is circular in shape. In some versions of the invention, the longitudinal position of the lens relative to the light source 201 is selectively set. This allows the user to selectively focus/diffuse the beam of light emitted from the light assembly 200. Many lens displacement assemblies include a rotating collar. Rotating the collar in a first direction cause movement of the lens to focus light is concentrated in a small area. Rotation of the collar in the opposite direction results in movement of the lens so that the emitted light is diffused about a large area. This rotation of the collar may be done manually or with a focusing servo motor. Control of the electric servo motor is explained in greater detail below.

Light assembly 200 includes a light angle adjustment mechanism 204. Mechanism 204 allows the user to change the direction of the beam of light so it can be directed to a specific location. Specifically, the light housing 202 is pivotally mounted to two parallel legs 210 (one shown in FIG. 7). Legs 210 are integrally formed with and extend downwardly from a rigid block 209. Block 209 is attached to the front outer surface of the strap 142. A pin 211 that extends through the ends of the legs 210 pivotally holds the light housing 202 to the legs.

A semi-rigid cable 216 regulates the pivotal movement of the light housing 202. The cable 216 is contained in a sheath (not identified). A cable clamp AW and rivet P cooperate to hold the forward end of the sheath to the exposed face of the inner shell portion 18. The rear end of the sheath, with the cable 216 contained therein, extends through an opening in the shell 17 into the void space between the inner and outer shell portions 18 and 20, respectively. A ring clamp AZ is disposed over the front of the housing, immediately proximal to the front face. The opposed ends of the ring clamp (one shown as element 206 in FIG. 8) extend upwardly towards shell 17. An elongated screw 217 (FIG. 3) extends between ring clamp ends 206 to compression secure the ring clamp AZ to the light housing 202. The front end of the cable 216 is wrapped around the exposed section of screw BA between the ring clamp end sections 206.

Figure 9:
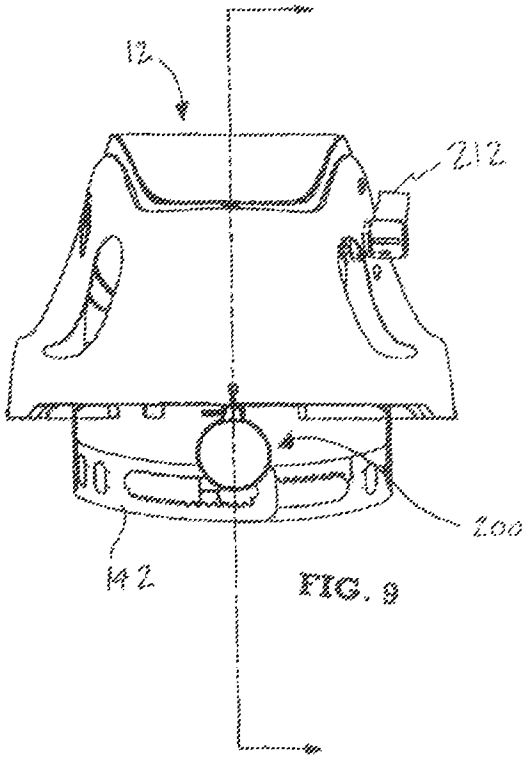
FIG. 9 is a back view of the helmet assembly implementing the light assembly.
Figure 10:
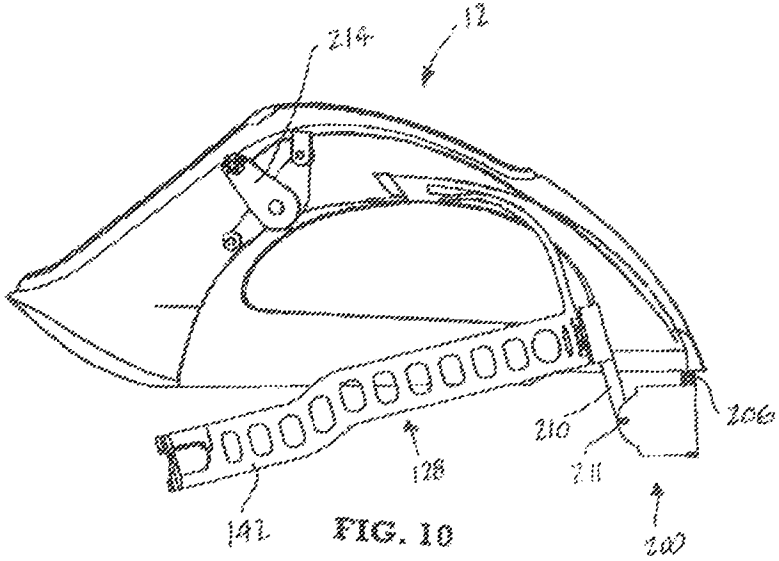
FIG. 10 is a cross-sectional view of the helmet assembly along the line 10-10 shown in FIG. 9.
Figure 12:
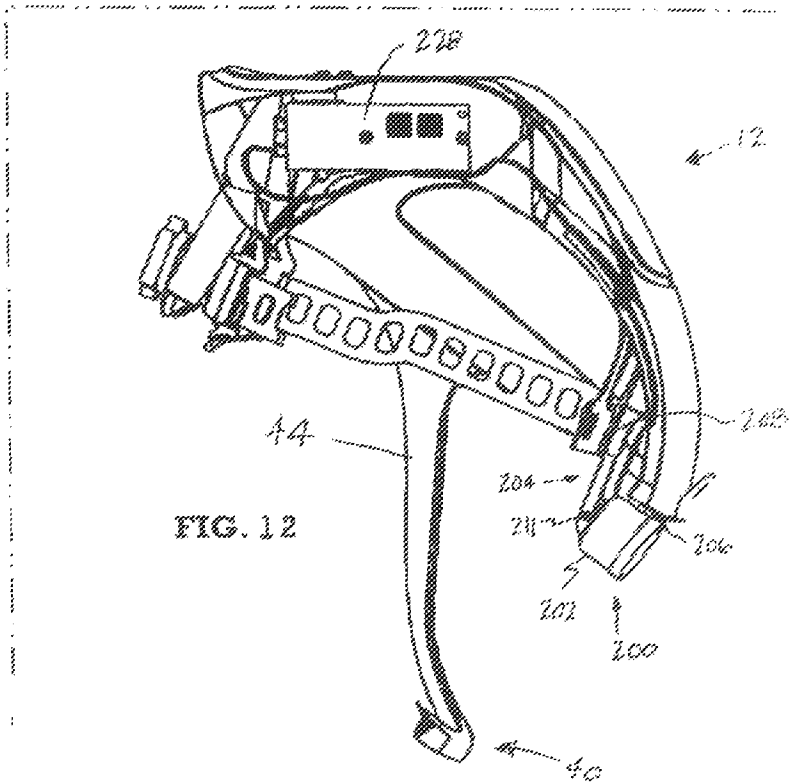
FIG. 12 is a cross-sectional side view of the helmet assembly showing a printed circuit board disposed within the helmet assembly.
Figure 11:
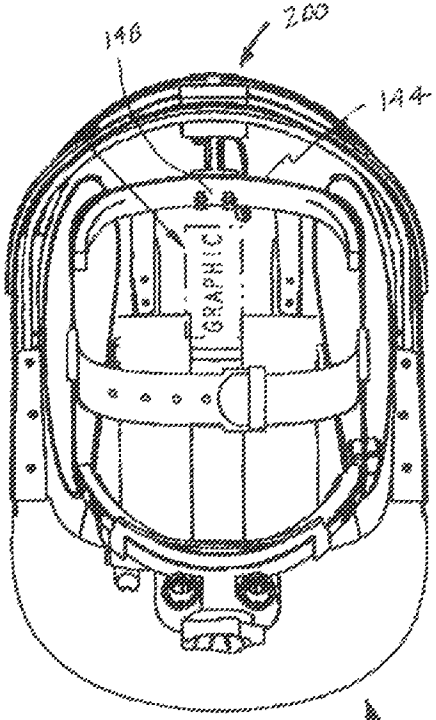
FIG. 11 is a bottom view of the helmet assembly implementing the light assembly.
Figure 14:
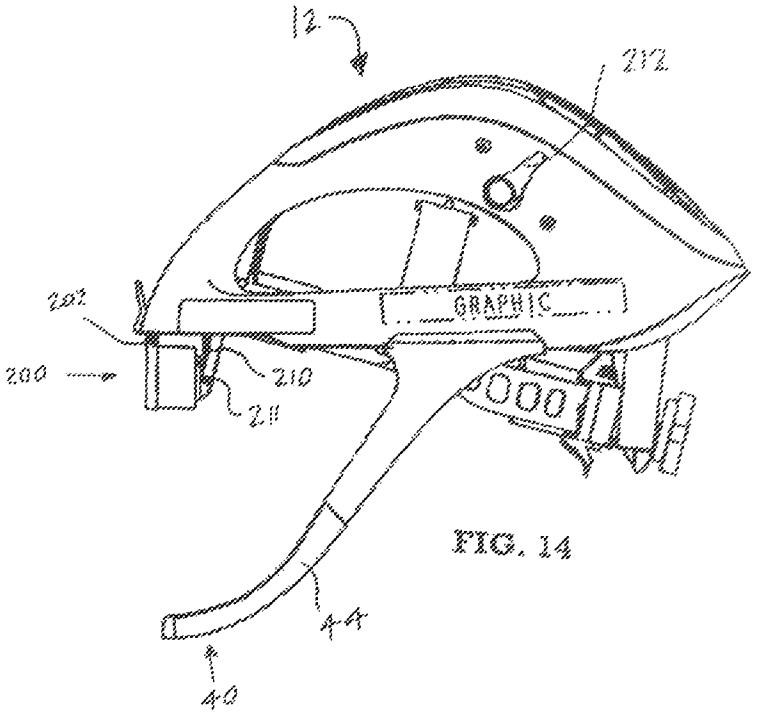
FIG. 14 is a side view of the helmet assembly showing a handle for adjusting the angle of the light assembly.
Figure 13:
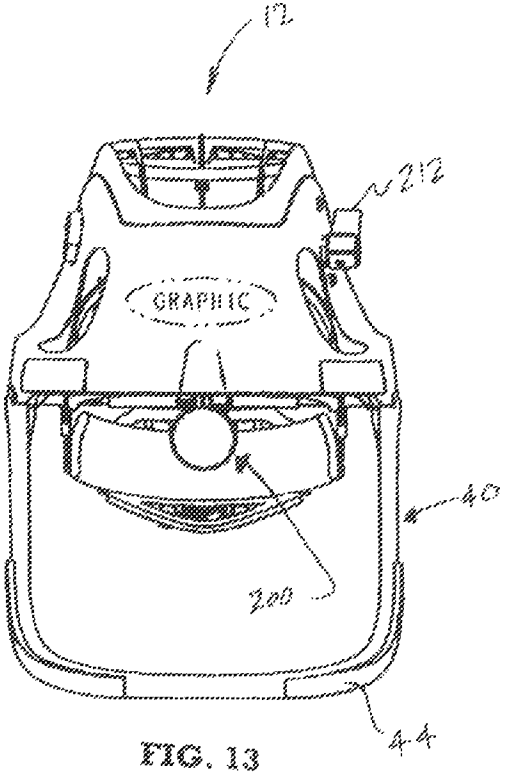
FIG. 13 is a front view of the helmet assembly.
Figure 15:
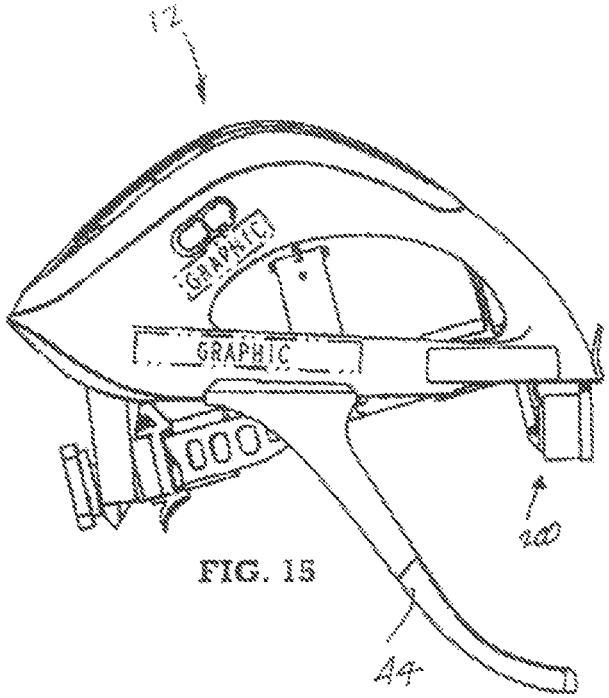
FIG. 15 is a side view of the helmet assembly.
Figure 16:
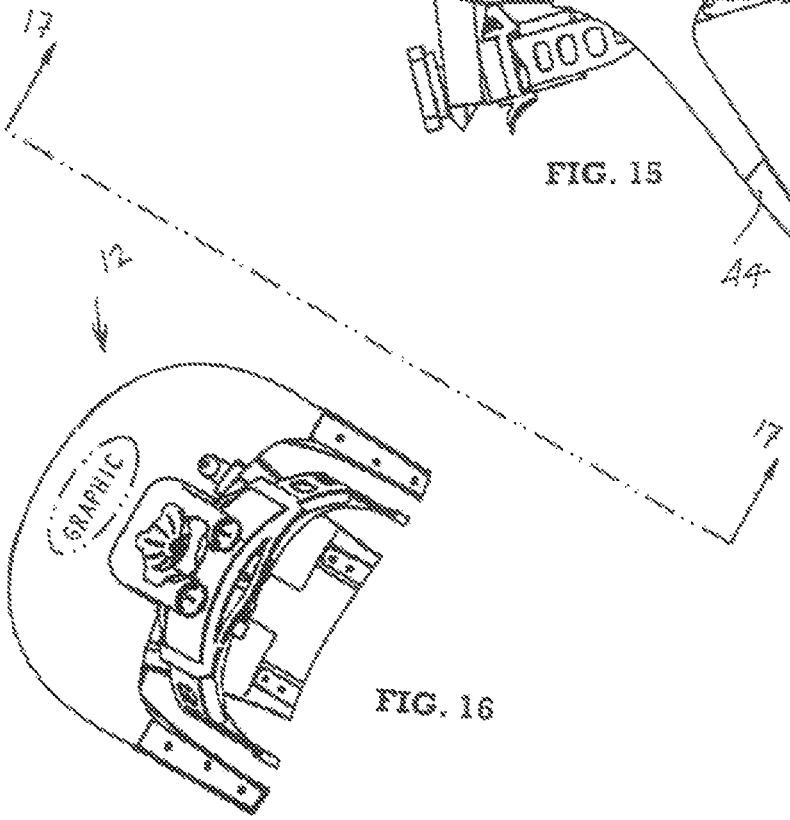
FIG. 16 is a perspective back view of the helmet assembly along the line 16-16 shown in FIG. 15.
Figure 17:
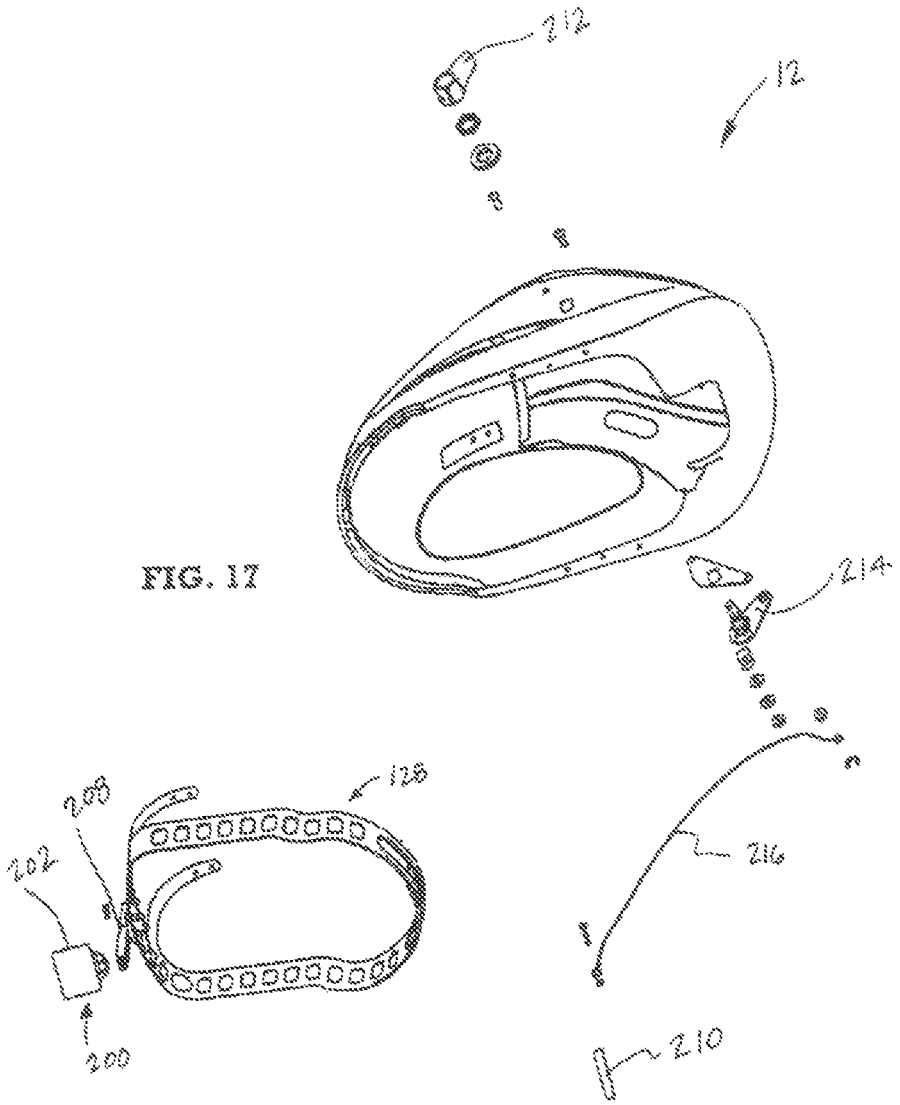
FIG. 17 is a partial exploded view of the helmet assembly showing the components of an light adjustment mechanism for adjusting the angle of the light assembly.
Figures 18, 19:
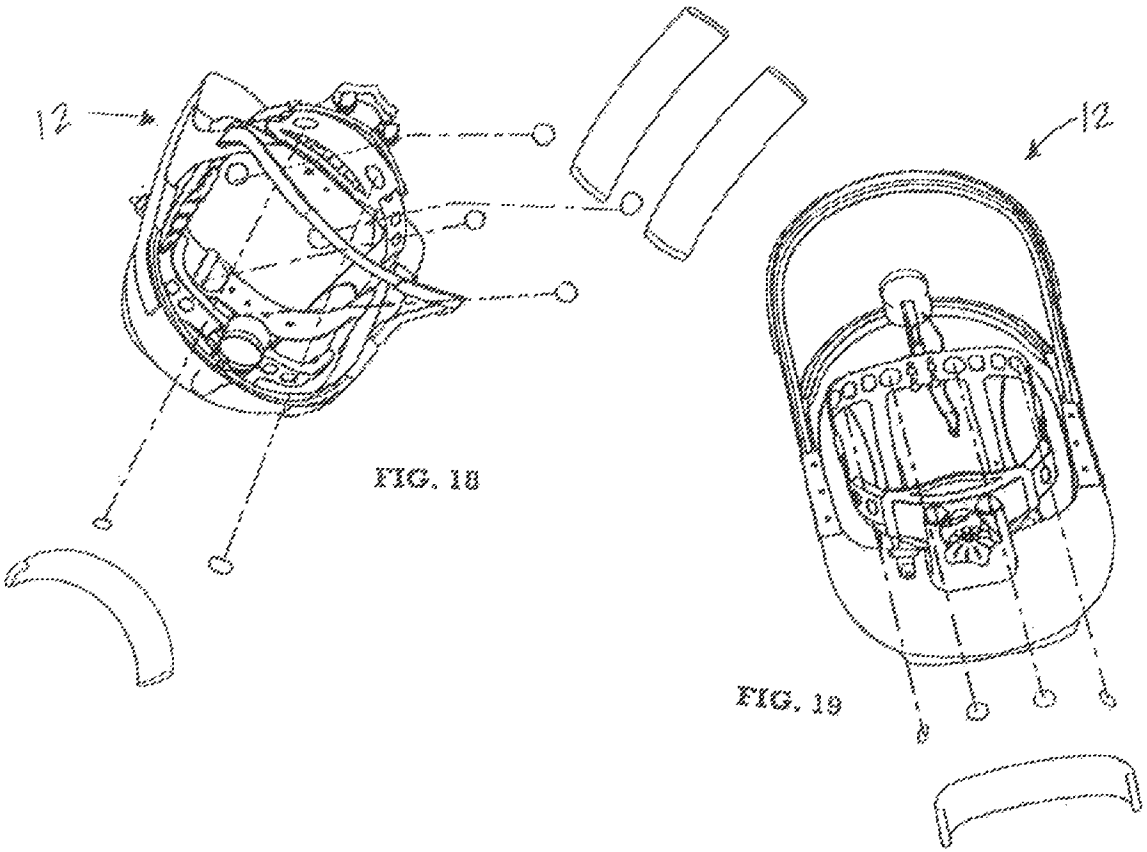
FIG. 18 is a perspective view of the helmet assembly.
FIG. 19 is a bottom view of the helmet assembly.

As seen in FIG. 10, a lever arm 214 disposed inside shell 17, selectively extends and retracts the cable 216. Lever arm 214 is connected by a pin (not identified) to an adjustment knob 212 located outside of the shell 17 (FIG. 9). The pin extends through the shell outer portion. The proximal end, the rear end of the cable 216 is attached to the end of the lever arm 214 distal from the pin. The rotation of the knob and lever arm sub-assembly thus results in the extension/retraction of the cable. The cable movement, in turn pivots the light housing 202 around the axis defined by pin 211.

The light housing 202 and, more particularly, the light source 201, are positioned directly under the front air outlet opening 35. By positioning as such, the air discharged from opening 35 blows the warm air surrounding the light assembly 200 away from the light assembly. This reduces the build up of heated air adjacent the light assembly. Instead, the heated air is exhausted out of the hood 92. The removal of this heated air lessens the extent to which the heat generated by the light assembly excessively warms the wearer of the personal protection system 10.

Still another feature of this construction of the invention is that it minimizes the extent to which the temperature of the light assembly 200 itself rises due to the heat emitted by source 201. By maintaining the light source 201 at a relatively low temperature, the source itself is able to function as a relatively efficient light emitter. (The light-emitting efficiency of LED type light source drops with an increase in the temperature of the LED.)

Figure 20:
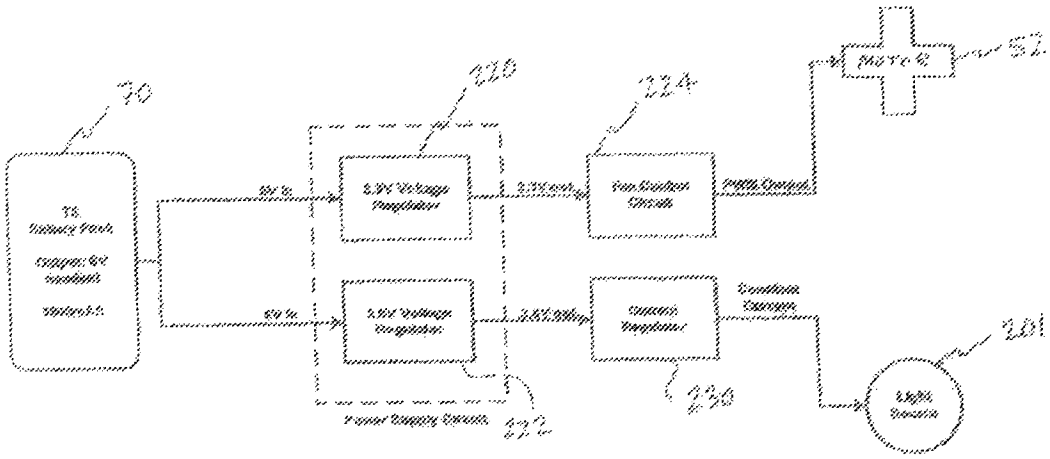
FIG. 20 is an electrical block diagram illustrating the flow of electricity from a power supply to a motor and a light source.

Referring now to FIG. 20, the control circuit for motor 52 and light source 201 are shown in block form. Power supply 70 energizes both the motor and the light source. In alternative versions of the invention, power supply 70 may be divided into a pair of power supplies, with each power supply individually powering the motor 52 or the light assembly 200.

Power supply 70 is preferably at least one cell (i.e., battery). The at least one cell may be rechargeable. However, non-rechargeable (i.e., disposable) cells may also be used. In one version of the invention, power supply 70 provides a 6 VDC power signal. However, other voltages may alternatively be implemented.

The first power supply 70 is preferably mounted to the body 16 of the user as shown in FIG. 5. By mounting the first power supply 70 outside of the toga 88, it can be easily replaced (i.e., switched out) during a medical/surgical procedure. In some versions of the invention, power supply 70 is located where it is accessible through the toga. Alternatively, the first power supply 70 may be disposed within, i.e., integrated into, the helmet assembly 12.

Referring again to FIG. 21, the personal protection system 10 further includes a fan control circuit 224 for regulating the actuation of the fan motor 52. A voltage regulator 220 applies a constant voltage signal to control circuit 224 for energizing the control circuit. Voltage regulator 220 regulates the 6 VDC electric current received from the power supply. In one version of the invention, voltage regulator 220 provides a 3.3 VDC electric current which energizes the fan control circuit 224.

Figure 21:
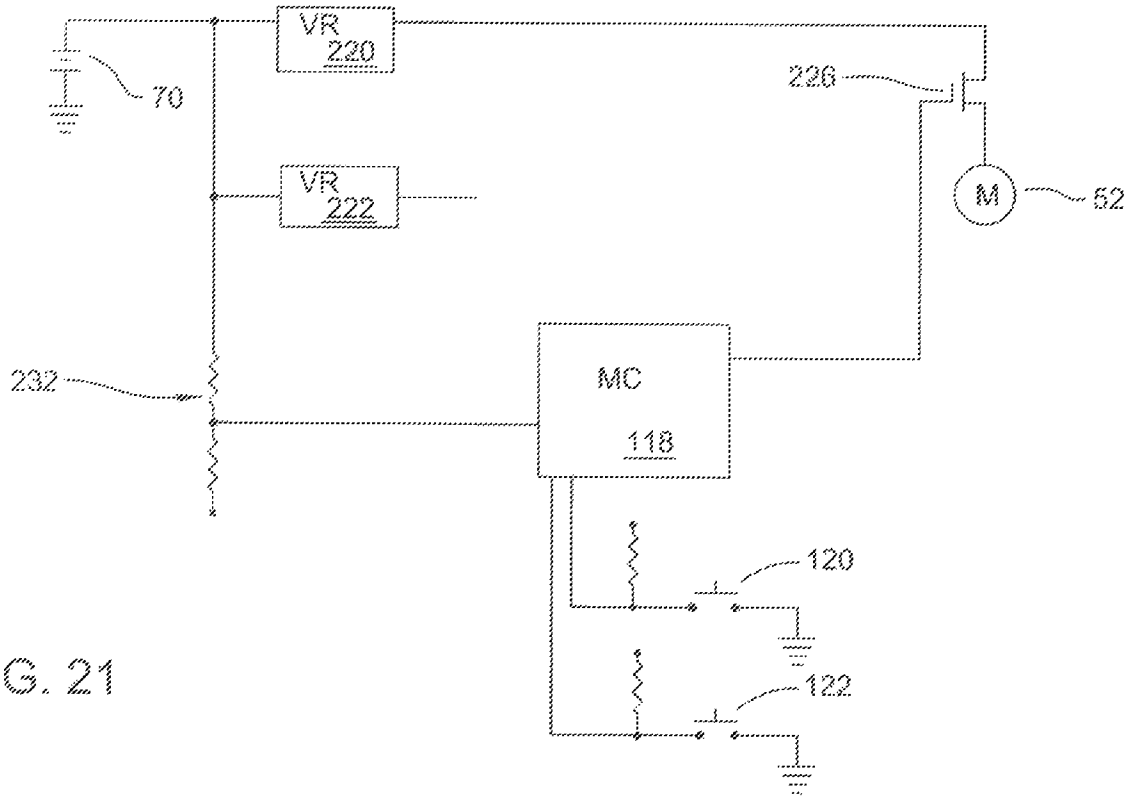
FIG. 21 is an electrical schematic diagram showing the relationship between electronic components disposed on the circuit board.

A light control circuit selectively applies an energization signal to the light source 201 to control both the on/off state of the light source and the intensity of the light emitted by the source. In FIG. 21, the light control circuit is shown as current regulator 230. The current regulator 230 receives a constant voltage energization signal from a voltage regulator 222. In one version of the invention, voltage regulator 222, which is connected to power supply 70, supplies a 3.6 VDC signal to current regulator 230.

In some versions of the invention a single voltage regulator provides a common constant voltage to both the fan control circuit and the light control circuit. In some versions of the invention, there may not even be a need to provide a voltage regulated energization signal to either the fan control circuit or the light control circuit. Thus, in some versions of the invention, either one or both of the fan and light control circuits are powered directly from the power supply 70.

The fan control circuit 224 is electrically connected to the fan motor voltage regulator 220 and the motor 52. The fan control circuit 224 receives electric current from the fan motor voltage regulator 220 and conditions the electric current to control the speed of the motor 52 and the fan 50.

In the illustrated version of the invention, the fan control circuit 224 provides implements pulse-width modulation (PWM) for controlling the speed of the motor 52 and the fan 50. To accomplish the PWM, the fan control circuit 224 includes a microcontroller 118 and a power transistor 226. The microcontroller 118 includes a plurality of inputs and outputs. Two switches 120 and 122 are pushbuttons are electrically connected to individual inputs of the microcontroller 118. (Not identified are the pull up resistors associated with the switches.) The user presses the pushbuttons to adjust the desired speed of the fan 50 (and the consequential air flow). The switches are in the form of pushbuttons mounted to the side of the helmet assembly 12 and are easily operable by the user through the hood 92.

At least one output of the microcontroller 118 is electrically connected to the power transistor 226 to selectively turn on and turn off the transistor based on the desired speed of the fan 50. More specifically, the energization signal applied through the transistor is a PWM signal having a constant frequency and a variable on duty cycle that is directly proportional to the desired fan speed.

Power transistor 226 is in one version of the invention, actually a pair of power MOSFETs, the individual MOSFETs not shown. Here a primary MOSFET is a P-channel type and a secondary MOSFET is an N-channel type. The drain of the primary MOSFET is tied to the positive input of the power supply. The source of the primary MOSFET is tied to fan motor 52. The gate of the primary MOSFET is tied to the positive terminal of the battery through a resistor. The drain of the secondary MOSFET is also tied to the gate of the primary MOSFET. The source of the secondary MOSFET is tied to ground. The gate of the secondary MOSFET is connected to a control line from the microcontroller 118. Thus, the signal present at the drain of the secondary MOSFET gates the primary MOSFET. The IRF7307TR Power MOSFET manufactured by International Rectifier, headquartered in El Segundo, Calif. is a single package that contains both the P- and N-channel MOSFETs that collectively form power transistor 226. Of course, those skilled in the art realize other possible implementations of the power transistor 226 are possible.

Microcontroller 118 is preferably is a Model ATmega8 manufactured by Atmel Corporation, headquartered in San Jose, Calif. The ATmega8 includes built-in PWM support. Other suitable microcontrollers 118 or microprocessors are evident to those skilled in the art. The microcontroller 118 may also be used for functions separate from controlling the speed of the fan 50, as is described in greater detail below.

In one version of the invention, the current through motor 52 is used as feedback signal to establish the PWM rate. A resistor (not illustrated) is tied between the motor 52 and ground. The voltage across the resistor is applied to microcontroller 118 so as to serve as an indication on the motor speed. Motor speed is adjusted by varying the percent on duty cycle of the pulse per fixed total period (on and off) of the pulse.

Microcontroller 118 may also be electrically connected to the focusing servo motor and the light angle servo motor. This eliminates the need to hand adjust the light.

In addition to controlling the volume of air flowing into the helmet assembly 12, the invention provides an audible indication of when the fan is at the minimum and a maximum air flow rates. This indication is provided by momentarily resetting the frequency of the PWM signal applied to the motor. This in turn, causes the motor to be actuated at a rate that causes is shaft to rotate in a manner that causes sound detectable by the human ear to be emitted. This sound provides an audible indication of the minimum and the maximum volume of air to the user. That is, the present invention provides the user with an audible 'ping' upon reaching the minimum and maximum volumes of air flowing into the helmet assembly 12.

This ping is also provided each time the control circuit 224, in response to the depression of one of the control buttons, raises or lowers the speed of the fan motor 52. At the opposed high and low ends of the motor speeds, the controller is configured to actuate the motor so two closely spaced apart in time pings are emitted at the same frequency. This provides the user notice the maximum or minimum motor speed setting has been reached.

The audible ping is provided by, for a brief period, for example between 0.1 and 0.2 seconds, running the fan motor at a frequency at which the motor generates an audible sound. For example, during normal actuation of the motor, the constant frequency of the energization signal applied by the control circuit 224 is 30.3 kHz. Between the transition from outputting the energization signal at a first duty cycle to a second duty cycle, (in order to change the speed of the motor), the energization pulses are applied to the motor at a frequency of between 261 to 523 Hz at a 50% duty cycle. As a result of the energization pulses being applied at this frequency, the speed of the motor drops appreciably. This causes the motor 52 to emit a tone detectable by the human ear In some versions of the invention, the frequency at which the motor is actuated in order to generate the ping varies with new speed range the motor is being set to operate at. For example, in one embodiment of this version of the invention, prior to each time the control circuit 224 increases the on duty cycle of the motor energization signal in order to increase motor speed, the control circuit first applies a high frequency ping-generating energization signal. This results in a relative high frequency ping signal being generated. Prior to the control circuit 224 decreasing the on duty cycle for the energization signal in order to decrease motor speed, the control circuit applies a lower frequency ping-generating energization signal. This results in the emission of a lower frequency ping from the motor 52. Thus, the surgical personnel not only receive an audible indication the fan speed is being reset, they receive an indication regarding if the speed is being lowered or increased.

However, it is to be understood that the frequency at which the motor is selectively actuated may otherwise be within the acceptable range of unaided human hearing (30 Hz to 20 kHz) so long as it provides the audible indication. The frequency of the activation rate causes various components of the motor 52 of the fan module 46 to vibrate at the frequency thereby generating the audible indication.

Alternatively, the fan control circuit 224 includes a potentiometer, also commonly referred to as a variable resistor or varistor, to control the speed of the motor 52 and fan 50, instead of utilizing PWM. Additional implementations for varying the speed of the motor 52 and fan 50 are known to those skilled in the art and may be alternatively utilized.

A printed circuit board 228 (PCB) is disposed within the helmet assembly 12. The PCB 228 supports the voltage regulators 220, 222, the microcontroller 118, and associated electronic devices. The PCB 228 includes conductive tracks to electrically connect items mounted on the PCB 228, as is well known to those skilled in the art.

The personal protection system 10 also includes a light current regulator 230 for providing a constant current, regardless of voltage, to the light source. By keeping the current constant, the light source provides a steady illumination that does not degrade as the cells of the first power supply 70 drain and lose voltage. The light current regulator 230 is preferably integrated with the light assembly 200 within the light housing. However, the light current regulator 230 may be disposed on the PCB 228.

The personal protection system 10 also includes a low power detection circuit for alerting the user when the cells of power supply 70 are running low. In the preferred embodiment, a voltage divider circuit 232 comprising a pair of resistors is electrically connected to the first power supply 70. The signal present at the junction of the resistors is applied as an input signal to microcontroller 118. An enunciator 234 is electrically connected to one of the outputs of the microcontroller 118. The enunciator 234 may be an indicating LED, preferably mounted within the helmet assembly 12 and within the field of view of the user. The enunciator 234 may also be a loudspeaker for producing an audible signal that is hearable by the user, or a combination of the loudspeaker and LED. Alternatively, the enunciator 234 may be substituted with selectively activating and deactivating the power transistor 226 to vibrate the fan and generate an audible signal, as described above.

V. Communications Unit

Referring to FIGS. 22-27, personal protection system 10 also includes a communications unit 236. The communications unit 236 provides wireless communication between other communications units 236. The other communication units may be integrated with other personal protection systems 10 or embodied as one or more stand-alone units. The communications units 236 allow for convenient voice communications between the users of the personal protection systems 10.

The communications unit 236 includes a microphone 238, a speaker 240, and a transceiver 242. Communications unit 236 also includes a second power supply 244. The second power supply 244 powers transceiver 242. Second power supply 244 is preferably at least one cell. The at least one cell is preferably rechargeable; however, non-rechargeable cells may also be used. The at least one cell may be a single cell or a plurality of cells connected together. The transceiver 242 and second power supply 244 are often packaged together and mountable on the body 16 of the user.

Figure 26:
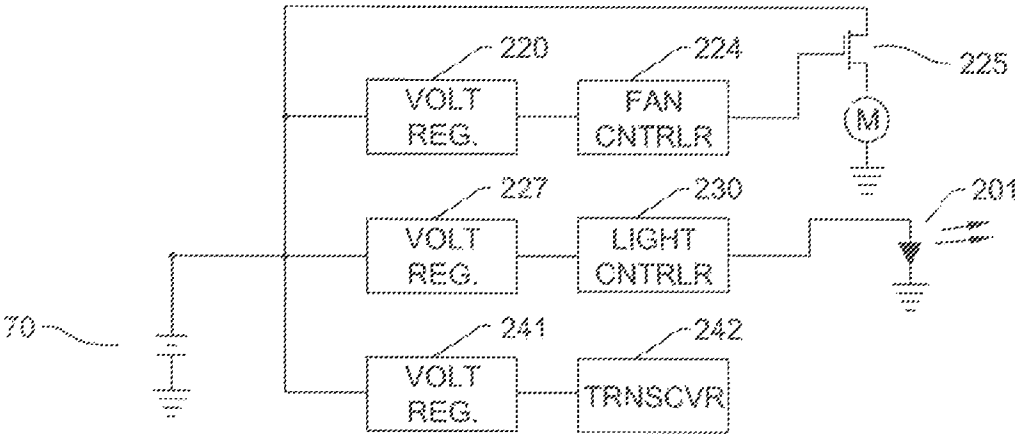
FIG. 26 is a block diagram of how, in some versions of this invention, a single power supply provides the energization current for the fan motor, the light source and the communications transceiver.

Alternatively, as seen in FIG. 26, the transceiver 242 is electrically connected to the first power supply 70, such that the user would not have to carry multiple power supplies. In these versions of the invention a third voltage regulator 241 provides a third constant voltage signal to the transceiver 242. This third voltage is different from the regulated voltages provided to the fan control circuit 224 and the light control circuit (current regulator 230). Transceiver 242 may also be alternatively disposed within the helmet assembly 12.

Microphone 238 converts speech into electrical signals. The signals produced by the microphone 238 are applied to the transceiver 242. Transceiver 242 is preferably a radio frequency (RF) transceiver 242 capable of transmitting and receiving RF signals. The transceiver 242 converts the electrical signal into an RF signal and transmits the RF signal. The transmitted RF signal may then be received by the transceivers 242 of the other communication units. The transceiver 242 converts the received RF signal into an electrical signal. The speaker 240 is electrically connected to the transceiver 242 and receives the electrical signal from the transceiver 242. The speaker 240 decodes the electrical signal into an audio wave which can be heard by the user.

Microphone 238 is attached to the chin bar 44 of the helmet assembly 12. A cable 239 (shown in phantom) over which the signals produced by the microphone is similarly disposed in the chin bar 44. The microphone may be mounted to other locations on the helmet.

In one version of the invention, speaker 240 is an earpiece. The earpiece includes a hook shaped to be worn on the ear of the user. A bud with the actual sound generating transducer is attached to the hook. The bud is shaped to be positioned adjacent or in the ear canal of the user. The audio signal cable that supply signals to the bud are mounted to the helmet. The front end of the cable is however, not mounted to the helmet. This provides a degree of flexibility between the earpiece and the helmet shell 17. This flexibility accommodates for differences in body size of individual users. This flexibility also allows the user to move his/her head while using the personal protection system 10 of the invention while the earpiece remains in place. Also, multiple mounting assemblies are provided in the helmet. This allows the earpiece to be mounted for insertion in either ear of the user of the system 10.

Transceivers 242, in one version of the invention, operate in the 900 MHz band. The individual transceivers exchange digital, spread spectrum RF signals. The communications units 236 preferably operate in full duplex, i.e., the transceivers 242 can transmit and receive RF signals at the same time. One example of a suitable transceiver 242 is the STx 1000 manufactured by Eartec of Narragansett, R.I. Coachcomm of Auburn, Ala. also markets an appropriate transceiver system. Each of these systems allows three or more individuals to simultaneously use the surgical protect system 10 of this invention and communicate in full duplex mode with each other using the transceivers. There is no need to depress a push-to-talk switch in order for any individual to communicate with another individual. Thus, this protection system 10 allows a group of individuals (three or more) to engage in conversation with each other as if in normal group conversation, without having to raise their voices in order to overcome the sound attenuating of the protective hoods 92 and the noise generated by the fan 50 and motor 52.

Figure 27:
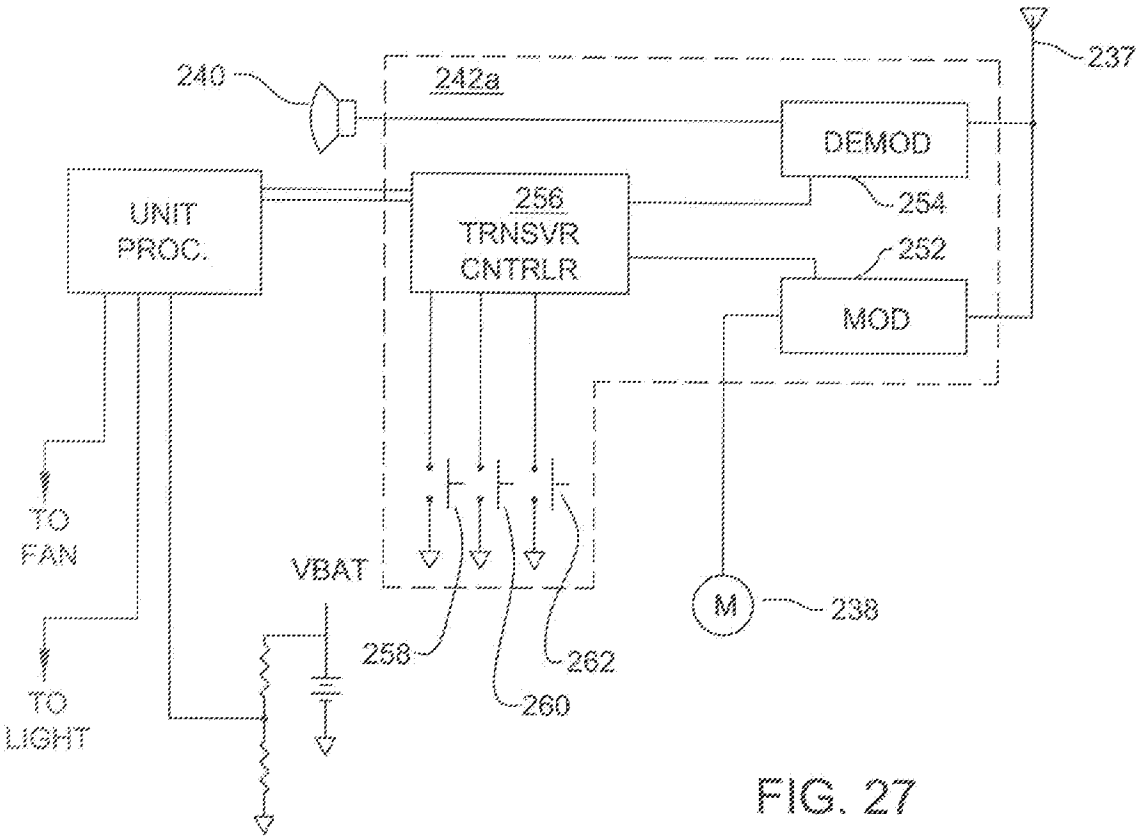
FIG. 27 is a block diagram of the components internal to a transceiver of this invention.

FIG. 27 illustrates in block form an alternative transceiver 242*a* of this invention. Transceiver 242*a* includes a modulator 252 for converting audio signals received from the microphone 238 into RF signals. The RF signals generated by the modulator 252 are broadcast over communications unit antenna 237. Also connected to antenna 237 is the transceiver demodulator 254. The demodulator 254 converts the received RF signals into audio signals that can be used to actuate the speaker 240.

Actuation of the modulator 252 and demodulator 254 is controlled by a transceiver controller 256 also part of transceiver 242*a*. This transceiver controller 256 could be a conventional digital microprocessor, a PLA or a DSP. Transceiver controller 256 regulates the actuation of the modulator 252 and demodulator 254 in part based on the state of three user actuated switches 258, 260 and 262. An individual wearing system 10 of this invention could actuate one switch, for example switch 258, in order to effectively "turn off" the demodulator. 254. An individual takes this step if he/she does not want to receive the transmissions broadcast by others employing the communications units. If the individual wants the transceiver 242*a* in this state, the transmitter controller could respond by deactivating the demodulator 254. Alternatively, the transceiver controller 256, in response to the user wanting speaker 240 deactivated, turns on a FET that causes the audio output signal generated by the demodulator 254 to go to ground (FET not illustrated).

Transceiver controller 256 also selectively deactivates the output of RF signals by the modulator 252. The individual using system 10 may want the modulator 252 to temporarily stop broadcasting RF signals with embedded audio signals if he/she wants to conduct a conversation with a nearby individual that is not for broadcast. Switch 260 is actuated to regulate the selective broadcast of the RF modulated audio signals. In response to the individual wanting the transceiver 242*a* to not broadcast audio signals, the transceiver controller 256 temporarily stops actuation of the modulator 252. Alternatively, by switching a FET (not illustrated) the transceiver controller 256 selectively blocks the forwarding of audio signals from the microphone to the modulator 252.

The transceiver controller 256 also regulates the modulator 252 to control which group or groups of other communication units 236 are able to receive signals emitted by the transceiver 242*a*. For example, in versions of the invention wherein the individual transceivers exchange signals using a direct sequence spread spectrum protocol, the transmitter controller 256 regulates the codes used to establish the modulation of the output signals and the demodulation of the input signals. In versions of the invention wherein the individual transceivers exchange signals using a frequency hoping spread spectrum protocol, transceiver controller 256 generates the code that establishes the frequency hoping pattern of the carrier frequency. Switch 262 is the control member that is actuated to establish which group or group of communications units are able to exchange and/or receive signals.

The utility of the protection system of this invention's ability to selective exchange signals is now explained by reference to FIG. 28. Here, five individual communication units 236*a*-236*e* are shown. Arbitrarily, communications unit 236*d* is one unit that has this selective transmission/reception capability. Thus, by depressing switch 262, the associated transmitter controller 256 configures the transceiver 242*a* of communication unit 236*d* so that the broadcast audio signals can be received by all the remaining units 236*a*, 236*b*, 236*c* and 236*e* or just by unit 236*e*. This allows a surgeon to have some privacy to communication with another individual wearing the system 10. Alternatively, this allows a surgical assistant to communicate with another individual without disturbing the surgeon.

In FIG. 29, a receiver 264 is also shown. The receiver is capable of receiving the signals broadcast by one or more the communication units 236*a*-236*e*. The audio signals broadcast by the receiver 264 can be broadcast through a loudspeaker 263. This may be desirable in a teaching setting. Alternatively, the audio signals may be stored with the aid of a recorder 265. Again, by selective modulation of the broadcast signals, the ability of the receiver to demodulate the signals broadcast by any particular transceiver 242*a* is selectively regulated.

Returning to FIG. 28, it is seen that a unit processor 272 is connected to the transceiver controller 256. Digital signals extracted from the received RF signals by the demodulator 254 are forwarded to the transceiver controller 256. Modulator 252 is able to embed digital signals received from the transceiver controller 256 into the broadcast RF signals. Primarily the transceiver controller 256 functions as a intermediate processor for transmitting digital signals received by the unit processor 272 and forwarding digital signals used by the unit processor. In some versions of the invention, transceiver controller 256 and unit processor 272 are a single unit.

Figure 28:
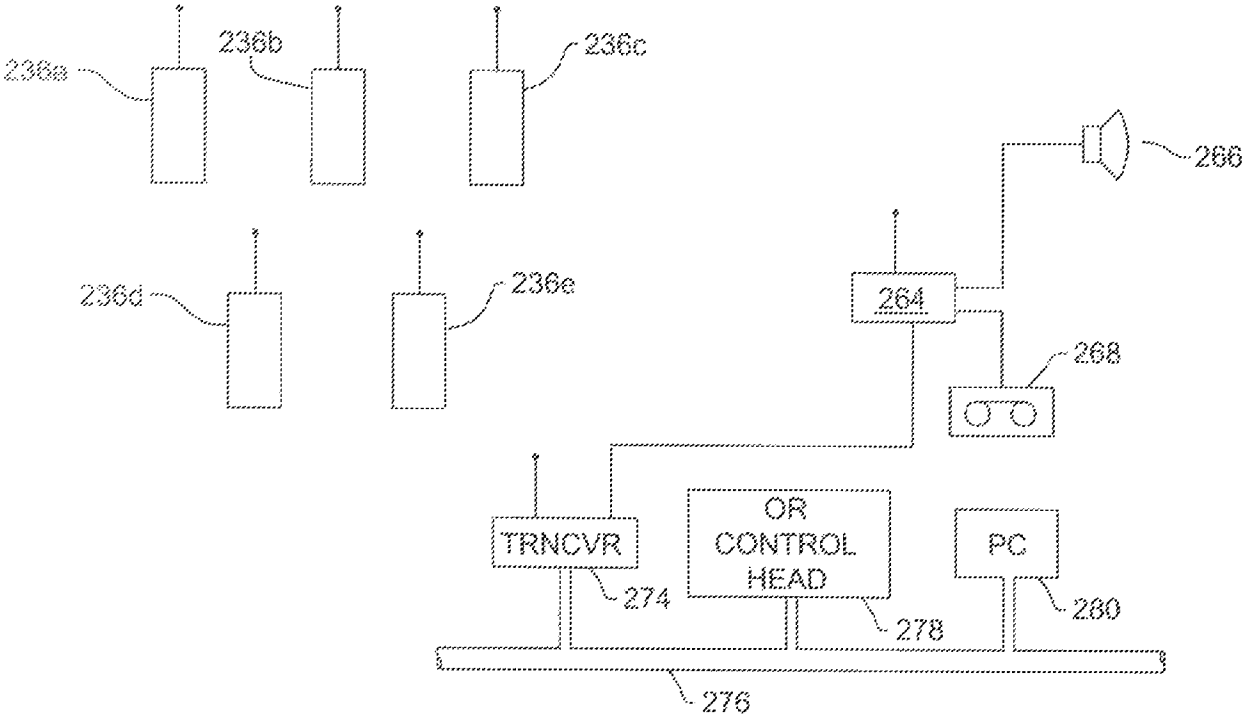
FIG. 28 is a diagrammatic illustration of how signals are exchanged between different communications units of this invention.
Figure 14:
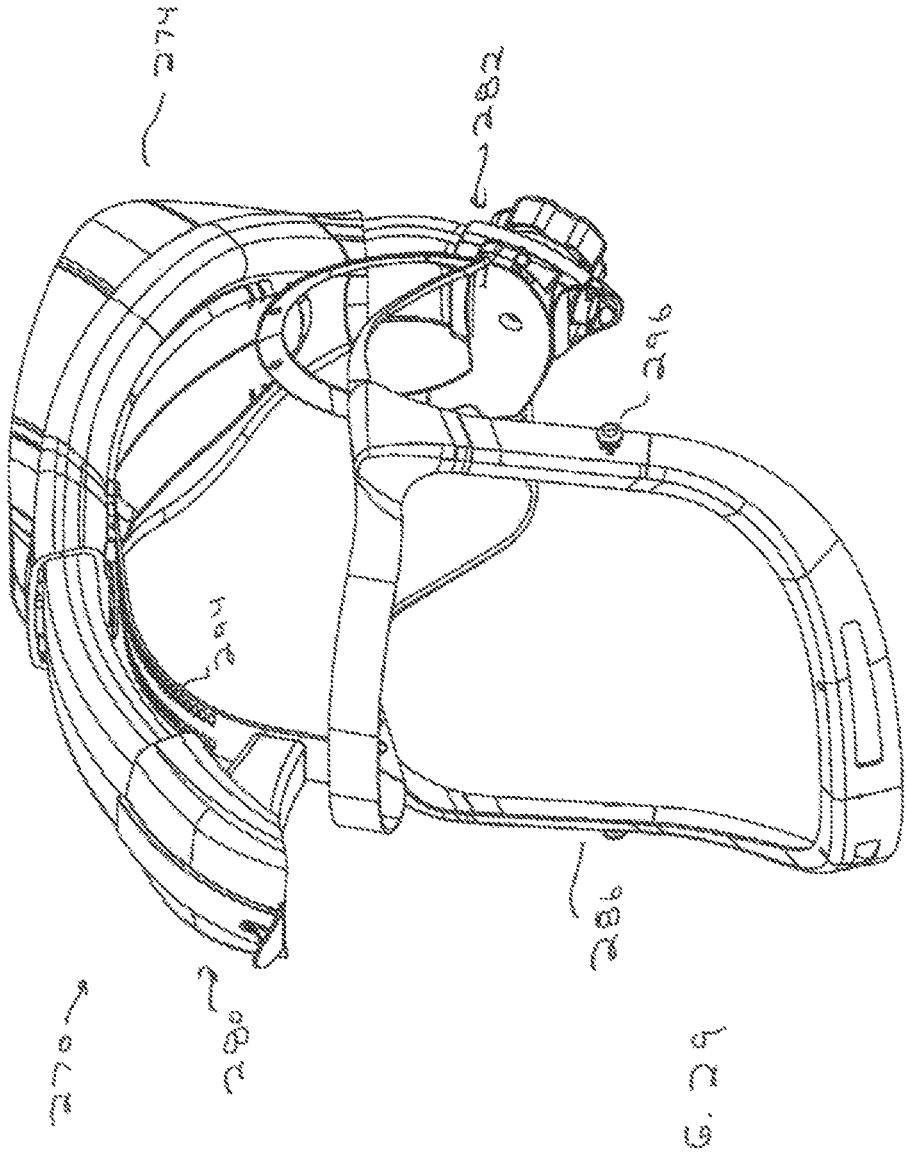
Figure 30:
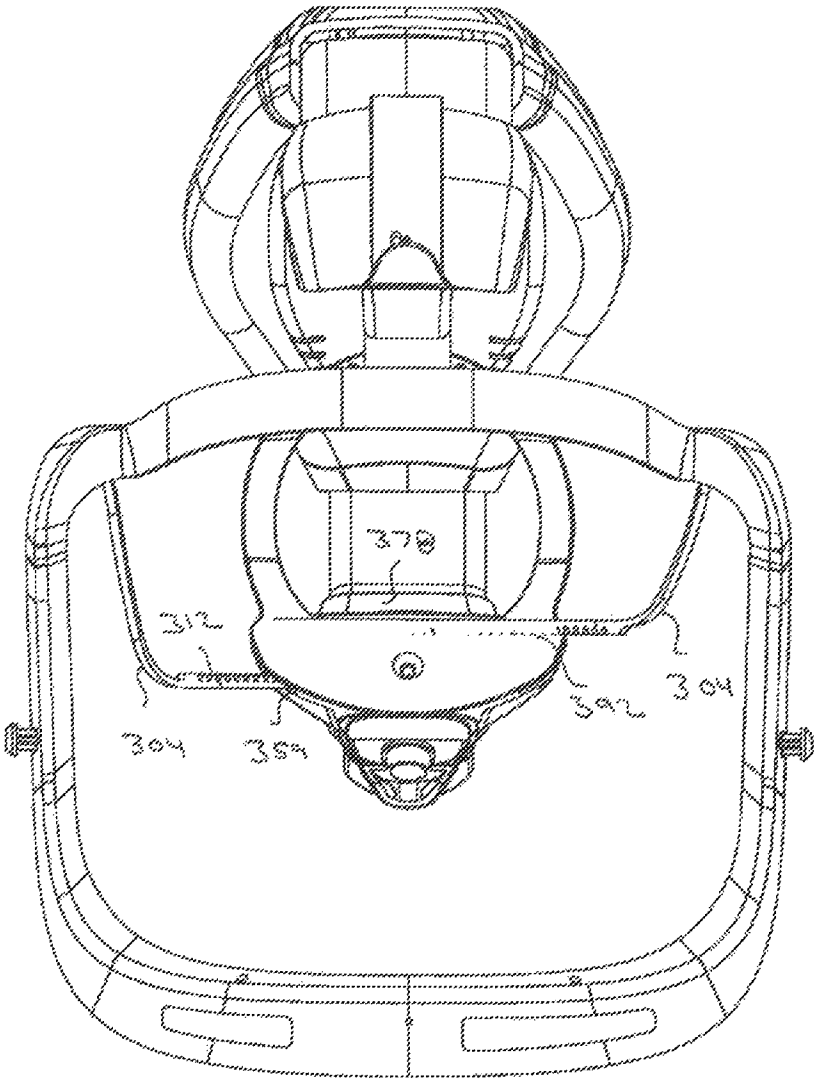
FIG. 30 is a front view of the head unit.
Figure 26:
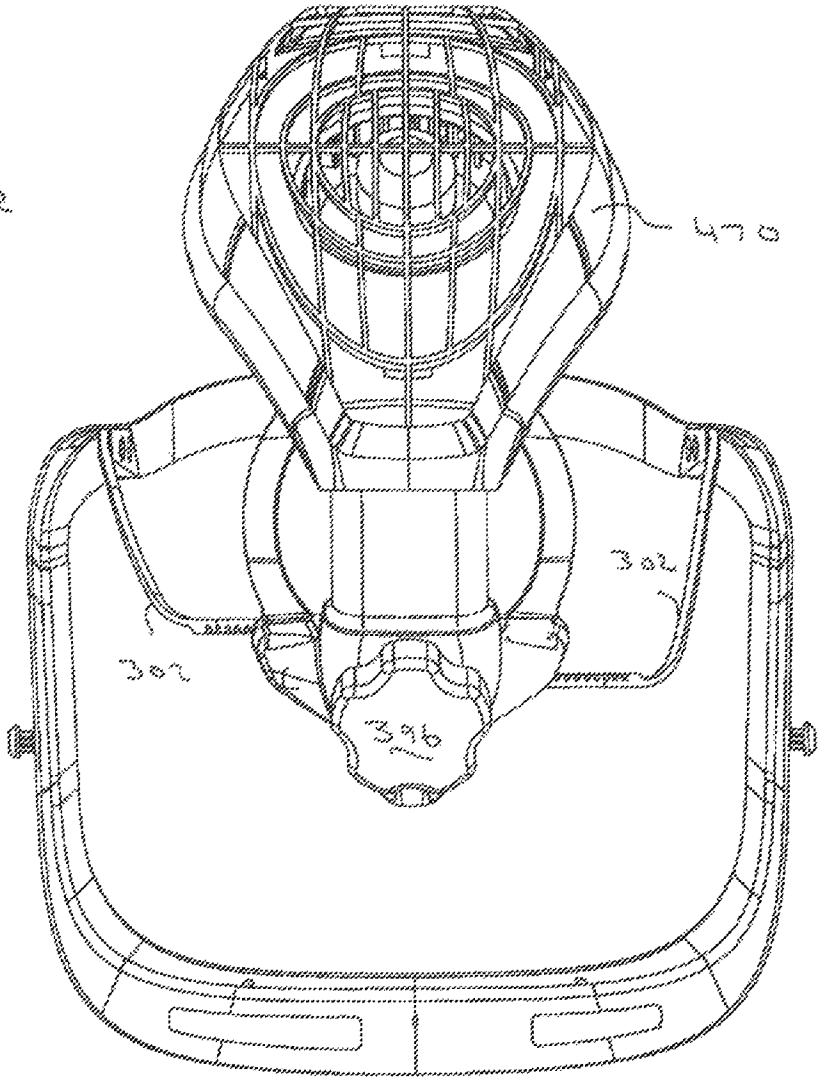

The digital RF signals are exchanged with a static RF transceiver 259 seen in FIG. 28. Transceiver 259 is connected to a communications bus 266 in the operating room. Other units connected to the bus include the below-discussed operating room control head 261 and equipment such as a personal computer 268. One such operating room control head 261 is sold by the Applicants' Assignee under the trademark SIDNE. This arrangement allows the transceiver 242*a* to serve as the unit through which other components of the surgical protection system 10 exchange signals with remote devices. In FIG. 28, the operating room control head is shown as receiving audio signals from the static receiver 264. In some versions of the invention, transceivers 264 and 259 are a single unit.

For example, by speaking into the microphone 238, the surgeon speaks the command "Focus Light". The audio signal representative of these words is transmitted by transceiver 242*a* to the operating room control head. The operating room control head processes the audio signals to decode the command. Once the command is interpreted, the operating room control head, through transceiver 259 generates a command data packet to the transceiver 242*a*. The transceiver 242*a* strips out the command message and forwards it to the unit processor 272. Unit processor 272, upon receipt of the command, generates appropriate control signals to cause the actuation of the servo motor employed to displace the lens integral with the light assembly 200.

The speed of the fan motor 52 is similarly regulated by the integrated system of this invention.

Communication unit 236*a* can also provides voice actuated control of the other equipment in the operating room such as the surgical instruments and the operating room environmental settings (HVAC and light). More specifically, the spoken commands entered through microphone 238 are transmitted by transceiver 242*a* and receiver 264 to the operating room control head 261. The operating room control head then generates the appropriate instruction packets that are output on bus 266 to the appropriate device that is to act on the instructions.

The integrated construction of the system of this invention also allows the personal protection system 10 to report back information regarding its own operating state. In FIG. 28, the signal present at the junction of the two resistors forming voltage divider 232 is shown as being applied to unit processor 272. In the event the signal present at this point falls to a level at which indicates the charge stored in power supply 70 is becoming low, the unit processor 272 generates a data packet with these data. The data packet is forwarded to the transceiver controller 256 so it is broadcast by the transceiver 242*a*. The data packet is received by transceiver 259. This packet is forwarded to the personal computer 268. This provides personnel in the operating room with notice that the particular power supply 70 worn by a specific individual is close to being discharged and should be replaced.

VI. Alternative Head Unit

FIGS. 29 through 34 illustrate an alternative support structure for supporting hood 92 around the head and upper body of the wearer. This particular support structure is a head unit 270. Head unit 270 includes a head band 272 to which a ventilation unit 274 and light 276 (FIG. 49) are adjustably mounted. The air forced through the ventilation unit 274 is discharged through front and rear nozzle assemblies 280 and 282, respectively. The adjustability of the ventilation unit 274 relative to the head band allows the components forming the unit, primarily the ventilation fan 278, to be positioned relative to the body of the wearer where the physical strain the unit imposes on the wearer is minimized.

More particularly, head unit 270 includes a face frame 286 formed of plastic that has some flexibility. In one version of the invention, face frame 286 is formed from polypropylene or Nylon. Face frame 286, best seen in FIG. 35, is shaped to have a forehead band 288 that has a curvature designed to allow the bar to fit against the forehead of the individual. Not shown are padding that may be secured to the inner surface of the forehead band 288. Extending downwardly from the opposed ends of forehead band 288, face frame 286 has downwardly extending support posts 290. A chin bar 292, also part of face frame 286 extends between the opposed bottom ends of support posts 290. Chin bar 292 has a curved shape such that between the posts 290, the chin bar curves forward of the posts so as to extend around and in front of the person wearing the head unit 270.

Also part of face frame 286 is a support strap 294. Support strap 294 is in the form of a generally rectangular strip and extends upwardly from the center of the forehead band 288. As discussed below, support strap 294 is the member from which the ventilation unit 274, light 276 and front nozzle assembly 280 are suspended.

A mounting pin 296 extends outwardly from each of the face frame support posts 290. Each mounting pin 296 has a stem (not identified) that extends outwardly from the outer surface of the associated support post 290. Each mounting pin 296 also has a wide diameter head 298 that forms the free end of the pin. Mounting pins 296 support and secure the transparent shield integral with the hood.

Figure 36:
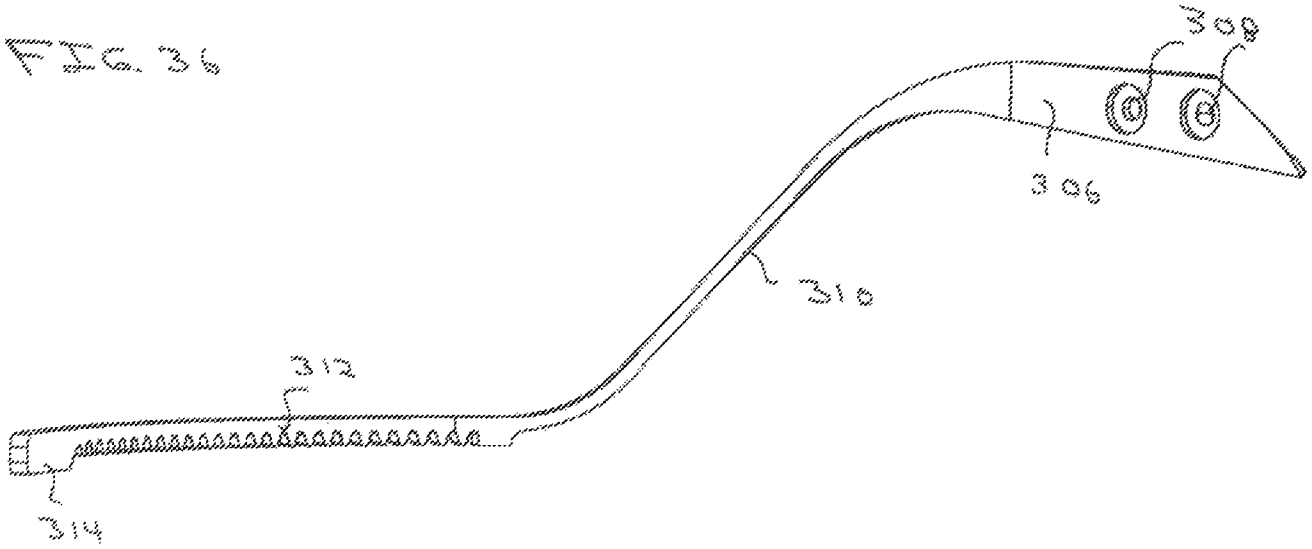
FIG. 36 is a plan view of one of the head straps.

A head strap 302 extends rearwardly from each end of the face frame forehead band 288. Collectively, the forehead band 288 and head straps 302 form the head band 272. Head straps 302 are formed from very flexible plastic such as Nylon 66. Each head strap 302, as seen in FIG. 36, includes a base 306 that has a relatively wide width. Base 306 is seated against the inner surface of the associated end of the forehead band 288. Two openings 308 extend through each strap base 306. Openings 308 accommodate fasteners (not illustrated,) that hold the head strap 304 to the face frame 286. In the illustrated versions of the invention, a counterbore (not identified) extends around each opening 308.

A leg 310 extends downwardly from the each head strap base 306. Each leg 310 has a width less than that of base 306 from which the leg extends. Each head strap 302 has a rack 312 that extends from the free end of the leg 310. The racks have a set of teeth (not identified) that extend laterally away from the longitudinal axis of the rack. FIG. 36 illustrates the head strap 302 for the left side of head unit 270. This head strap 302 is formed so that the rack teeth project downwardly. The head strap 302 for the right side of the head unit 270 is formed so that the teeth project upwardly. A toe 314 projects perpendicularly away from the free end of each rack 312. Each toe 314 is directed in the same direction in which the associated rack teeth are directed.

Rear nozzle assembly 282 both directs the output flow from the fan 278 down the neck of the wearer and holds head straps 302 together. Rear nozzle assembly 282 includes a shell 320 and a tip 318 that rotates around the longitudinal axis of the shell.

Figure 37:
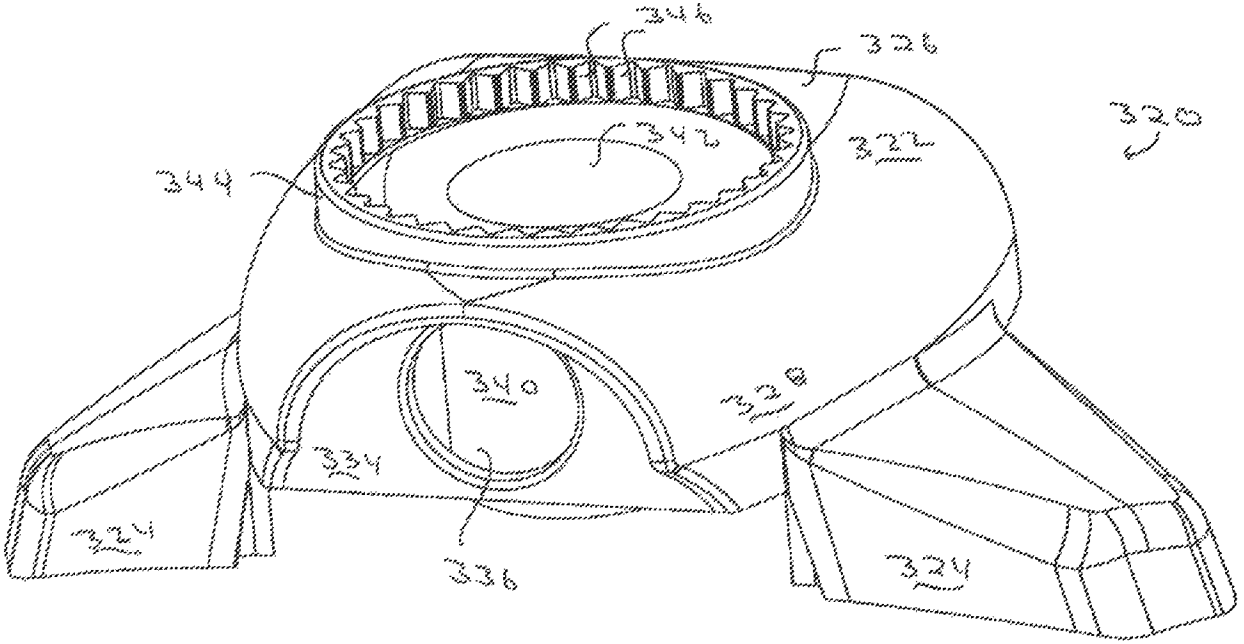
FIG. 37 is view of the outside of the rear nozzle assembly shell.
Figure 38:
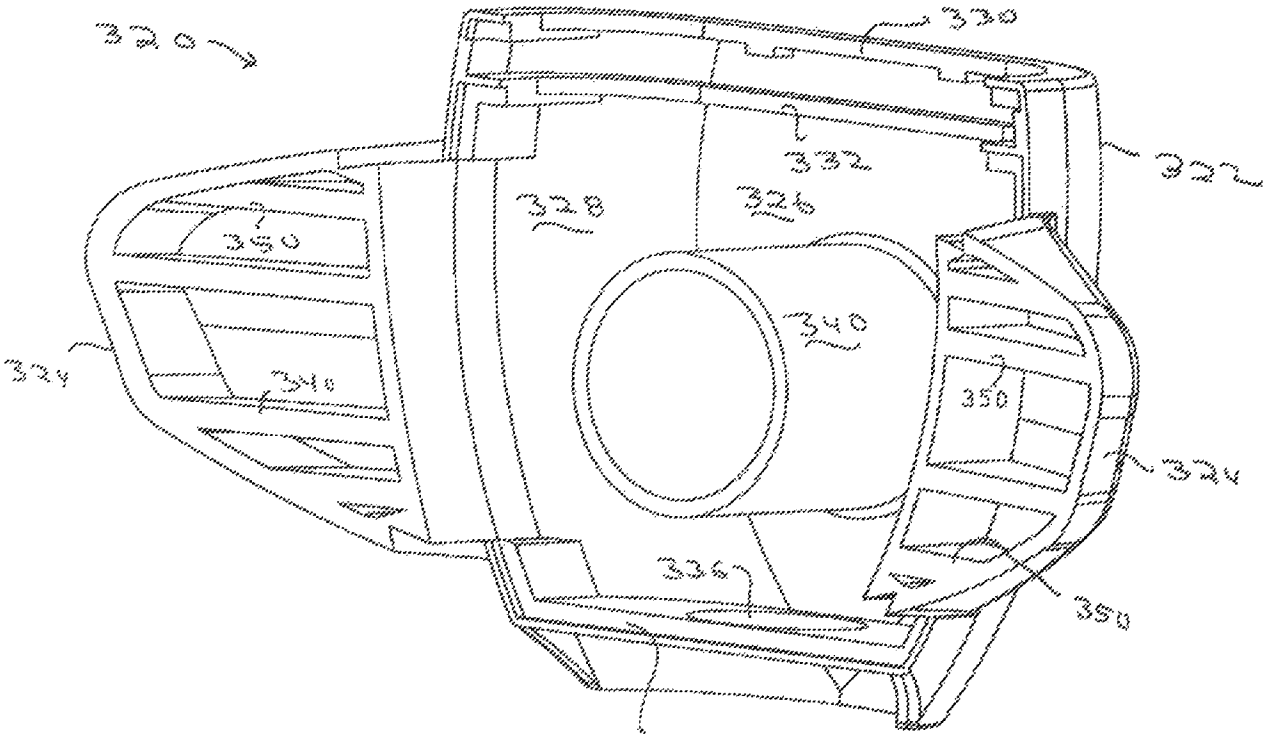
FIG. 38 is a view of the inside of the rear assembly shell.
Figure 30:
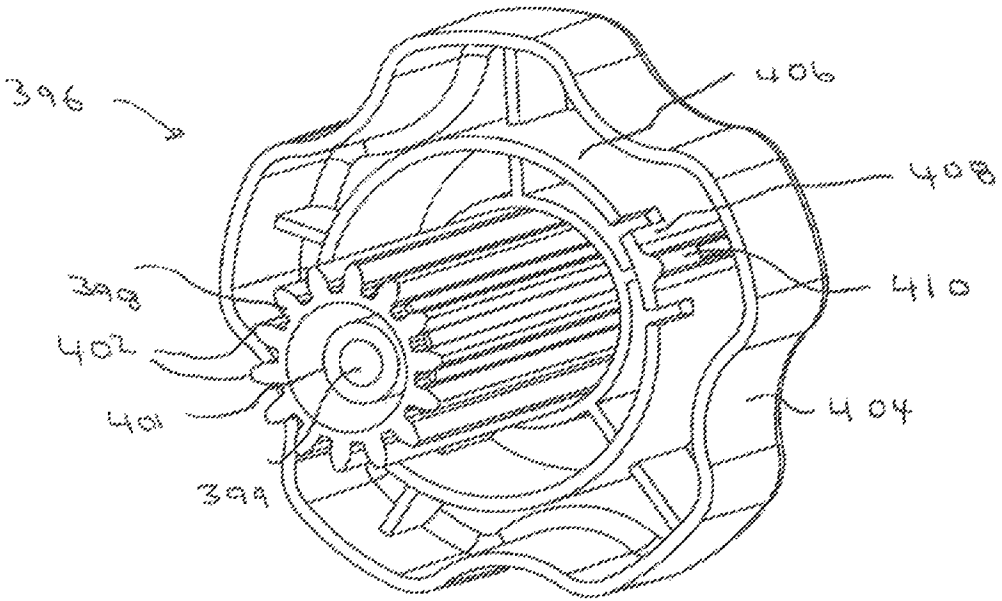
Figure 34:
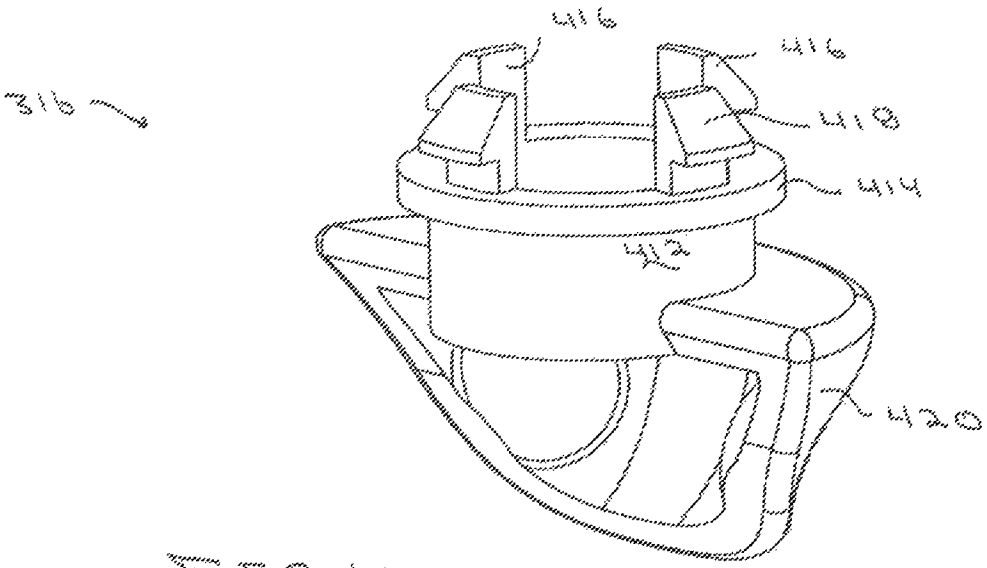
Figure 34:
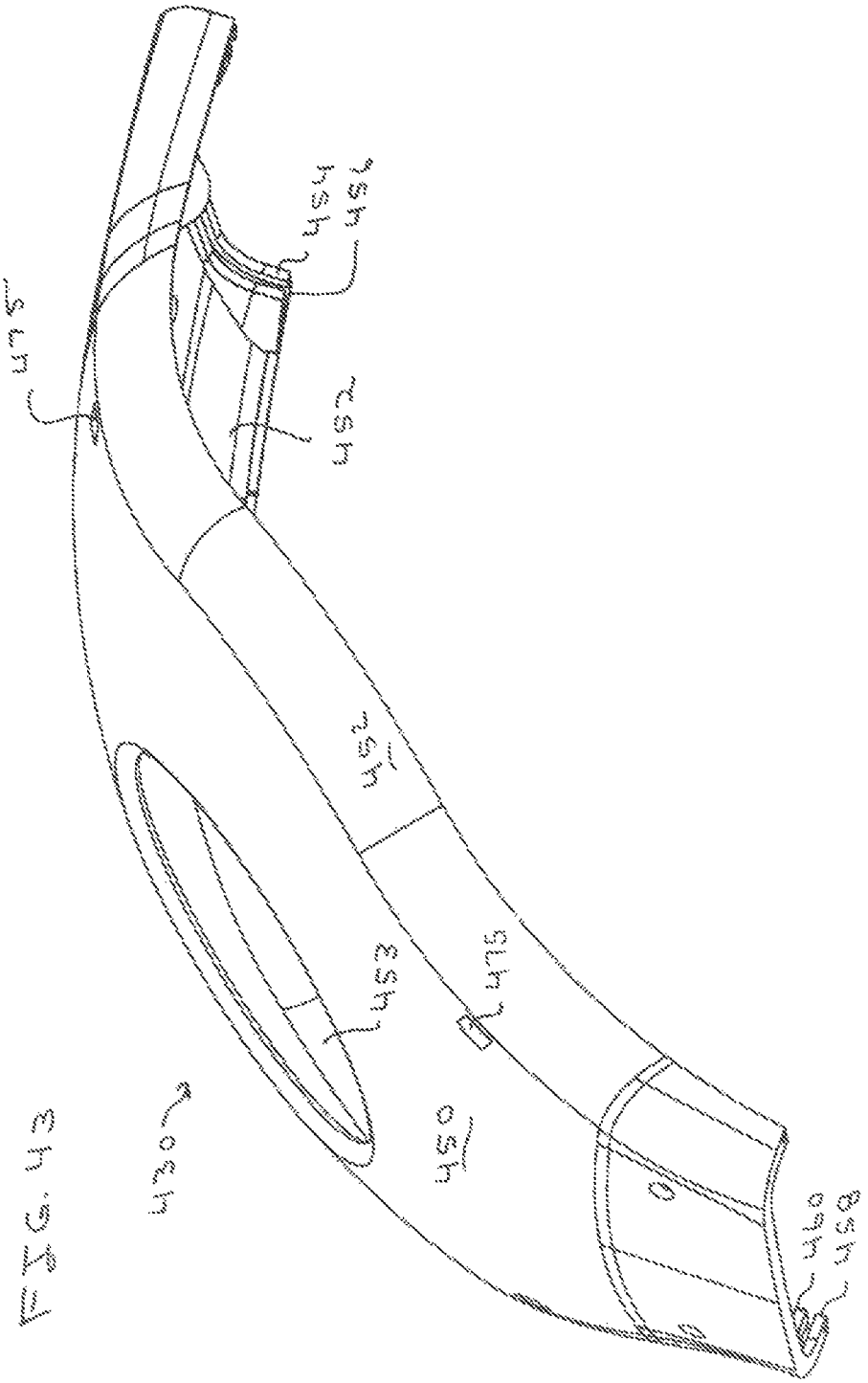

The rear nozzle assembly shell 320 now described by reference to FIGS. 37 and 38. Shell 320, is formed from a single piece of plastic and has a three-sided trunk 322 from which two wings 324 extend. More particularly, the trunk 322 is formed to have a back wall 326 that curves into two opposed side walls 328. Shell 320 is further formed so that the opposed side walls 328 are inwardly tapered. Consequently, shell 320 is wider at the top than at the bottom. The shell 320 is further formed to have two spaced apart ribs 330 and 332 that extend laterally across the inner surface of the shell, from side wall to side wall. Rib 330 is located around the open end of the shell 320. Rib 332 is parallel to and located below rib 330.

A plate 334 extends from the inner surfaces of back wall 326 and side walls 328. Plate 334 extends to and does not project beyond the inner edges of the side walls 328. An opening 336 extends through the plate 334. Opening 336 is centered along an axis that extends longitudinally through the void space defined by the shell back wall 326 and side walls 328.

A rigid tubular sleeve 340 extends inwardly from the shell back wall 326 so to project into the void space between the back wall and side walls 328. Sleeve 340 extends from an opening 342 in the back wall 326. The back wall 326 is further formed to have an annular ring 344 concentric from and radially spaced away from opening 342 that projects from the wall outer surface. Ring 344 is formed with spaced apart teeth 346 that extend inwardly to opening 342.

Each shell wing 324 extends from a separate one of the base side walls 328. The wings 324 are basically three wall structures that are arranged so that the open faces thereof extend forwardly, toward face frame 286. Plural spaced apart reinforcing webs 350 extend through the void spaces defined by each wing 324 and the trunk side wall 328 from which the wing extends. Webs 350 extend laterally, that is perpendicular to the top-to-bottom longitudinal axis through the shell 320.

A plate 352, also part of the rear nozzle assembly 282, extends over the open void defined by the shell 320. Plate 352, now described by reference to FIG. 39, has a panel section 354 with a generally concavo-convex profile. The panel section 354 is further formed to have side edges (not identified) that are inwardly tapered. Panel section 354 is further formed so that the opposed top and bottom side edges are outwardly bowed. The panel section 354 is also shaped to have curved corners.

Figure 39:
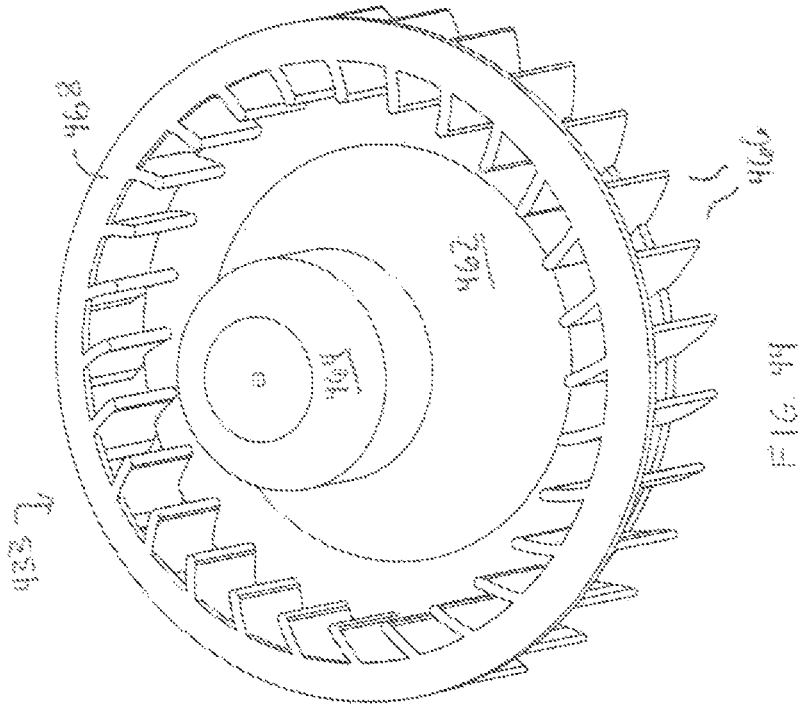
FIG. 39 is a perspective view of the inside of the plate of the rear nozzle assembly.

Extending outwardly from the inner surface of the panel section 354, the surface seen in FIG. 39, plate 352 is shaped to have two four sided reinforcing frames 356. Each reinforcing frame 356 extends outwardly from the inner surface of panel section 354. Each frame 356 has two parallel and spaced apart top and bottom ribs 358. An outer rib 360 located along the adjacent side edge of the panel section 354 extends between ribs 358 at one end of each frame. An inner rib 362, that is curved toward the side, extends between each of the ribs at the opposed inner end of each frame 356.

A hole 364 extends through the center of panel section 354. The panel section 354 is formed with an annular rib 366 around the hole 364. The plate 352 is further shaped so that the frame inner ribs 362 have a center of curvature that is concentric with hole 364.

A foot 368 projects outwardly from the bottom of panel section 354. Foot 368 has a planar base 369 that forms the bottommost structural component of the plate 352. Steps 370 extend from the opposed ends of foot 369 to the adjacent sections of the panel section bottom edge. Short lips 372 extend from each step 370 a short distance along the adjacent section of the panel section bottom edge. A reinforcing web 374 extends along the inner surface of the panel section 354. Web 374 extends between the opposed free ends of lips 372. The web 374 is parallel with and spaced apart from the two linearly aligned bottom ribs 358 of the reinforcing frames 356. Thus, a slot 359 is defined between the lowermost ribs 356 and web 374.

The plate 352 also has a three sided collar 378 that is integral with and extends a short distance above the panel section 354. Collar 378 has a front wall 380. Two side walls 382 curve inwardly from the opposed ends of the front wall 380. Formed integrally with the collar are two parallel ribs 384 and 386. Rib 384 extends inwardly across the coplanar top edges of the collar front wall 380 and side walls 382. Rib 386 is located below and is spaced from rib 384.

A lip 387 extends from each collar outwardly along the panel section top edge. The lips 387 project away from the inner surface of the panel section 354. A web 390 extends outwardly from the inner surface of the panel section 354 between the ends of the opposed lips 387. The web 390 is parallel to and located above the opposed, linearly aligned top ribs 378 of the reinforcing frames 356. Thus, a slot 392 is defined by the top located ribs 356 and web 390.

Plate 352 is further formed to have a support arch 394. The arch 394, which has a generally circular shape, extends upwardly from top edge of panel section 354. While cross sectional slices through the arch are of constant diameter, the arch does not lie flat. The arch 394 is angled toward the center. This profile approximately matches the general contour at the back of the skull. More particularly, the opposed terminuses of arch 394 are each located between one end of collar 378 and the adjacent panel side edge. As discussed below, arch 394 flexibly supports the ventilation unit 274 above the head of the wearer.

When the rear nozzle assembly 280 is assembled, plate 352 is positioned against the open, forward directed surfaces of shell 320. A knob 396, also part of the rear nozzle assembly 282, is mounted to the exposed back surface of the shell 320. The knob 396, seen best in FIG. 40, includes a cylindrical shaft 398. Arcuately spaced apart teeth 402 extend radially outwardly along the shaft 398. The knob shaft 398 is further formed to have a bore 399 that is open from the free end of the shaft. In one version of the invention, bore 399 extends through a sleeve 401 constrict with and located in shaft 398.

The knob 396 also has a head 404 disposed over one end of the shaft 398. Internal to the head 404 is ring 406 that extends around the portion of the shaft disposed in the head. Ring 406 is concentric with and spaced radially outwardly from shaft 398. The ring 406 is formed with two diametrically opposed flexible tabs 408 (one shown). Each tab 408 has a single rib 410 that extends longitudinally along the outer surface of the tab.

The rear nozzle assembly 280 is constructed so that the knob shaft 398 seats in and extends through shell sleeve 340. The free end of the shaft 398 seats against the annular space about the reinforcing rib 366 formed in plate 352. A threaded fastener (not illustrated) extends through plate hole 364 and into bore 399 integral with knob 396. This fastener holds the panel 352 to the shell 320. When the rear nozzle assembly is so constructed, the ribs 410 integral with knob 396 seat in the void spaces between shell teeth 346.

When head unit 270 is assembled, the head strap racks 312 seat in the slots between shell 320 and panel 352. This is seen best in FIG. 30; here it is understood the left-right sides of head unit being inverted. Specifically, the rack 312 integral with the right side head strap 302 seats in slot 359. The rack 312 the forms part of the left side head strap seats in slot 392. The rack teeth engage knob teeth 402.

Figure 41:
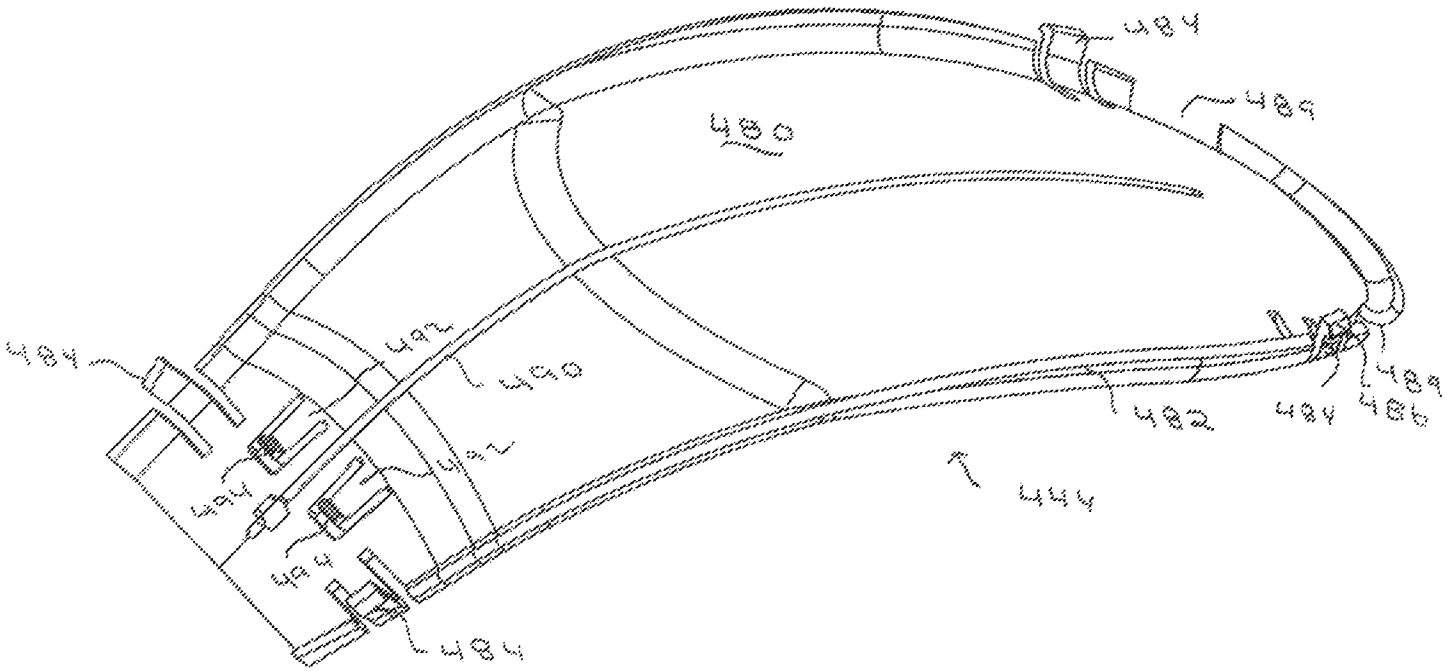
FIG. 41 is a perspective view of tip of the rear nozzle assembly.

Rear nozzle tip 318, now described by FIG. 41, includes a tubular base 412. A lip 414 extends annularly around the open end of base 412 and away from the outer surface of base. Projecting upwardly from lip 414, nozzle tip 318 has four equangularly spaced apart mounting tabs 416. Each tab 416 has a head 418 with a tapered outer surface. When the rear nozzle assembly 282 is put together, tabs 342 snap fit in shell opening 336. Nozzle tip 318 is thus able to rotate relative to the axis that extends through opening 336.

Nozzle tip 318 is formed with a head 420 that partially surrounds the bottom open end of base 412. The nozzle tip 318 is formed so that tip head 420 is generally shell shaped such that the open end of base 338 opens into the void space defined by the concave surface of the head.

Returning to FIG. 34 it can be seen that ventilation unit 274 includes lower and upper shells 428 and 430, respectively, that house a fan 433 and a motor 434. The lower shell 428, best seen in FIG. 42, includes a base 432. The lower shell 428 is formed so that the base 432 is widest at the center and relatively narrow at the opposed front and rear ends. Opposed side walls 434 extend upwardly from the side edges of base 432 extend along the longitudinal side edges of the base. Shell base 432 also has a cylindrical, hollow boss 436 that extends upwardly from the center of the base. Boss 436 is dimensioned to receive the fan motor 434. Not identified is the opening in the center of the boss 436 wherein the rotating shaft of the motor extends therethrough.

The lower shell 428 is formed with two pairs of posts 438 and 440 that receive fasteners for holding the upper and lower shells together. Each of the posts 438 and 440 extends upwardly from the shell base 432. A first pair of posts, posts 438, are located adjacent the front end of the lower shell 428. Each post 438 is located inwardly of an adjacent one of the side walls 434 at the front end of the shell 428. Each post 440 is located inwardly of and adjacent one of the side walls at the rear of the shell 428.

Two parallel ribs 442 and 444 extend inwardly from the shell base 432 and side wall 434 adjacent the rear opening these surfaces define. One rib, rib 442 extends inwardly around the open rear end of the shell. Rib 444 is located forward of and spaced apart from rib 442. While not illustrated, it should be appreciated that similar ribs project outwardly from the base 432 and side walls 434 at the front end of the lower shell 428.

The lower shell 428 also has a set of baffle plates 438 and 440 that partially surround and are radially spaced away from boss 436. One plate, plate 438, is generally S-shaped and starts at a locating slightly behind the open front end of the shell and the curves slightly inwardly. Baffle plate 438 then has a section that is has a radius of curvature that is centered on the axis of boss 436. This particular section of the baffle plate 438 subtends approximately 150° of the circumference around the boss 436. Baffle plate 438 also has a tail section that angles away from the S-section. This section of the baffle plate angles back to and abuts the adjacent shell side wall 434.

Baffle plate 440 has an arcuate profile. The baffle plate 440 extends from the side wall 434 opposite the side wall with which plate 438 is associated. Baffle plate 440 is spaced forward of and substantially covers the open end of the lower shell 428. The baffle plate 440 subtends an arc of approximately 70° around boss 436. There is an arcuate separation of approximately 5 to 10° between the arcuate section of baffle plate 438 and the adjacent plate 440.

The lower shell 428 is also formed so that there are a number of rectangular openings 442 in the base 432. Openings 442 facilitate the securing of a motor cover 444 (FIG. 34) to the exposed bottom surface of the lower shell 428 as discussed below.

The upper shell 430, now described by reference to FIG. 43, includes a lid 450 from which two side walls 452 extends. Lid 450 has a shape that generally conforms to that of lower shell base 432. The lid 450, like the lower shell base 432 is curved along its longitudinal axis. Side walls 452 extend along the longitudinal side edges of the lid and curve downwardly from the lid. The lid 450 is formed with a circular center opening 453. When the shells 428 and 430 are assembled together, opening 453 is coaxial with lower shell boss 436.

The upper shell 430 is further formed to have ribs 454, 456, 458 and 460 similar to the ribs 442 and 44 of the lower shell 428. Two parallel ribs 454 and 456 extend side wall to side wall at the front end of the upper shell. Rib 454 extends into the opening defined by the lid 450 and the adjacent side walls 452. Rib 456 is parallel to and spaced behind rib 454. Ribs 458 and 460 adjacent the rear opening of the upper shell 428 (ribs only partially shown.) The first rib, rib 458, extends around the rear opening. The second rib, rib 460, is spaced inwardly of rib 458.

Figure 44A:
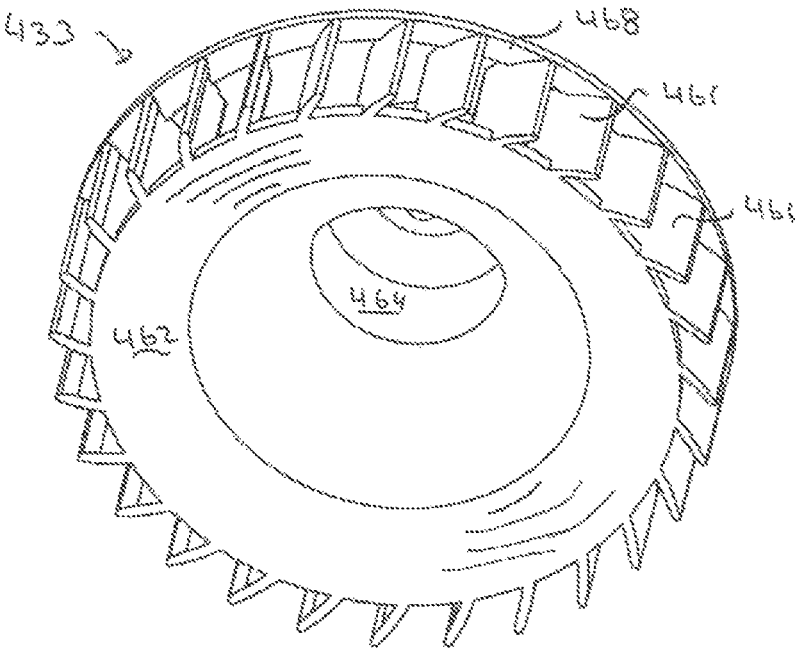
FIG. 44A is a perspective view of the underside of the fan.

Fan 433, illustrated in FIGS. 44 and 44A, has a circular base 462. A hollow boss 464 extends upwardly from the center of the base 462. While the fan base is circular, it is not flat. Instead the base 462 curves upwardly to the hole formed by boss 464. When the ventilation unit 274 is assembled, the fan 433 is fitted in the lower shell 428 for mounting to the motor 434 the fan boss 464 seats over shell boss 436. The motor shaft mounts to the center of the fan boss 464 (motor shaft securement means not illustrated.) Located around the outer perimeter of base 462 are a number of arcuately spaced apart blades 466.

A ring 468 is disposed over the top surfaces of the blades 466. While in cross section ring 468 is flat, the ring has a tapered profile. Thus the inner edge of the ring is located above the outer edge. This change in lateral elevation of the ring 468 approximates the similar rise in elevation of the fan base 362. This profile of having these surfaces rise to the center approximates the curvature towards the center of the caudal portion of the skull. This is the portion of the head over which the ventilation unit 274 is centered.

Figure 45A:
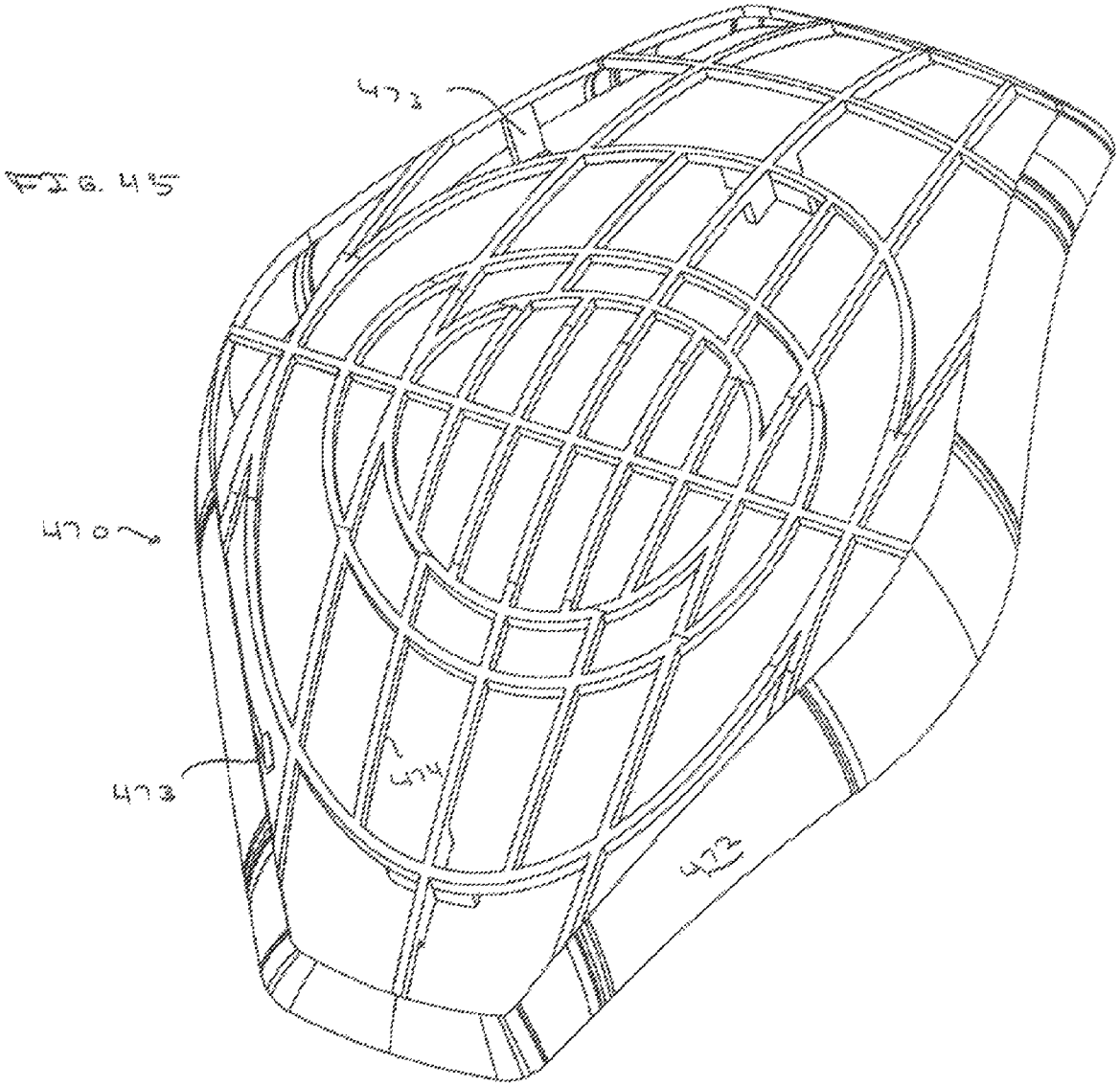
FIG. 45 is a perspective view of the ventilation unit grill unit.

A grill unit 470, also part of ventilation unit 274, is disposed over the top of the upper shell 430. As seen in FIG. 45, the grill unit 470 includes a frame 472. The frame 472 generally has a shape similar to that of the lid. However, frame 472 is sized to fit wholly on the outer surface of the upper shell lid 472. The frame, while formed from a set of flat strips of plastic, is shaped so that the strips are tapered inwardly. Thus the outer edges of the individual strips forming the frame are the surface of the grill unit 470 that seat against the adjacent outer surface of the upper shell lid 450.

Formed integrally with frame 472 is a lattice 474. The lattice is formed from a number of crossing webs. The lattice 474 extends over lid opening 453 and fan 433. Shown extending downwardly from frame 472 are snap tabs 473. When ventilation unit 274 is assembled snap tabs lock in openings 475 in the upper shell (FIG. 43) to hold the grill unit to the upper shell.

The motor cover 444, best seen in FIG. 46, is fitted to the exposed under surface of the lower shell base 432. Motor cover 444 has a main body 480 that, while sheet like in shape, is curved along its longitudinal axis. Motor cover main body 480 is also curved into the center of the longitudinal center axis. Again, this curvature approximates the curvature of the portion of the skull over which the ventilation unit is typically seated. The front end of the main body has a straight edge; the rear end has a curved profile between the side edges. The motor cover 478 is further formed to have a lip 482 that extends upwardly from the outer perimeter of the main body 480. More particularly, the lip 482 extends upwardly along the side and rear edges of the cover body 480.

Four feet 484 interrupt the lip 482. Each foot 484 is generally L-shaped and extends upwardly in the same direction as the lip 482. Each foot 484 extends from the cover main body 480. Two of the feet 484 are located immediately behind the front edge of the cover base 432. The remaining two feet 484 are located forward of the curved rear end. Each foot 484 has an outwardly extending toe 486. Toes 486 extend above the outer edges of the adjacent lip 482. Motor cover 444 is secured to the lower shell 428 by snap fitting toes 486 in shell openings 442.

Motor cover 444 is further formed so that, one each side, forward the rear end and rearward of the rear located feet 484, there is a gap 489 in the lip 482.

The motor cover main body 480 is formed with a slot 490 that extends along the longitudinal axis of the body. Slot 490 starts at the front end of the body. The slot 490 terminates at a location forward of the rear end of the main body 480. Immediately rearward of the front end of the main body 480, motor cover 444 is formed with two flexible fingers 492. The fingers 492 are located diametrically opposite each other relative to slot 490. The finger 492 are formed integrally with the rest of the motor cover 444. Each finger 492 has a tip 494 that extends upwardly in the same direction as lip 482.

Ventilation unit 274 is partially suspended above the head of the wearer by arch 388. When head unit 270 is assembled, the upper end of the arch 388 is sandwiched between the outer surface of the lower shell 428 and the motor cover 444. Fasteners, (not illustrated,) hold the lower shell 428, and therefore the whole of the ventilation unit 274, to the arch. When motor cover 444 is secured to the lower shell 428 the arch extends through the gaps 489 in the cover lip 482.

Figure 34:
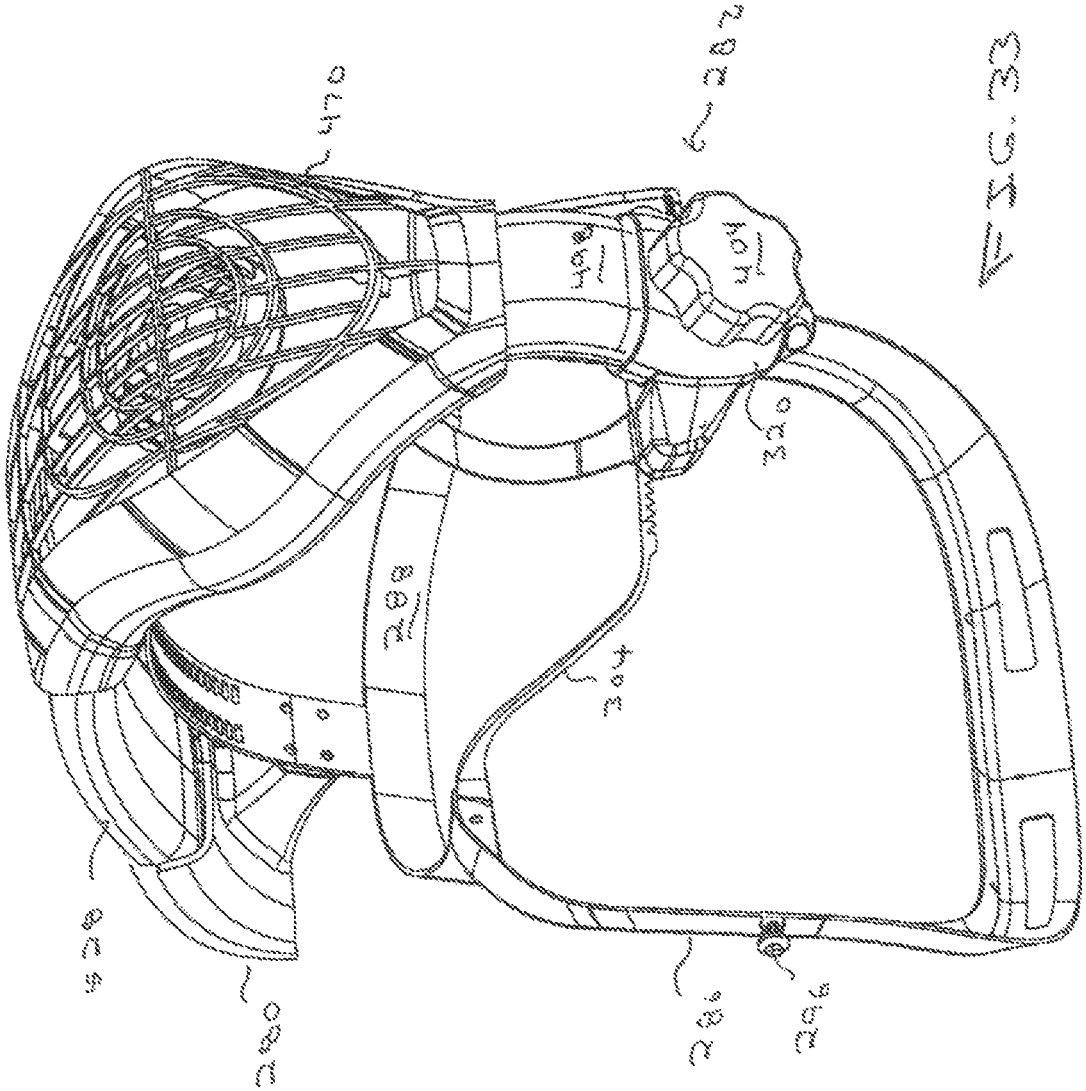
FIG. 34 is an exploded view of the head unit.
Figure 28:
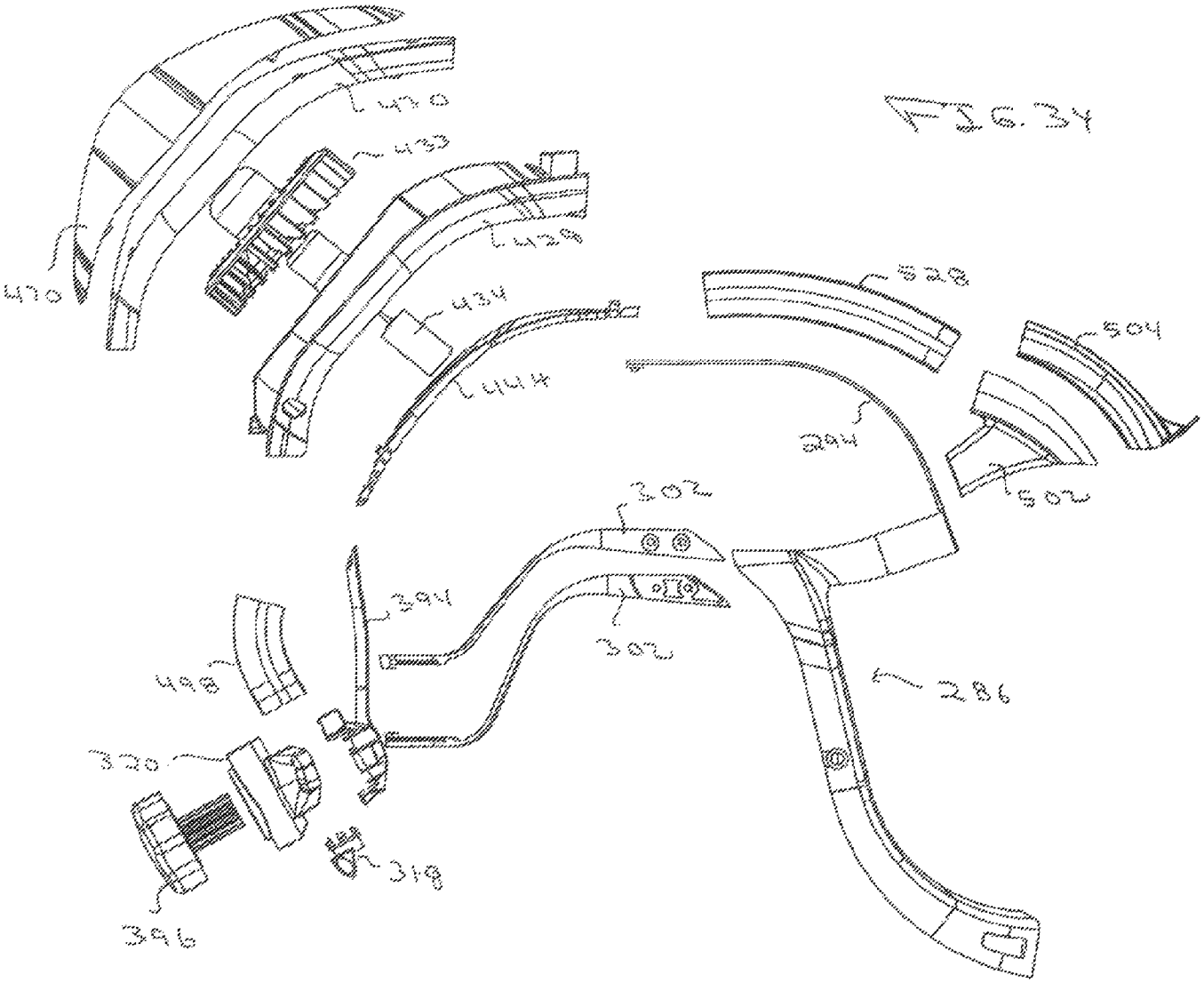
Figure 3H:
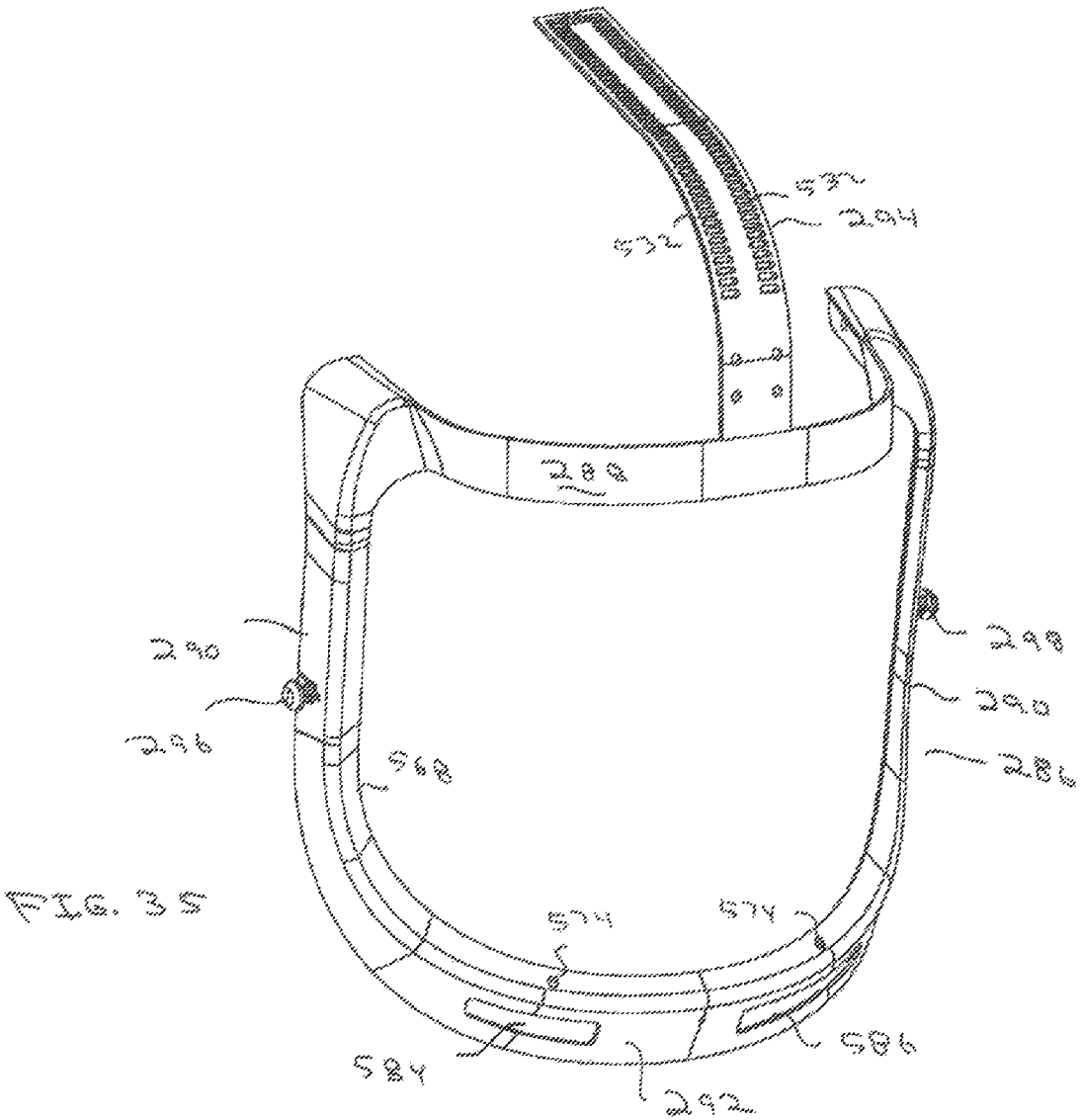

An accordion-like rear bellows 498, seen in FIGS. 33 and 34, functions as the conduit from the rear end opening of the ventilation unit 270 to the rear nozzle assembly 282. At the ventilation unit end, rear bellows 498 extends through the generally oval shaped opening formed by the ends of the lower and upper shells 428 and 430, respectively. The forwardmost rib of the rear bellows 498 (rib not identified) is seated in the slot around this opening defined by adjacent lower shell ribs 442 and 444 the aligned adjacent upper shell ribs 458 and 460.

The rear end of rear bellows 498 seats in the oval opening defined by the adjoining top ends of the rear nozzle assembly shell trunk 322 and plate collar 378. The rear most rib of the rear bellows 498 is seated in the slot around this opening defined by shell ribs 330 and 332 and adjacent collar ribs 384 and 386.

Figure 47:
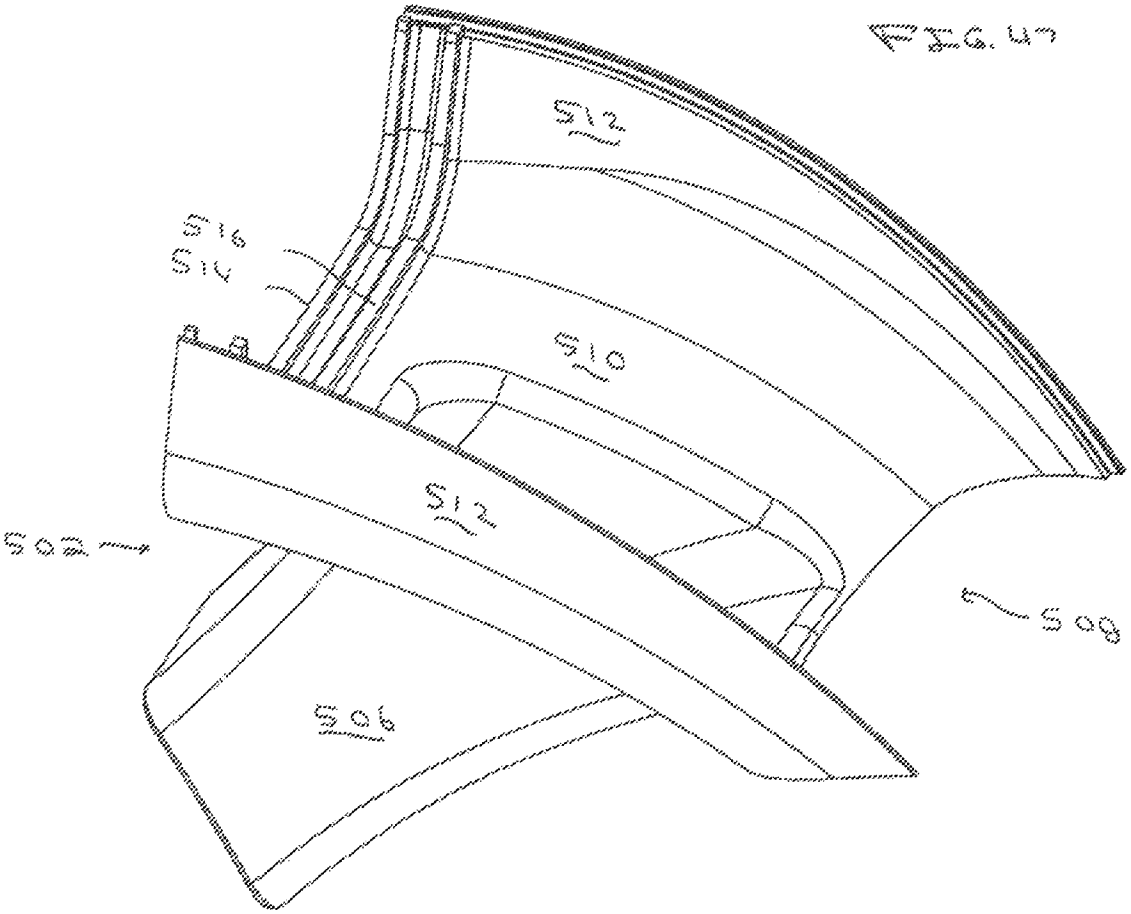
FIG. 47 is a perspective view of the front nozzle assembly pedestal.

Front nozzle assembly 280 includes a pedestal 502 and a cap 504. The pedestal 502, seen best in FIG. 47, includes a hollow post 506. Post 506 has a generally rectangular cross sectional profile. The base of the post 506 is secured to the section of the face frame support strap 294 immediately above the forehead band 288. Not shown are the fasteners used to accomplish this securement.

Above post 506, pedestal 502 has a head 508. The head has a planar base 510 that extends outwardly from the front, back and sides of the pedestal. Side walls 512 that curve upwardly from the opposed longitudinal sides of the base 510 complete the head 508. Two ribs 514 and 516 extend inwardly from the inner surfaces of the base 510 and side walls 512. Rib 514 is located around the rear end of the pedestal head 508. Rib 516 is parallel to and located forward of rib 514.

Figure 48:
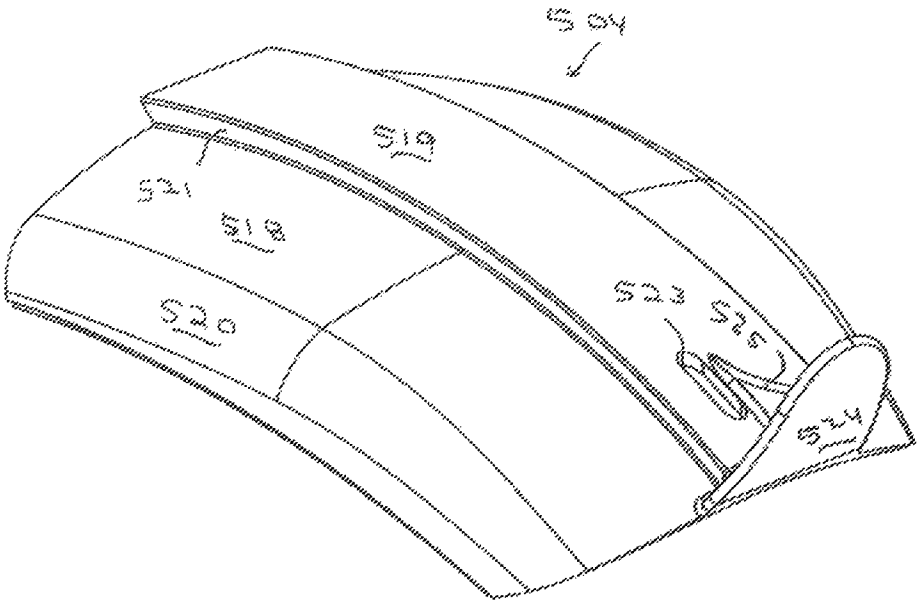
FIG. 48 is a perspective view of the front nozzle assembly cap.

Cap 504 seats over the pedestal head 508 to complete the front nozzle assembly 280. Referring to FIG. 48, it can be seen that the cap 504 has a top panel 518 from which two side panels 520 curve downwardly (one side panel shown). The cap 504 is further formed so that the top panel 518 is curved along its longitudinal axis. When the front nozzle assembly 280 is put together, the cap side panels 520 abut the top edges of the pedestal head side walls 512.

The front nozzle assembly cap 504 is further shaped so that a rib 519 extends along the longitudinal axis of the cap top panel 514. The rib 519 is formed so as have slots 521 that extend inwardly from the sides (one slot shown.) At the front end of the top panel 518, a tab 524 extends upwardly. Tab 524 is thus located immediately in front of rib 519. A small web 525 extends perpendicularly from tab 524 to the rib 519. Flange 525 is extends upwardly from the longitudinal axis of the rib 519. Immediately behind tab 524, an elongated slot 523 is formed in the rib 519.

While not illustrated, it should be appreciated that a pairs of ribs extend inwardly from the inner surface of the cap top panel 518 and side panels 520. A first one of these ribs abuts pedestal rib 514. The second cap rib abuts pedestal rib 516.

A front bellows 528 seen best in FIGS. 31 and 34, similar in structure to rear bellows 498, serves as the conduit through which the forced air from the ventilation unit 274 is output to the front nozzle assembly 280. The rear most rib internal to front bellows seats in the slot defined by lower shell ribs (not illustrated) and adjacent upper shell ribs 454 and 456. The front most rib internal to the front bellows 528 seats in the slot defined by pedestal ribs 514 and 516 and the adjacent complementary ribs formed on the cap 504.

Support strap 294 assists in the suspension of the ventilation unit 274 above the head of the wearer as now described by reference to FIGS. 29 and 31. Specifically, when the support strap 294 extends through the open front end of the motor cover 444 below the lower shell 428. Returning to FIG. 35, it is noted that the support strap is formed with two rows of parallel openings 532. Openings 532 extend laterally across the support strap 294. The pairs of openings 532 are spaced apart from each other longitudinally along the length of the strap.

When support strap 294 is positioned between the lower shell 428 and the motor cover 444, finger tips 494 seat in a pair of opposed strap openings 532. This engagement of the motor cover 444 to the support strap 294 serves to provide a front support for the ventilation unit 274 above the head of the wearer.

Owing to the flexibility of the rear nozzle assembly arch 388, ventilation unit 274 is able to pivot around the rear attachment of the unit rear nozzle assembly 282. Motor cover fingers 492 are flexible. This means the position of the ventilation unit 274 can be selectively set to be relatively close to or spaced from the front nozzle assembly 280. Collectively, this adjustability of the ventilation unit 274 means that the unit may be positioned relative to the head of the wearer wherein it will least likely impose a strain on the wearer.

Strain on the wearer is also reduced by the fact that the center of gravity of the ventilation unit 274 is relatively close to the seventh cervical vertebra. This goal is accomplished by shaping the components such as the lower shell 428, upper shell 430 fan 433, motor cover 444 and grill unit 470 so that they extend downwardly from their centers. As discussed above, this shaping approximates the back of the skull, the portion of the head against which the ventilation unit is typically fitted.

Still another reason this invention minimizes strain on the wearer is that the head unit is relatively light in weight. The head unit 270, include the head band 272, the ventilation unit 274 the front nozzle assembly 280, the rear nozzle assembly 284 and face frame 286 typically has a weight of less than 450 grams. In more preferred versions of the invention, this assembly has a weight of less than 400 grams.

In regard to the minimization of this strain, experiments with head mounted equipment have shown that the strain is kept to the minimum if the center of mass is located over the seventh cervical vertebra. Thus a wearer of this head unit 270 is able to configure the unit so that the unit's center of mass is located as closely as possible positioned over this landmark. Again this position can be accomplished regardless of the head size of the wearer.

Regardless of the adjustment of the size of the head band 272 and the position/orientation of the ventilation unit 274 relative to the head band, the discharge opening of the front nozzle assembly 280 remains at a fixed position relative to the forehead band 288. This means the transparent shield, which is suspended from the front nozzle assembly, remains a constant distance from the forehead band 288 and thus the face of the wearer. Therefore, the air flow discharged from the front nozzle assembly remains a constant distance away from the face of the wearer, regardless of the sizing of the head unit 270. This means the front nozzle is positioned, regardless of head unit configuration, to ensure the discharge of air is at the appropriate position relative to the wearer's face to ensure, there is proper purging of $CO_2$ away from the face and delivery of relatively cool make up air.

Still another advantage with maintaining the front nozzle assembly 280 at a relatively constant position in front of the face is associated with hood/toga placement. As discussed below the hood/toga face shield 590 (FIG. 52) is suspended from the front nozzle assembly 280. Again since this assembly 280 is at relatively constant position relative to the face, transparent shield 590 is likewise at a constant distance from the face. This means the shield 590 can be located at a position so that regardless of head unit adjustment glare from either the light 276 or ambient light is keep to a minimum.

Similarly, regardless of the adjustment of the head unit, the rear nozzle assembly 282 remains essentially a constant distance from the neck of the wearer. This ensures that air discharged from tip 318, regardless of head size and shape, optimally cool the neck.

Another advantage of so locating the transparent shield 590 essentially a constant distance from the face is that the shield can be sized to ensure that regardless of head size the field of view is essentially constant. In an ideal construction of the invention, no aspect of the head unit and the hood/toga is within the field of view except the transparent shield 590. This can reduce feelings of claustrophobia an individual may developing using the system.

Figure 50:
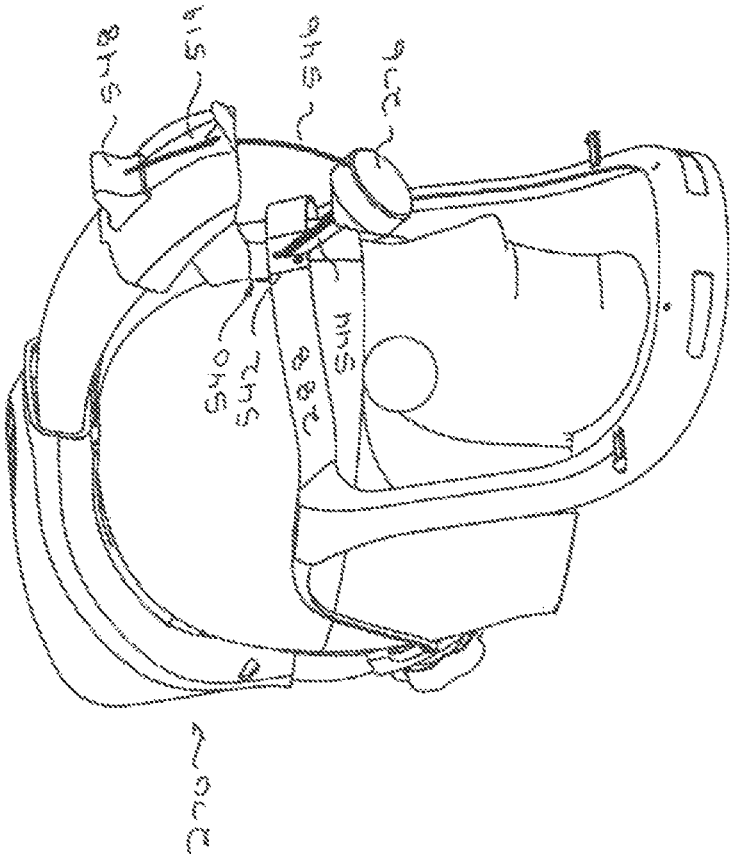
FIG. 50 depicts how the flex circuit is attached to the front frame chin bar.

The support strap 294 is formed at the tail end thereof with a small downwardly directed tab 295 (FIG. 50). This tab extends through slot 490 formed in the motor cover. The tab provides a visual indication of the extent to which the support strap 294 is extended into or retracted away from the ventilation unit 274.

As seen in FIG. 49, the light 276 is a self contained unit that includes an LED (not illustrated) or other light emitting element. Light 276 is pivotally mounted to a bracket 540 that is attached to forehead band 288. Specifically, the bracket 540 includes a flat base 542. Fasteners, (not illustrated,) hold the bracket base 542 to the face frame forehead band 288 immediately below support strap 294. Two arms 544 extend diagonally downward from base 542. The light is pivotally mounted to and between the free ends of the bracket arms 544.

A support wire 546 controls the up/down angle of the light 276. The wire extends from a small tab 548 that is slidably mounted to the rib 519 on the top of the front nozzle assembly. The tab 548 has feet (not illustrated) that sit in rib slots 521. The feet-in-slot arrangement facilitates the friction fitting of the tab 548 along the length of the rib 519 so that the tab can be slid to a left in position.

Wire 546 extends from tab 548 through cap opening 523 to the light unit 276. The pivotal up/down position of the light 276 is set by adjusting the position of the tab 548 along the length of the front nozzle assembly 280.

As seen in FIG. 50, a flex circuit 560 is mounted to the inner surface of the face frame chin bar 292. Flex circuit 560 supports two lower power indicator LEDs 562 and 564 and a microphone 566. While not illustrated it should be understood that layered on the flex circuit are the conductive traces that extend to the LEDs 562 and 564 and the microphone 566.

More particularly, returning to FIG. 35, it can be seen that the face frame 286 around the posts 290 and chin bar 292 has an inwardly directed lip 568. The flex circuit 560 has a main body 570 with generally rectangular shape. Three fingers 572 integral with the flex circuit main body 570 extend upwardly from the main body at longitudinally spaced apart locations along the upper side surface of the main body. The LEDs 562 and 564 are mounted to the outer surface of the two outer flex circuit fingers 572. Each LED 562 and 564 extends through a separate opening 574 formed in the face frame chin bar lip 568.

The microphone 566 is mounted to the center located flex circuit finger 572. This finger 572 wraps around so as to overlap the flex circuit main body 570. A cap (not illustrated) is fit over the chin bar 292 to cover the flex circuit. The microphone 566 extends through an opening in this cap so as to be directed to the mouth of the wearer.

Figure 22:
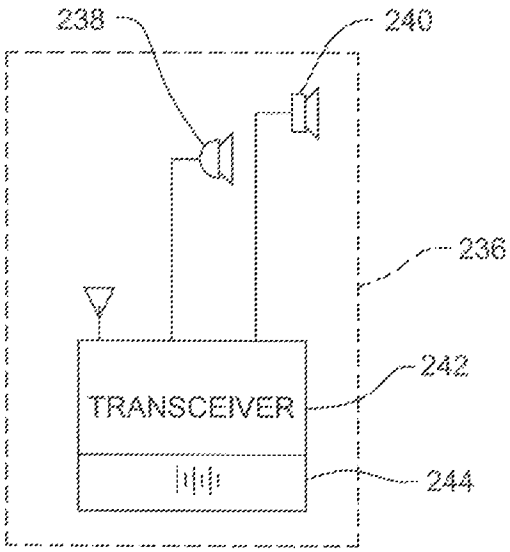
FIG. 22 is an electrical block diagram of a communications system.
Figure 23:
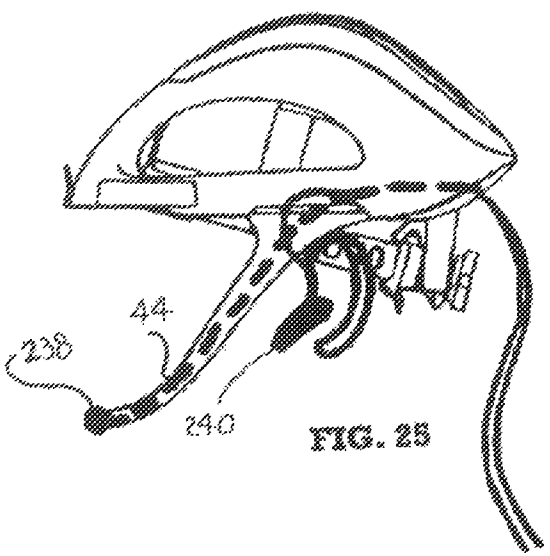
FIG. 23 is a side view of the helmet assembly illustrating a microphone of the communications system.
Figure 24:
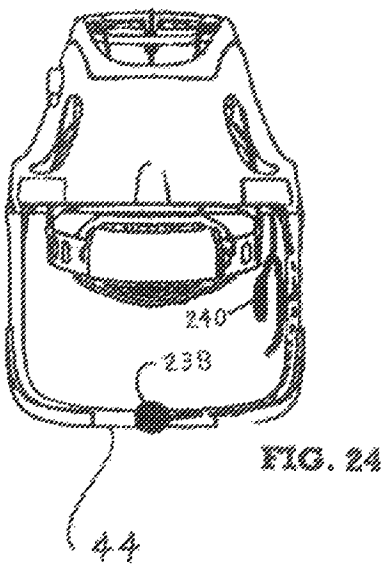
FIG. 24 is a front view of the helmet assembly illustrating the microphone and a speaker of the communications system.
Figure 25:
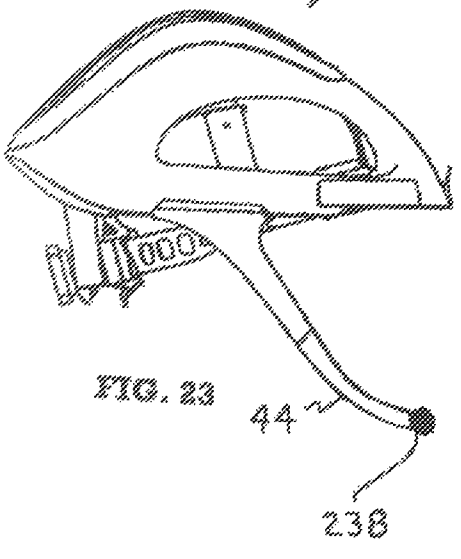
FIG. 25 is a side view of the helmet assembly illustrating the microphone and the speaker of the communications system.

A first one of the LEDs, arbitrarily LED 562, performs the function of the power monitor enunciator 234 (FIG. 22). Thus LED 564 is illuminated whenever the power monitoring circuit determines that the battery 562 is almost discharged.

The second LED, LED 564, and microphone 566 are associated with the communications unit internal to the head unit 270. The microphone 566 converts the words spoken by the wearer into electrical signals. The transceiver controller circuit 256 actuates switch 258 to place the communications system in the "mute" mode.

Figure 51:
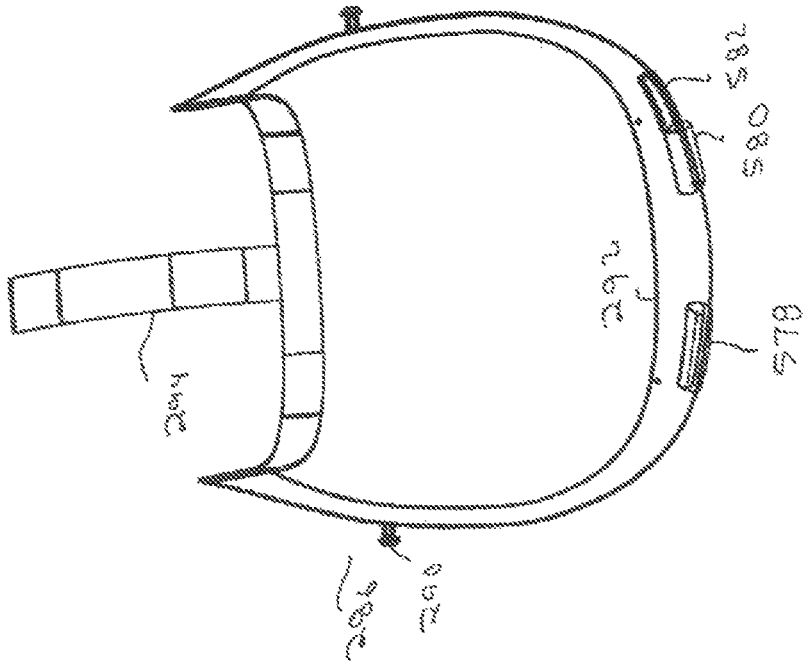
FIG. 51 depicts how switches are mounted to the front frame chin bar.
Figure 50:
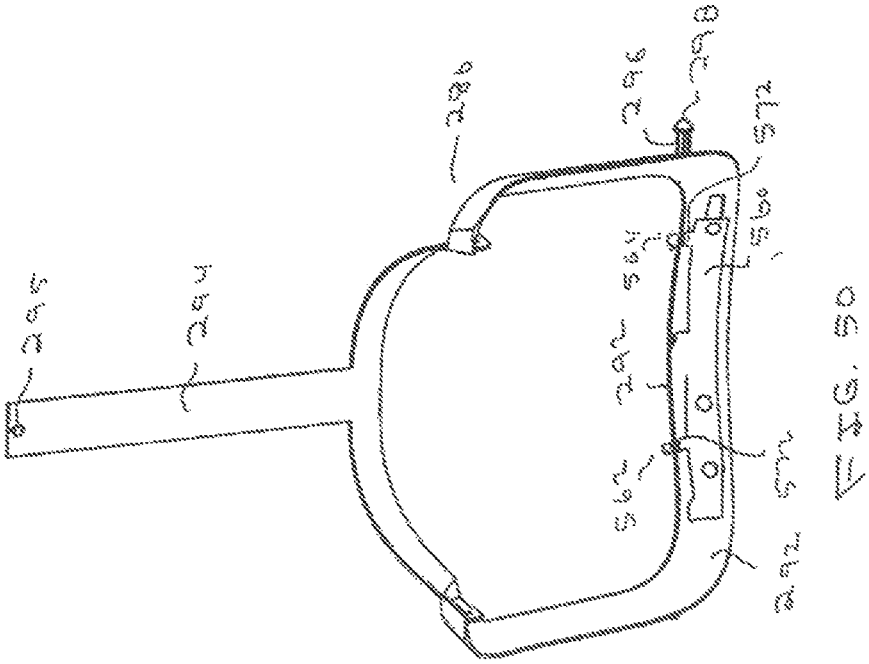

Also mounted to chin bar 292 are the wearer actuated switches 578, 580 and 582, seen in FIG. 51, for controlling the system. The switches 578, 580 and 582 are formed from silicon rubber and have carbon contacts. A first one of the switches, switch 578, is mounted in a first opening 584 defined by the chin bar 292. The remaining two switches 580 and 582 are mounted in a second chin bar opening 586.

Flex circuit main body 570 is disposed over the chin bar openings 584 and 586. Formed on these surfaces of the flex circuit 560 are the conductive traces against which the switch carbon contacts abut (contacts not shown.) A first one of the switches, switch 578, performs the function of switch 258. This switch 578 is actuated to take the communications system in and out of the mute mode. The remaining two switches are analogues to switches 120 and 122. Switches 580 and 582 thus are depressed to regulate the speed of the ventilation unit fan 278.

An advantage of the above placement of switches 578, 580 and 582 is that the switches are immediately in front of the wearer. This makes it relatively easy for the wearer, by moving a hand towards his/her head to actuate the switches. Thus, an individual wearing this unit 270, for most definitions of a sterile field, does not have to move his/her hand out of the field in order to actuate the switches.

Figure 52:
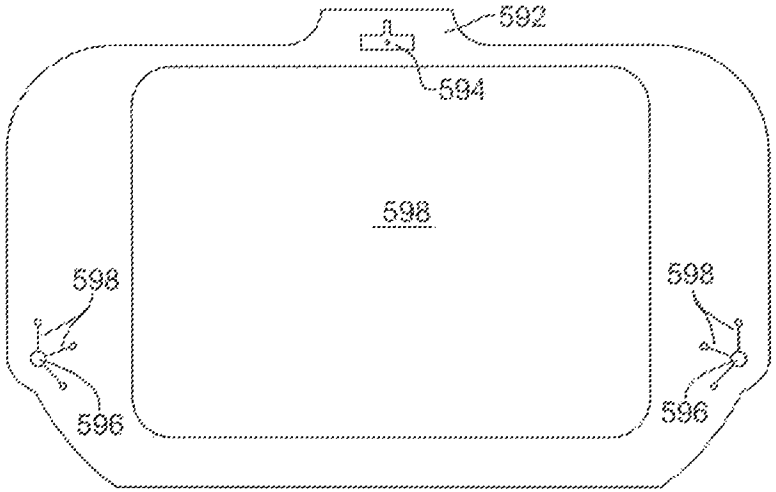
FIG. 52 is a plan view of the hood/toga transparent shield used with the head unit.

FIG. 52 illustrates the transparent shield 590 attached to a hood or toga used with head unit 270. Shown as a dashed line is the position internal to the perimeter of the shield 590 around which the sterile material forming the hood or toga is secured to the shield 590. The top of the shield 590 is formed to have a tab 592. Tab 592 has a slot shaped opening 594. Opening 594 is rectangular in shape and on an axis parallel to the latitudinal, right-to-left axis of the shield 590. The opening 594 further has an extension slot 595 that extends upwardly. Extension slot 595 is centered on the longitudinal, up-to-down axis of the shield 590.

Shield 590 is formed to have two circular openings 596. Each opening 596 is located adjacent a side edge of the shield 590 above the curved edge that functions as the transition edge between the side edge and the shield bottom edge. Cuts 598 extend radially from each opening 596. It is appreciated that openings 594 and 596 are located in the perimeter section of the shield 590. This is the section of the shield that is covered by the material forming the sterile hood or toga.

When the hood or toga is to be fitted to head unit 270, the shield is placed over the head unit so that the tab 524 integral with the front nozzle assembly 280 is inserted in shield opening 590. Front nozzle assembly web 525 seats in opening extension slot 595. This seating of the shield 590 over the static tab 524 and web 525 serves to align the shield with the outer components of the head unit 270 and prevent rotation of the aligned shield.

Shield 590 is then curved around the face frame 286. This flexing of the shield 590 brings each of the shield openings 594 into alignment with a separate one of the face frame pins 296. Shield openings 594 are smaller in diameter than heads 298 of the mounting pins 296. Thus, at this time the shield 590 is snap fitted over pins 296. This engagement secures the shield 590 and the associated hood or toga, to the head unit.

In this version of the invention, there is spacing of at least 3 cm between the topmost attachment of the shield 590 to tab 524 and where the shield is attached to the two laterally spaced apart pins 296. As a consequence of this arrangement, when the shield is fitted to the head unit 270, the radius of curvature of the shield varies along the top to bottom longitudinal axis. More particularly at the top of the shield, adjacent the tab, there is a relatively wide diameter radius of curvature. Between pins 296 the shield has a smaller diameter of curvature, a more pronounced curvature.

An advantage of this construction is that near eye level the less curved, relatively flat, shield profile minimizes the amount glare. This arrangement also serves to assist in the shield's suspension of the material forming the hood/toga away from the forehead and top of the wearer's head. This feature provides a relatively large transparent shield-hood free space around the top of the head. This reduces the effort required to fit auxiliary equipment, such as a heads up display, a camera, other communication devices or lights around the wearer's head.

Another advantage of this configuration of this invention is that openings 594 and 596 serve as the means integral with the shield 590 for holding the shield to the head unit 270. This arrangement eliminates the need to provide snap heads, magnets or hook-in-fabric fastening strips to the hood/toga on the shield in order to facilitate the attachment of the shield to the head unit. The elimination of these fastening members results in a like elimination of the costs associated with providing the shield with these components.

VII. Alternative Light, Communications and Fan Unit

Figure 53:
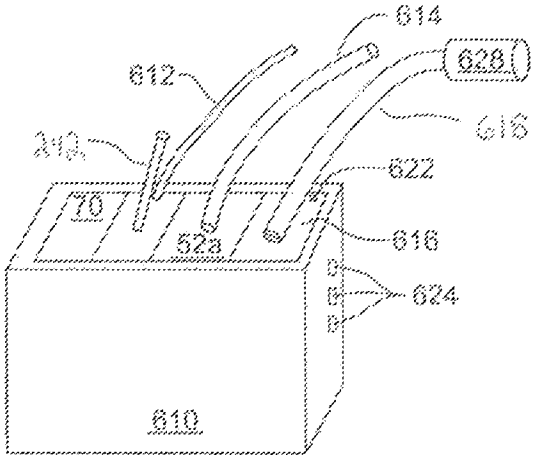
FIG. 53 is a block diagram of how the power supply, the fan, the transceiver and light generating source of the personal protection system of this invention are contained in a common housing.

FIG. 53 is a diagrammatic illustration of how a number of components of the personal protection system 10 of this invention are, in some versions of the invention, contained in a single housing 610. Housing 610 is configured to be worn someplace on the individual. For example, the housing 610 may include a clip (not illustrated) so it can be attached to an article of clothing such as a belt. The housing 610 may alternatively include a strap (not illustrated) so it can strapped to the individual.

Internal to the housing 610 is the power supply 70. Also integral with the housing is the transceiver 242. A cable 612 that leads to head of the individual includes the conductors that are connected to the microphone 238 and speaker 240. In these and other versions of the invention, the microphone and speaker may be built into a head set separate from the structure used to suspend the hood. Also disposed inside housing 610 is a fan 52*a*. The majority of the airflow output by the fan is discharged through a flexible tube 614. Tube 614 is connected to the output vents in the body support structure from which the air should be discharged.

A light generating unit 616 is also contained housing 610. The light generating 616 unit may contain an LED or an incandescent bulb such as a halogen bulb. A fiber optic cable 618 extends from the light generating unit 616. The distal end of the fiber optic cable is attached to the light emitting head 620 attached to the body support structure.

In this version of the invention, the outlet flow from the fan 52*a* is discharged from two ports, (not shown). The proximal end of tube 614 is connected to one of the ports. The second port leads to a duct 622 in the housing. Duct 622 is located between the face of the sub housing 302 in which the light generating unit 616 that would be closest to the wearer of the system 10 and the adjacent structural wall of the housing 610. Thus, the system is actuated fan 52*a* continually blows new make-up air into duct 298. The air is discharged from exhaust ports 624 formed in the side of the housing 610. This constant supply of this air minimizes the extent to which the heat generated by the light generating unit 616 convectively warms the housing 610 and the adjacent portion of the body of the wearer.

An advantage of this version of the invention is that he majority of the weight of the active components of the personal protection system 10 are suspended from the waist or other body part of the user where the presence of such weight does not induce significant appreciable physical stress.

VIII. Alternative Features

Body-worn support structures for suspending the hood other than the illustrated and described helmet may be employed in this invention. One possible structure is a shoulder mounted frame. This frame contains structural members for supporting the hood. This fan or light generating unit may be directly mounted to this support structure. In versions of the invention where both components are so mounted to the support structure, a duct is present to circulate a fraction of the air discharged by the fan around the light generating unit. Alternative embodiments of this version of the support structure of this invention may simply have ducts for receiving the air and ports through which the air is discharged and a light emitting head for emitting the light. In these versions of the invention the waist mounted unit contains the fan and the light generating unit.

In some versions of the invention, the body support structure includes a vest like garment worn about the trunk of the wearer. Integral with this garment are one more supports from which the hood is suspended.

Also, in some versions of the invention, the support unit may include an outwardly directed speaker. For example, this speaker could be mounted to flex circuit 560. In these versions of the invention, there is also an amplifier capable of amplifying the signals produced by microphone 566. These signals are broadcast by this speaker through the hood/toga into the surrounding environment. This arrangement eliminates the need to provide RF signal transceivers.

It may also be desirable to provide the transparent shield of the hood/toga with at least one section that transmits sound. (Generally the material forming the transparent shield absorbs or reflects sound.) Thus, the transparent shield could be formed an opening that is generally aligned with the mouth of the wearer. This opening is covered with a section of the sterile material from which the rest of the hood/toga is formed. This construction can eliminate the need to provide any assembly for broadcasting or amplifying the speech of the wearer.

Alternatively the transparent shield opening may be covered with material that absorbs and retransmits sound waves. Electrometric materials such as a silicon rubber may perform this function.

It should likewise be appreciated other duct assemblies may be provided to direct air from the ventilation fan to the light generating unit. For example, there may be a duct within either the front or rear nozzle assembly that leads directly to the light source. This duct extends to a conduit, which may be flexible, that extends to the light source. In some versions of the invention, this conduit opens into the inside of the housing of the light source. Thus, the air passes directly over the heat generating, light emitting elements or heat sink elements internal to the light source housing.

Alternatively, in some versions of this invention, the light source has its own ventilation fan. This arrangement may be useful if it is necessary to flow large volumes of air over the light source.

In either of the above versions of the invention, the light source may be formed with a conduit through which the air introduced into the source is exhausted. This conduit has an exhaust port that opens away from the wearer.

It may also be desirable to position a temperature sensitive transducer adjacent the heat generating components of the light source. The signal output by this sensor can be used to regulate the light source and/or the fan that provides the air for cooling the light. Thus when this sensor indicates the temperature adjacent the light source is rising to uncomfortable levels, the current regulator 230 could respond by reducing the power supplied to the light. When this condition is detected, alternatively, microcontroller 118 could step up the speed of the fan so as to increase the air flow over the light source.

It should be appreciated that there are reasons other than wearer comfort for so controlling the temperature of the light source and the space surrounding the source. This excessive heating of the light source can appreciably diminish its useful life. In some instances, the excessive heating of the source can cause its failure. Also, this heat, if not exhausted, could potentially warm the user to the point at which the skin blisters or is burned.

In some versions of the invention a heat pipe formed from thermally conductive material extends from the light source. This heat pipe may extend to a duct that extends from the fan.

An anti glare hood may be fitted over the light emitting head so as to extend between the head and the inner surface of the transparent shield. The inner surface of this hood is formed from light reflective or absorbing material. This arrangement reduces, if not eliminates, the amount of light emitted by the head that is reflected by the inner surface of the transparent shield back to the wearer as glare.

This hood may be formed from rigid or flexible material. One advantage of employing flexible material is that it can ensure the hood abuts the inner surface of the transparent shield when the shield is fitted to the helmet or head unit.

Some light systems may also be configured to provide the wearer with short bursts of high intensity light. This light is provided in response to depression of a specific control switch. The light burst may be provided in situations in which a very large amount of light is required. Only a burst of light for a period between 1 to 10 minutes is provided. Only the burst is provided so as to minimize the possibility this high driving of the light source results in excessive heat being output or the source or the source being excessively operated to the level at which it may burn out.

Devices other than the bellows may be employed as the adjustable conduits that connect the ventilation unit 274 to the front and rear nozzle assemblies 280 and 284, respectively. For example, telescoping tubes and/or tubes with flexile joints may be employed as these conduits.

Further, there is no requirement that in all versions of the invention two spaced apart support members, support strap 294 and arch 394 both be provided to suspend the ventilation unit 274 above the head band 272. In some versions of the invention, a single support member or support post may be all that is required.

Also, in not all versions of the invention may it be necessary to attach the front ventilation unit 280 to the head band 272. Thus, in some versions of the invention the adjustable conduit that extends from the ventilation unit 274 to the front nozzle assembly 280 provides support for suspending the front nozzle assembly in a specific position relative to the head band.

Further, there is no requirement that the all versions of the invention include both the front and rear nozzle assemblies 280 and 282. Clearly most units will include the front nozzle assembly.

Thus it should be clear that the foregoing description is directed to specific embodiments of the invention. Therefore, it is an object of the appended claims to cover all such modifications and variations that come within the true spirit and scope of this invention.

What is claimed is:

1. A personal protection system, said system comprising:

a helmet shaped to be worn over the head of the wearer;

a fan disposed in said helmet for drawing air into said helmet;

at least one nozzle connected to said helmet for receiving air from said fan and discharging the air outwardly from said helmet;

a chin bar that is connected to said helmet and that is located below said helmet so that said chin bar is located forward of the chin of the wearer, said chin bar being shaped to extend at least partially around the chin of the wearer;

at least one control button that is mounted to said chin bar for regulating operation of said personal protection system;

a hood that extends over said helmet, said fan and said chin bar, including said at least one chin bar-mounted control button, said hood having a transparent face shield; and fastening features attached to said helmet that engage said hood so as to releasably hold said hood over said helmet, said fan and said chin bar so that said face shield is located forward of said chin bar.

2. The personal protection system of claim 1, wherein said at least one control button is mounted to said chin bar so as to be facing outwardly from said chin bar.

3. The personal protection system of claim 1, wherein two said posts extend downwardly from said helmet and said chin bar extends between ends of said posts distal to said helmet.

4. The personal protection system of claim 1, wherein at least one said helmet fastening features for holding the hood to said helmet is attached to the chin bar.

5. The personal protection system of claim 1, wherein plural said control buttons are mounted to the chin bar.

6. The personal protection system of claim 1, wherein said at least one control button is connected to said fan to control said fan.

7. The personal protection system of claim 1, wherein:

a communications unit is mounted to said helmet; and said at least one control button is connected to said communications unit to control said communications unit.

8. The personal protection system of claim 1, wherein said hood is part of a toga.

9. The personal protection system of claim 1, wherein:

said helmet includes: a head band; and a shell, said shell being mounted to said head band so as to be located above the head of the wearer; and said fan is contained in said shell.

10. A head unit for use as part of a personal protection system, said head unit comprising:

a helmet shaped to be worn over the head of the wearer;

a face frame that is connected to said helmet and that extends downwardly from said helmet, said face frame having a chin bar that extends around and forward of the chin of the wearer;

at least one first fastening feature attached to said helmet and at least one second fastening feature attached to said face frame, said first and second fastening features shaped to engage complementary fastening features integral with a hood that has a face shield so that, when said fastening features are engaged, the hood is disposed over said helmet and the hood face shield is located forward of said chin bar;

a fan disposed in said helmet for drawing air into said helmet and the hood;

at least one nozzle connected to said helmet for receiving air from said fan and discharging the air outwardly from said helmet; and at least one control button that is mounted to said chin bar and connected to said fan for regulating operation of said fan.

11. The head unit of claim 10, wherein said at least one control button is mounted to said chin bar so as to be facing outwardly from said chin bar.

12. The head unit of claim 10, wherein said at least one second fastening feature is a pin that is connected to and extends outwardly from said face frame, said pin adapted for insertion into an opening formed in the hood face shield.

13. The head unit of claim 10, wherein:

said face frame includes at least one post extends downwardly from said helmet and said chin bar is connected to said at least one post; and said at least one second fastening feature is mounted to said at least one post of said face frame.

14. The head unit of claim 10, wherein said at least one first fastening feature and said at least one second fastening fastener are each configured to engage the hood face shield and are further collectively configured and arranged so that when said first and second fastening features engage the hood face shield, the face shield develops a radius of curvature that varies along the length of the face shield such that, adjacent said chin bar the radius of curvature of the hood face shield is small and, spaced upwardly from said chin bar, the radius of curvature of the hood face shield is large.

15. The head unit of claim 14, wherein:

said helmet has a single said first fastening feature; and plural said second fastening features are attached to said face frame and said second said fastening features are spaced outwardly from said first fastening feature.

16. The head unit of claim 10, wherein plural said second fastening features are attached to said face frame.

17. The head unit of claim 10, wherein said first fastening feature is a tab shaped to seat in an opening formed in the hood.

18. The head unit of claim 10, further including a microphone mounted to said chin bar.

19. The head unit of claim 10, further including an indicator light mounted to said chin bar.

20. The head unit of claim 10, wherein plural said control buttons are mounted to said chin bar.

21. The head unit of claim 10, wherein said chin bar is formed from flexible material.

22. The head unit of claim 10, wherein:

said helmet includes: a head band; and a shell, said shell being mounted to said head band so as to be located above the head of the wearer; and said fan is contained in said shell.

23. The head unit of claim 10, wherein said first fastening feature is mounted to said at least one nozzle.

24. The head unit of claim 10, wherein:

a first said nozzle extends from said fan to direct air discharged from said fan in front of the face of the wearer; and a second said nozzle extends from said fan to direct air discharged from said fan towards the neck of the wearer.

* * * * *